US007832991B2

(12) United States Patent
Wood et al.

(10) Patent No.: US 7,832,991 B2
(45) **Date of Patent: *Nov. 16, 2010**

(54) AIR COMPRESSOR WITH REMOVABLE MANIFOLD

(75) Inventors: Mark Wood, Jackson, TN (US); Robert Burkholder, Rotonda West, FL (US); Crandall Barbour, Jackson, TN (US); Mike L. Davis, Jackson, TN (US); Fred M. Morgan, Jackson, TN (US); David W. Robenalt, Jackson, TN (US); Dave C. Smith, Jackson, TN (US); John W. Hardin, Medina, TN (US); J. Cody Stilwell, Jackson, TN (US); Gary White, Medina, TN (US); Stephen J. Vos, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 471 days.

This patent is subject to a terminal disclaimer.

(21) Appl. No.: 11/652,842

(22) Filed: Jan. 12, 2007

(65) Prior Publication Data

US 2008/0044296 A1 Feb. 21, 2008

Related U.S. Application Data

(63) Continuation of application No. 10/444,708, filed on May 23, 2003, now Pat. No. 7,163,382, which is a continuation-in-part of application No. 10/410,129, filed on Apr. 9, 2003, now Pat. No. 6,923,627, which is a continuation-in-part of application No. 10/277,187, filed on Oct. 21, 2002, now Pat. No. 6,742,995, which is a continuation-in-part of application No. 09/802,149, filed on Mar. 8, 2001, now Pat. No. 6,655,925, which is a continuation-in-part of application No. 09/801,406, filed on Mar. 8, 2001, now Pat. No. 6,532,990, which is a continuation-in-part of application No. 09/801,408, filed on Mar. 8, 2001, now Pat. No. 6,532,991, which is a continuation-in-part of application No. 09/802,139, filed on Mar. 8, 2001, now Pat. No. 6,468,048.

(60) Provisional application No. 60/469,645, filed on May 12, 2003, provisional application No. 60/187,744, filed on Mar. 8, 2000, provisional application No. 60/187,680, filed on Mar. 8, 2000, provisional application No. 60/187,723, filed on Mar. 8, 2000, provisional application No. 60/187,745, filed on Mar. 8, 2000.

(51) Int. Cl.
*F04B 53/00* (2006.01)
*E03B 5/00* (2006.01)

(52) U.S. Cl. ..... 417/234; 417/572; 137/565.18

(58) Field of Classification Search ..... 417/234, 417/572, 363, 410.1; 137/565.18
See application file for complete search history.

(56) References Cited

U.S. PATENT DOCUMENTS 2,812,895 A * 11/1957 Peeps ..... 137/899.4
4,870,994 A * 10/1989 Raymond (Continued)

*Primary Examiner*—Charles G Freay
(74) *Attorney, Agent, or Firm*—Rhonda L. Barton; Michael P. Leary; Adan Ayala

(57) ABSTRACT

An air compressor assembly includes a compressor configured to provide a source of compressed air and a manifold assembly removably coupled to the compressor and configured to distribute the compressed air to one or more pneumatic tools. The manifold assembly is configured to be coupled to the compressor via an air conduit when the manifold assembly is detached from the compressor so that the manifold assembly is operable at a location remote from the compressor.

22 Claims, 57 Drawing Sheets

U.S. PATENT DOCUMENTS 5,611,485 A * 3/1997 Davis
5,878,925 A * 3/1999 Denkins et al. ..... 222/608
5,907,970 A * 6/1999 Havlovick et al.
6,375,437 B1 * 4/2002 Nolan
6,468,048 B1 * 10/2002 Burkholder et al.
6,532,990 B1 * 3/2003 Wood et al.
6,532,991 B1 * 3/2003 Wood et al.
6,655,925 B1 * 12/2003 Robenalt et al.
6,742,995 B1 * 6/2004 Wood et al.
6,923,627 B1 * 8/2005 Wood et al.
6,991,437 B2 * 1/2006 Cherry et al.
7,029,240 B2 * 4/2006 Baron et al.
7,163,382 B1 * 1/2007 Stilwell et al. ..... 417/234
2002/0131872 A1 * 9/2002 Lucchi

* cited by examiner

AIR COMPRESSOR WITH REMOVABLE MANIFOLD

CROSS REFERENCE TO RELATED APPLICATIONS

The present application is a continuation of U.S. application Ser. No. 10/444,708, filed May 23, 2003, now pending, which is a continuation-in-part of U.S. application Ser. No. 10/410,129, filed Apr. 9, 2003, now U.S. Pat. No. 6,923,627, which claims the benefit of priority under 35 U.S.C. §119(e) of U.S. Provisional Application Ser. No. 60/469,645, filed May 12, 2003; said U.S. application Ser. No. 10/410,129 is a continuation-in-part of U.S. application Ser. No. 10/277,187, filed Oct. 21, 2002, now U.S. Pat. No. 6,742,995, which is a continuation-in-part of U.S. application Ser. No. 09/802,149, filed Mar. 8, 2001, U.S. Pat. No. 6,655,925, which claims the benefit under 35 U.S.C. §119(e) of U.S. Provisional Application Ser. No. 60/187,744, filed Mar. 8, 2000; said U.S. application Ser. No. 10/277,187 is a continuation-in-part of U.S. application Ser. No. 09/801,406, filed Mar. 8, 2001, U.S. Pat. No. 6,532,990, which claims the benefit under 35 U.S.C. §119(e) of U.S. Provisional Application Ser. No. 60/187,680, filed Mar. 8, 2000; said U.S. application Ser. No. 10/277,187 is a continuation-in-part of U.S. application Ser. No. 09/801,408, filed Mar. 8, 2001, U.S. Pat. No. 6,532,991, which claims the benefit under 35 U.S.C. §119(e) of U.S. Provisional Application Ser. No. 60/187,723, filed Mar. 8, 2000; and said U.S. application Ser. No. 10/277,187 is a continuation-in-part of U.S. application Ser. No. 09/802,139, filed Mar. 8, 2001, U.S. Pat. No. 6,468,048, which claims the benefit under 35 U.S.C. §119(e) of U.S. Provisional Application Ser. No. 60/187,745, filed Mar. 8, 2000. All of the above-mentioned patent applications and patents are herein incorporated by reference in their entirety.

TECHNICAL FIELD

The present invention relates generally to the field of air compressors.

BACKGROUND

Air compressor assemblies are used to provide compressed air for operating air powered tools such as nailing tools, socket driving tools, material shaping tools, sanding tools, spray painting tools, inflation chucks, and the like. Frequently, it is desirable to operate several tools from air supplied by a single air compressor assembly. In such instances, the air outlet port or "pressure manifold" of the air compressor assembly is fitted with an adapter allowing the attachment and removal of multiple air hoses for providing air to operate several air powered tools at once. However, in many applications, the air compressor assembly must be located remotely from the workers utilizing the tools for which it provides air. For instance, at a typical construction site, a single air compressor assembly may be required to provide air to operate a plurality of tools, which, because of the physical layout of the site, are used at locations where the air compressor assembly cannot be transported. For example, workers may be working in an upper story of an unfinished building while the air compressor assembly is located on the first story. Similarly, wherein the air compressor assembly is driven by an electric motor, it may be desirable to situate the air compressor assembly near a source of electrical power such as an electrical outlet, an electrical generator, a vehicle, or the like. As a result, the amount of air hose required to couple the air compressor assembly to each tool is greatly increased, in many cases becoming unwieldy to store and transport. Furthermore, because workers are remotely located from the air compressor assembly, they often cannot readily access the air compressor assembly's pressure regulator and pressure gauges to control the amount of pressure being provided to their tools.

Air compressor assemblies in portable applications are typically transported with the use of a wheel assembly and a transport handle assembly used to guide the air compressor assembly when utilizing the wheel assembly. However, a typical transport handle assembly is not suited for lifting the air compressor assembly, such as when the air compressor assembly is loaded into a truck, needs to be transported over stairs, is lifted over uneven ground, and the like. For example, a typical transport handle may be positioned at one end of the air compressor assembly, thereby providing support to only one end of the air compressor assembly. Furthermore, an air compressor assembly may weigh hundreds of pounds, thereby requiring a substantial force to be exerted to lift the air compressor assembly.

The failure of the typical transport handle assembly to supply an accommodating way of lifting the air compressor assembly often requires users, when trying to lift the air compressor assembly to wrap their arms around the air storage tank, grasp a wheel assembly, grip the motor assembly, and engage in other very difficult and unsure maneuvers. These maneuvers may cause damage to the air compressor assembly and even injury to the user due to the size and weight of a typical air compressor assembly.

Conventionally, a condensate removal device is placed in proximity to a low point of a compressed air tank within an air compressor assembly to remove condensate that may form within a compressed air tank. During the utilization of a compressed air tank, it is common for water and other liquids to condense from the air inside the air tank as a consequence of the pressure and temperature differences inside the tank and outside the tank. Water and other liquids that may accumulate inside the air tank may be removed through the installation of a condensate removal device placed near a low point of the air tank. Typically, condensate removal devices known to the art are valves that may be opened and closed easily yet are capable of maintaining a constant pressure inside the air tank.

Since compressed air tanks tend to be large and heavy, they may not be easily transported. As a result, typical mobile compressed air tanks may be fitted to a frame comprising wheels and handlebars. This allows a person or persons to lift the compressed air tank and pull or push it to a desired location. While traveling on a smooth surface, the design works well. However, in many construction sites, movement to a remote location over an uneven and unpaved surface may be necessary. A frequent problem that occurs while moving the compressed air tank to a remote location is that the drain valve for removing condensate from an air tank may be damaged during transport to a remote location. Foreign objects tend to come into contact with the valve during transport causing damage to the valve. Another problem is that compressed air tanks may be moved during the day and typically are placed upon the bed of a pickup truck in order to transport the compressed air tank to another worksite. Since typical compressed air tanks are heavy, it is not easy for persons to use care and caution when placing the compressed air tanks onto the bed of a pickup truck. Thus, the compressed air tank may be lifted and pushed onto the bed in a quick manner. Often, other items located on the bed of the truck may come into contact with the drain valve damaging the valve when the compressed air tank is placed upon the bed of a pickup truck. Upon damage to the drain valve, the compressed air tank becomes non-functional.

A popular type of air compressor assembly comprises a compressor mounted to a horizontal compressed air storage tank. The compressed air storage tank further includes a wheel assembly consisting of a wheel mounted to each side of the tank by a wheel bracket. A handle assembly and base are mounted to the air supply tank opposite the wheel assembly. The wheel assembly and base support the air compressor allowing the air compressor assembly to be transported by lifting on the handle assembly thereby raising the base from the surface on which the air compressor rests.

One long unresolved problem with such air compressor assemblies is that they tend to be top heavy due in part to the weight of the compressor above the compressed air storage tank. Furthermore, as shown in FIG. 1, such air compressor assembly 5-100 includes a base 5-102 which has historically been made much narrower than the width of the compressed air storage tank 5-104 since the three point stance provided by the base 5-102 and wheel assembly 5-106 was sufficient to balance and provide stability to the air compressor assembly 5-100 when used in normal consumer applications. However, when such air compressor assembly 5-100 is utilized in more austere environments, such as at a construction site, where the air compressor assembly 5-100 is much more likely to rest on rough or uneven ground, it has been discovered that excessive tension (such as a sharp pull or jerk) applied to an air hose coupled to the air compressor in a direction generally perpendicular to the side of the compressed air storage tank 5-104 can cause the air compressor assembly 5-100 tip over as shown by arrow 5-108, possibly damaging the air compressor assembly or injuring its user. Similarly, when such air compressor assembly is loaded into a vehicle such as a pickup truck, or the like for transport, movement of the vehicle may cause the air compressor assembly 5-100 to tip over possibly damaging the air compressor assembly 5-100 and the vehicle. As a result, many users consider air compressor assemblies having such horizontal compressed air storage tanks less desirable for use in harsh environments than air compressor assemblies having other tank configurations.

SUMMARY

In a first aspect, a manifold assembly for an air compressor assembly is capable of controlling and distributing compressed air from the air compressor assembly to one or more air powered tools. The manifold assembly may be attached directly to an air compressor, or, alternately, removed from the air compressor and coupled thereto via a conduit such as an air hose or the like, so that the manifold assembly can be used at locations remote from the air compressor. In exemplary embodiments of the invention, the manifold assembly may include a pressure regulator assembly for regulating the pressure of air provided to the air powered tools and indicators for indicating the pressure of compressed air in the air compressor assembly's compressed air storage tank and/or the manifold assembly's outlet pressure.

In a second aspect, an air compressor assembly includes a lifting handle. In an exemplary embodiment of the second aspect of the invention, an air compressor assembly suitable for lifting includes an air storage tank suitable for storing compressed air and a wheel assembly suitable for transporting the air compressor assembly disposed on the air storage tank. A lifting handle assembly suitable for use in lifting the air compressor assembly is integrally formed with the wheel assembly.

In a further exemplary embodiment of the second aspect, an air compressor assembly suitable for lifting includes an air tank suitable for storing compressed air, the tank having a front-end portion, a rearward portion, a first side portion, and a second side portion. A lift handle assembly suitable for use in lifting the air compressor assembly is at least partially disposed on at least one of the first and second side portions.

In another exemplary embodiment of the second aspect, an air compressor assembly suitable for lifting includes an air tank suitable for storing compressed air having a first end portion and a second end portion. A wheel assembly suitable for transporting the air compressor assembly is disposed on the second end portion of the air tank. A transport handle assembly suitable for use in controlling transportation of the air compressor assembly when utilizing the wheel assembly is disposed on the first end portion of the air tank. A lifting handle assembly suitable for use in lifting the air compressor assembly is at least partially disposed on the second end portion of the air tank.

In a third aspect, an air compressor assembly including a handle assembly is capable of assuming multiple positions. In an exemplary embodiment of the third aspect of the present invention, an air compressor assembly includes an air tank suitable for storing compressed air, the tank having a first side portion and a second side portion. A handle assembly including a handle is disposed on the air tank, the handle assembly being capable of attaining a first position and a second position, wherein the second position generally aligns the handle at least partially along at least one of the first and second side portions. It may also be desirable to have the first position include aligning the handle outward from an end portion of the air tank.

In a further exemplary embodiment of the third aspect, an air compressor assembly includes an air tank suitable for storing compressed air, the tank having a top edge. A handle assembly including a handle is disposed on the air tank. The handle assembly is capable of attaining a first position and a second position, wherein the first position arranges the handle generally above the top edge of the air tank and the second position arranges the handle generally below the top edge of the air tank.

In another exemplary embodiment of the third aspect, an air compressor assembly includes an air tank suitable for storing compressed air having an end portion. A handle assembly including a handle is disposed on the air tank, the handle assembly being capable of attaining a first position and a second position, wherein the first position arranges the handle generally outward from the end portion and the second position arranges the handle generally inward from the end portion.

In a still further exemplary embodiment of the third aspect, an air compressor assembly includes an air tank suitable for storing compressed air and a wheel assembly disposed on the air tank, the wheel assembly being suitable for transporting the air tank. A handle assembly including a handle is disposed on the air tank. The handle assembly is capable of attaining a first position and a second position, wherein the first position arranges the handle so as to be suitable for transporting the air compressor assembly utilizing the wheel assembly. The second position arranges the handle so as to be suitable for lifting the air compressor assembly.

In a fourth aspect, an apparatus for protects the condensate removal device from damage caused by contact with foreign objects. The fourth aspect is directed towards a shield that prevents objects from coming into contact with the condensate removal device. The fourth aspect of the present invention is further directed to a recessed condensate removal device where the condensate removal device may be recessed within a mounting device that to prevent damage to the condensate removal device by shielding contact from foreign objects. Furthermore, the fourth aspect is directed to a removable cap that may be placed around and cover the condensate removal device.

In a fifth aspect, a portable air compressor assembly is of the type having a horizontal compressed air storage tank. In accordance with one embodiment of the fifth aspect, the air compressor assembly includes a more stable base to prevent tipping of the air compressor assembly. In an exemplary embodiment, the base includes a lower portion suitable for contacting a surface for providing support to the air compressor assembly, wherein the lower portion has a width at least substantially equal to the diameter of the horizontal compressed air storage tank.

In accordance with a further embodiment of the fifth aspect, the portable air compressor assembly includes a plurality of tie-down points for securing the air compressor assembly to a platform such as a vehicle or the like. In an exemplary embodiment, the tie-down points are provided in brackets utilized for mounting wheel and handle assemblies to the compressed air storage tank.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

Implementations of this aspect may include one or more of the following.

Advantages may include one or more of the following.

Other advantages and features will be apparent from the description, the drawings, and the claims.

DETAILED DESCRIPTION

Referring generally to FIGS. 2 through 14, exemplary embodiments of a first aspect of the present invention directed to a manifold assembly for an air compressor assembly that is capable of controlling and distributing compressed air from the air compressor assembly to one or more air powered tools are shown.

Figure 1:
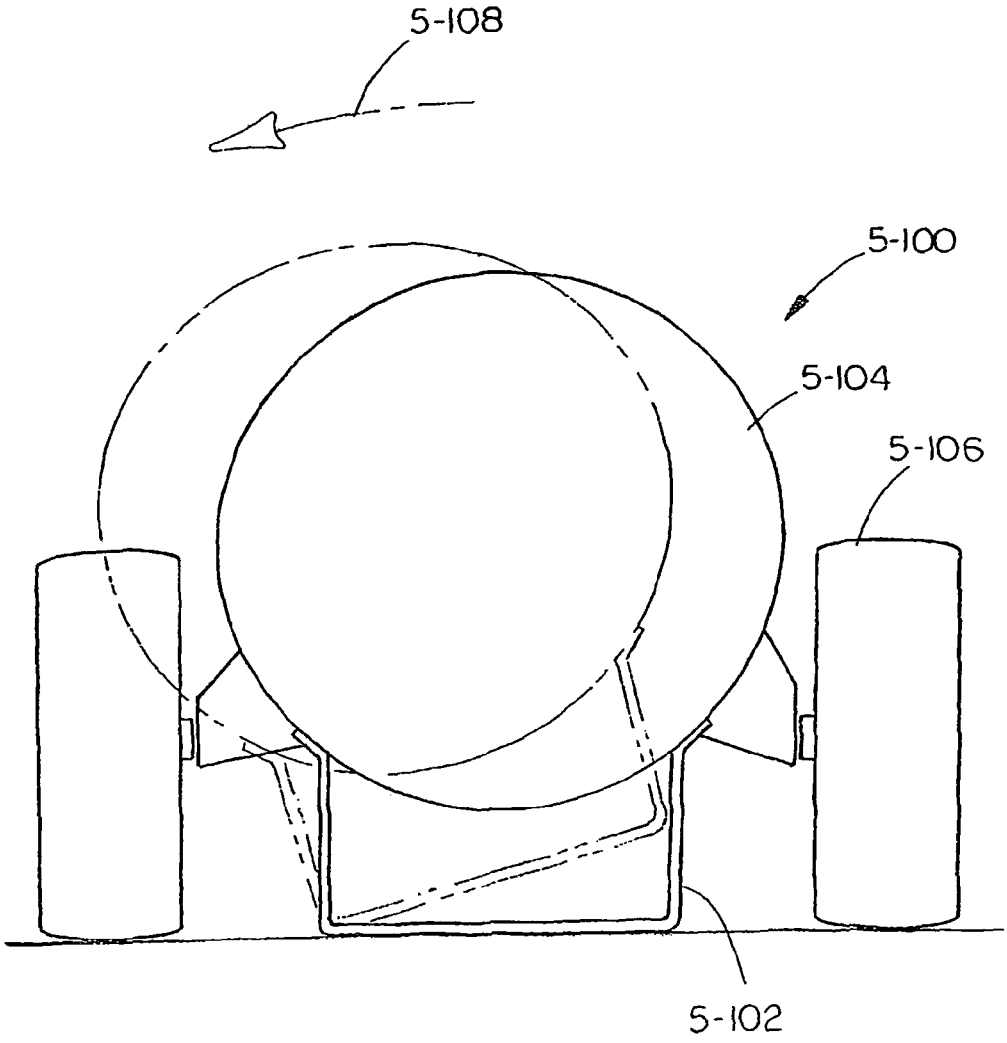
FIG. 1 (PRIOR ART)
FIG. 1 is an end elevational view of a portable air compressor assembly having a narrow base.
Figure 2:
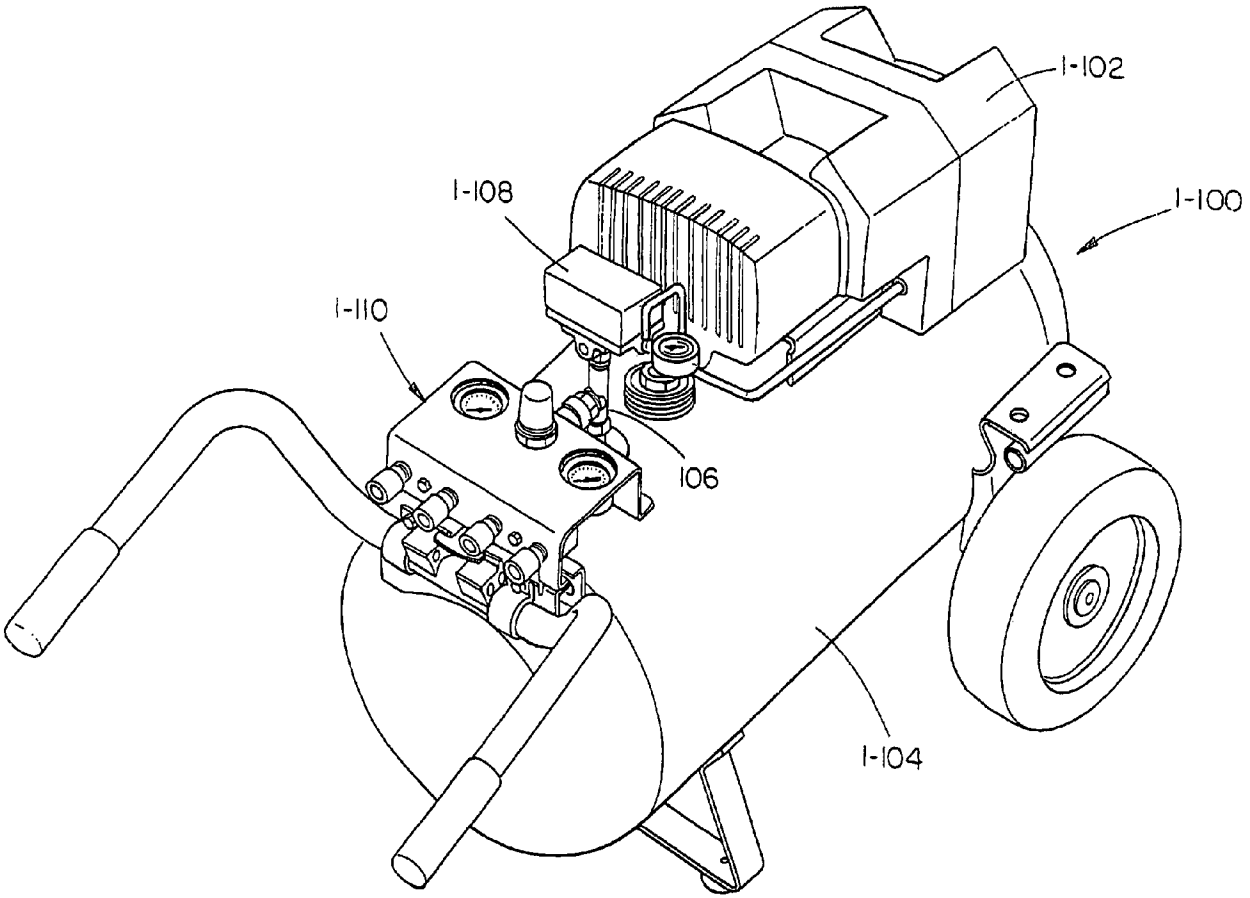
FIG. 2 is an isometric view illustrating an air compressor assembly having a removable manifold assembly suitable for use at locations remote to the air compressor assembly in accordance with an exemplary embodiment of the present invention.
Figure 3:
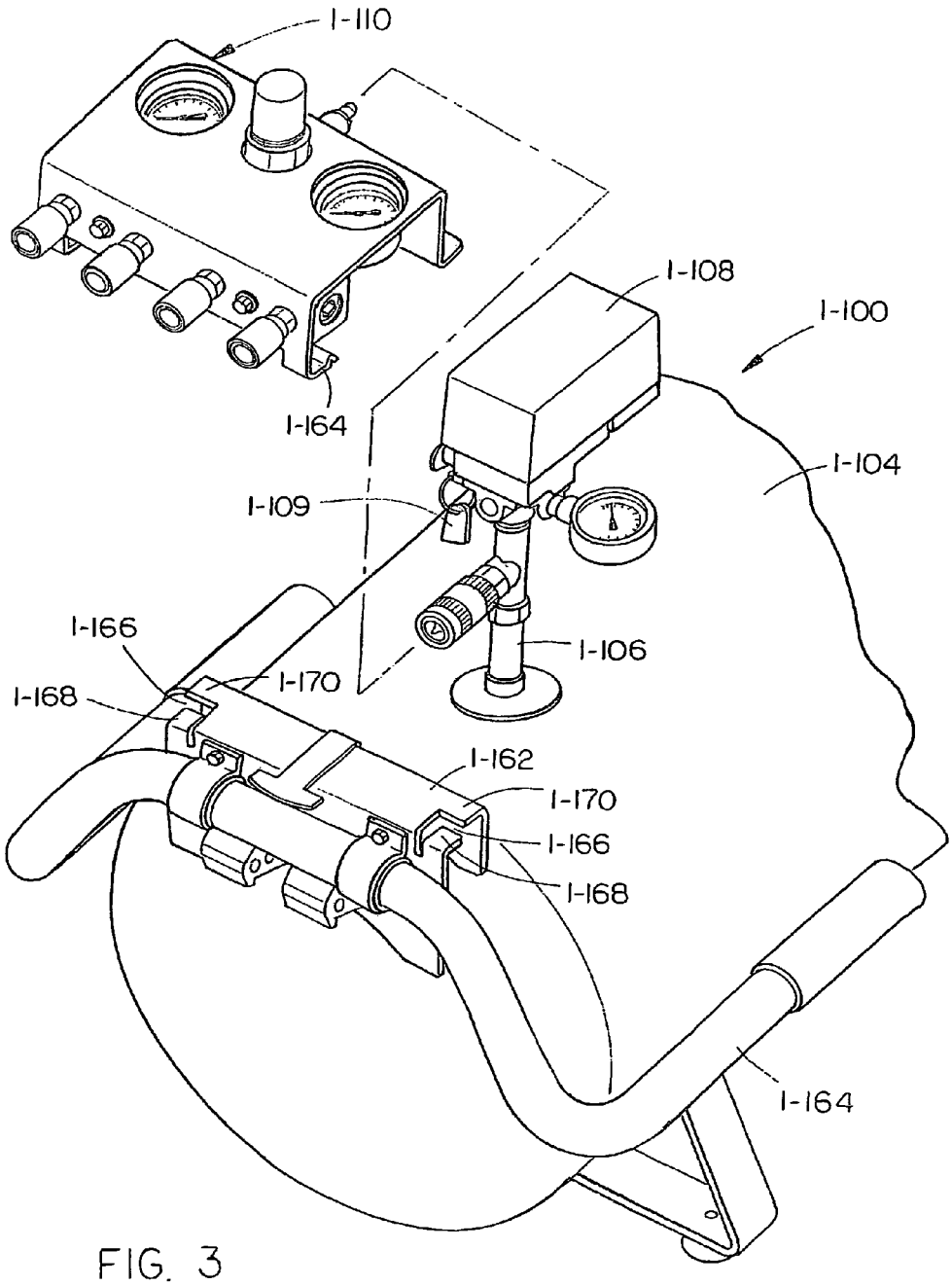
FIG. 3 is an exploded isometric view illustrating the air compressor assembly shown in FIG. 2 with the manifold assembly removed.

Referring generally to FIGS. 2 through 5, an air compressor assembly 1-100 in accordance with an exemplary embodiment of the present invention is described. As shown in FIGS. 2 and 3, the air compressor assembly 1-100 includes a compressor 1-102 mounted to a compressed air storage tank 1-104. The compressed air storage tank 1-104 provides a tank or receiver for storing air under pressure. A port (often referred to as a "spud") is provided in the compressed air storage tank 1-104 to which a pressure manifold or pipe 1-106 is fitted allowing compressed air to be drawn from the tank 1-104 for powering air powered tools such as nailing tools, socket driving tools, material shaping tools, sanding tools, spray painting tools, tire inflation chucks, and the like.

A pressure switch assembly 1-108 is mounted to the pressure manifold 1-106 for regulating pressure within the compressed air storage tank 1-104 by alternately starting and stopping the compressor 1-102 to periodically replenish the supply of air in the tank 1-104. When pressure within the tank 1-104 reaches a preset low pressure point, or "kick-in pressure", the pressure switch assembly 1-108 starts the compressor 1-102 to re-pressurize the tank 1-104. As the pressure within the tank 1-104 reaches a preset high pressure point, or "kick-out pressure", the pressure switch assembly 1-108 stops the compressor 1-102 to prevent over-pressurization of the tank 1-104. In this manner, the pressure of the compressed air in the compressed air storage tank 1-104 is maintained within a range generally suitable for powering one or more air powered tools. The pressure manifold 1-106 may include a safety pressure relief valve for relieving pressure within the pressure manifold 1-106. In accordance with an exemplary embodiment, the pressure relief valve may be opened by a user by pulling outward on an enlarged ring having a tab or "fob" 1-109 providing a label surface attached thereto. Preferably, the ring and fob 1-109 are sized to be easily gripped by users of the air compressor 1-100 to open the safety pressure relief valve.

In accordance with an exemplary embodiment of the present invention, the air compressor assembly 1-100 is provided with a manifold assembly 1-110 for controlling and distributing compressed air from the air compressor assembly to one or more air powered tools. The manifold assembly 1-110 may be attached directly to the air compressor assembly 1-100, as shown in FIG. 2, or, alternately, removed from the air compressor assembly 1-100, as shown in FIG. 3, and coupled thereto via a single air hose allowing the manifold assembly to be utilized at locations remote from the air compressor assembly 1-100 (see FIGS. 12, 13 and 14). The manifold assembly 1-110 is comprised of a pneumatic manifold 1-112 and pressure regulator assembly 1-114 supported in a housing or frame 1-116. In FIGS. 2 through 5, the pneumatic manifold 1-112 and frame 1-116 are shown as separate components attached together by suitable fasteners. However, it should be appreciated that the pneumatic manifold 1-112 and frame may be of one-piece construction without departing from the scope and spirit of the present invention.

Figure 4:
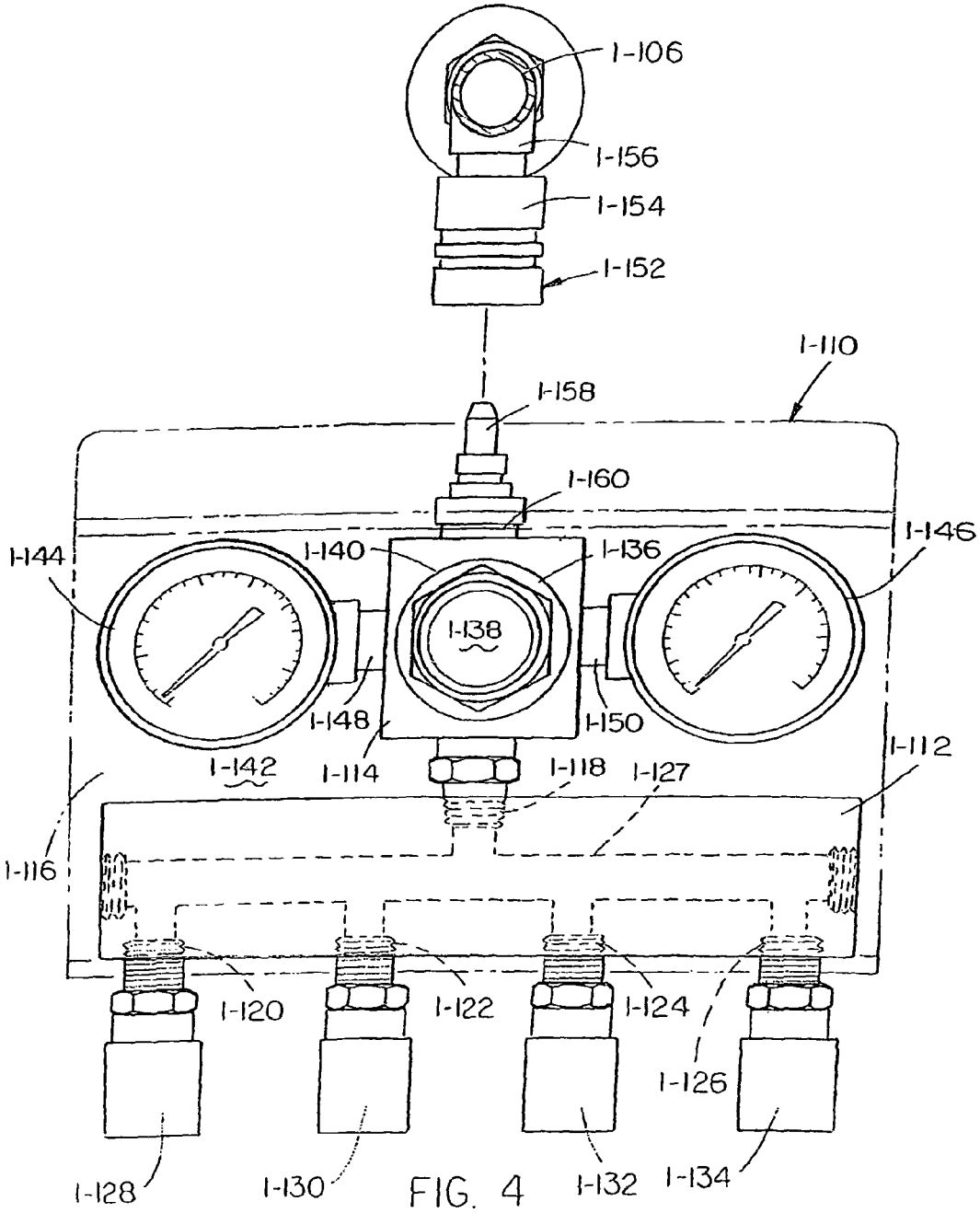
FIG. 4 is a partial cross-sectional top plan view illustrating the manifold assembly of the compressor assembly shown in FIG. 2.
Figure 5:
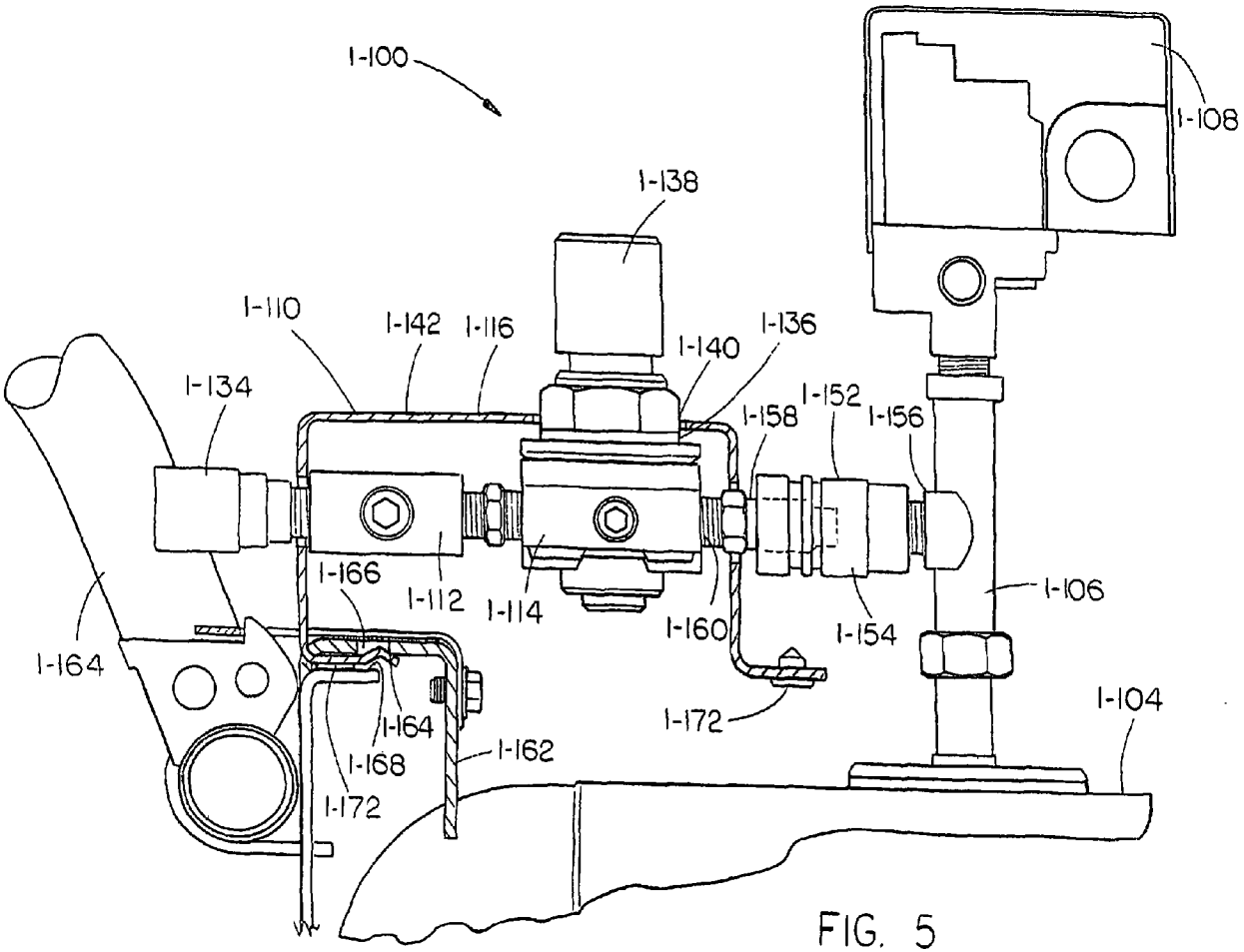
FIG. 5 is a partial side elevational cross-sectional of the air compressor assembly shown in FIG. 2, further illustrating apparatus for securing the manifold assembly to the air compressor assembly's compressed air storage tank.

As shown in FIGS. 4 and 5, the pneumatic manifold 1-112 includes an inlet port 1-118 coupled to one or more outlet ports (four outlet ports 1-120, 1-122, 1-124 & 1-126 are shown) via an internal passage 1-127. The outlet ports 1-120, 1-122, 1-124 & 1-126 are fitted with suitable couplers or connectors 1-128, 1-130, 1-132 & 1-134 which extend through apertures formed in the frame 1-116 allowing for attachment and removal of air hoses between the manifold assembly 1-110 and one or more air powered tools (see FIGS. 12, 13 and 14). For instance, in exemplary embodiments of the invention, couplers 1-128, 1-130, 1-132 & 1-134 may be comprised of quick-connect coupler bodies for allowing attachment and removal of air hoses without the use of tools. Alternately, one or more of the outlet ports 1-120, 1-122, 1-124 & 1-126 may be fitted with a quick-connect coupler plug or stud allowing attachment of air hoses equipped with a quick-connect coupler bodies, a threaded connector (male or female), or the like as contemplated by one of ordinary skill in the art.

The pressure regulator assembly 1-114 is coupled to the pneumatic manifold 1-112 via inlet port 1-118. In one embodiment, shown in FIG. 4, the pressure regulator assembly 1-114 includes a single pressure regulator valve 1-136 that may be opened and closed by a user of the air compressor assembly 1-100, for example, by turning a knob 1-138 extending through an aperture 1-140 formed in the face 1-142 of frame 1-116, to regulate the pressure of compressed air within the pneumatic manifold 1-112 and provided at outlet ports 1-120, 1-122, 1-124 & 1-126. Alternately, multiple pressure regulator valves may be provided for regulating the pressure provided at each outlet port 1-120, 1-122, 1-124 & 1-126 independently, or at specific groups of the outlet ports 1-120, 1-122, 1-124 & 1-126. The pressure regulator assembly 1-114 may further include indicators for indicating pressures within the air compressor assembly 1-100 and/or manifold assembly 1-110. For instance, as shown in FIG. 4, the manifold assembly may include an indicator 1-144 for indicating the pressure of unregulated compressed air in the compressed air storage tank 1-104 and pressure manifold 1-106, and an indicator 1-146 for indicating the regulated pressure of compressed air in the pneumatic manifold 1-112. In exemplary embodiments, the indicators 1-144 & 1-146 are comprised of high pressure gauges coupled to ports 1-148 & 1-150 in the pressure regulator valve 1-136, and oriented so that the dials of the gauges are viewable through apertures formed in the face 1-142 of the manifold assembly frame 1-116.

The manifold assembly 1-110 is coupled to pressure manifold 1-106 via a suitable coupling device 1-152 allowing it to be quickly and easily removed from the air compressor assembly 1-100. In one embodiment shown in FIGS. 4 and 5, the coupling device 1-152 is comprised of a quick-connect coupler body 1-154 fitted to the outlet port 1-156 of pressure manifold 1-106. This quick-connect coupler body 1-154 mates with a corresponding quick-connect coupler plug or stud 1-158 fitted to the inlet port 1-160 of the manifold assembly's pressure regulator assembly 1-114 when the manifold assembly 1-110 is directly attached to the air compressor assembly 1-100, as shown in FIG. 2. Preferably, when mated together, the quick-connect coupler plug 1-158 is retained within the quick-connect coupler body 1-154 until physically uncoupled by a user of the air compressor assembly 1-100 to remove the manifold assembly 1-110. The coupling device 1-152 thus provides both a pneumatic connection between the manifold assembly 1-110 and the pressure manifold 1-106, and a mechanical connection between the manifold assembly 1-110 and the compressed air storage tank 1-104 for at least partially securing the manifold assembly 1-110 to the air compressor assembly 1-100 and eliminating the need for separate latching or locking mechanisms to perform this function. However, it will be appreciated that supplementary latching or locking mechanisms may be provided to further secure the manifold assembly 1-110 to the air compressor assembly 1-100 if desired. Further, when the manifold assembly 1-110 is removed from the air compressor assembly 1-100, as shown in FIG. 3, the quick-connect coupler body 1-154 may be mated to a quick connect coupler plug fitted to a first end of the air hose (not shown) providing a pneumatic connection between the pressure manifold 1-106 and air hose. Likewise, the quick connect coupler plug 1-158 may be mated to a quick connect coupler body fitted to a second end of the hose, pneumatically coupling the air hose to the manifold assembly 1-110 so that air may be provided to the manifold assembly 1-110.

Turning now to FIGS. 3 and 5, the compressed air storage tank 1-104 may further be provided with a mounting bracket

1-162 for supporting the manifold assembly 1-110 while it is directly attached to the air compressor assembly 1-100. In an exemplary embodiment, the lower portion of the manifold assembly frame 1-116 includes one or more tabs 1-164 spaced so as to be generally aligned with notches or openings 1-166 formed in mounting bracket 1-162. When the manifold assembly 1-110 is attached to the air compressor assembly 1-100, as shown in FIGS. 2 and 5, these tabs 1-164 extend through the openings 1-166 so as to at least partially rest on supports 1-168 formed in the mounting bracket 1-162. As the manifold assembly 1-110 is slid rearward, i.e., toward the pressure manifold 1-106, so that the quick-connect coupler plug 1-158 fitted thereto may be mated with the quick-connect coupler body 1-154 fitted to the pressure manifold 1-106, the tabs 1-164 engage the mounting bracket 1-162 by at least partially sliding under the bracket's upper face 1-170, attaching the manifold assembly 1-110 to the compressed air storage tank 1-104. As shown in FIG. 5, the bottom surface of each tab 1-164 may include small knob or foot 1-172 preferably formed of a non-marring, wear resistant material such as plastic, a composite, or the like. When the manifold assembly 1-110 is attached to the air compressor assembly 1-100, this foot 1-172 substantially fills any gap between the tab 1-164 and the support 1-168 to prevent excessive play between the manifold assembly 1-110 and mounting bracket 1-162.

Figure 6:
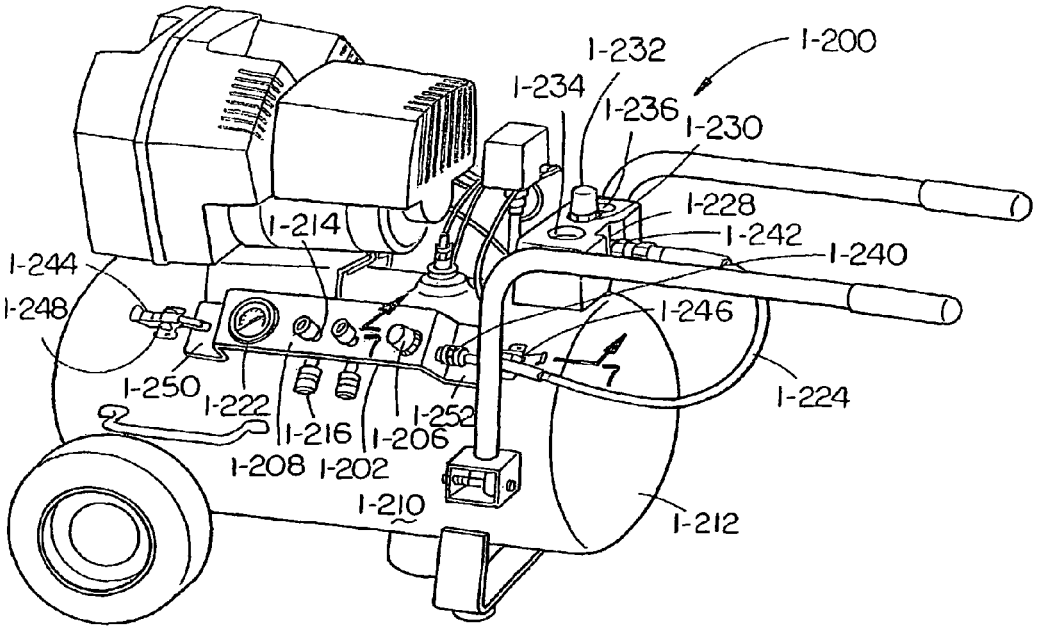
FIG. 6 is an isometric view of an air compressor assembly having a removable manifold assembly suitable for use at locations remote to the air compressor assembly in accordance with an exemplary embodiment of the present invention wherein the manifold assembly is mounted to the side of the air compressor assembly's compressed air storage tank.
Figure 7:
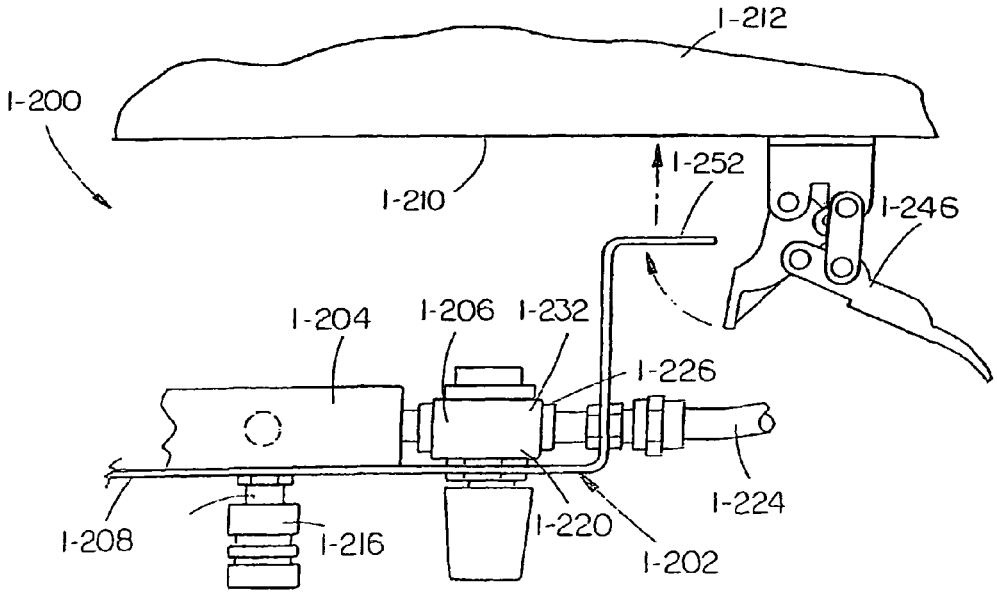
FIG. 7 is a partial cross-sectional side elevational view illustrating manifold assembly of the air compressor assembly shown in FIG. 6.

Referring now to FIGS. 6 and 7, an air compressor assembly 1-200 having a manifold assembly 1-202 in accordance with a further exemplary embodiment of the present invention is described. The manifold assembly 1-202 includes a pneumatic manifold 1-204 and pressure regulator assembly 1-206 mounted to a frame 1-208 capable of being attached to the side wall 1-210 of the air compressor assembly's compressed air storage tank 1-212. Outlet ports 1-214 in the pneumatic manifold 1-204 are fitted with couplers or connectors 1-216 for allowing attachment and removal of air hoses (not shown) to provide compressed air to one or more air powered tools (see FIGS. 12, 13 and 14). In exemplary embodiments of the invention, these couplers 1-216 may be comprised of quick-connect coupler bodies for allowing attachment and removal of air hoses without the use of tools. Alternately, the couplers 1-216 may comprise quick-connect coupler plugs allowing attachment of air hoses equipped with a quick-connect coupler bodies, a threaded connector (male or female), or the like as contemplated by one of ordinary skill in the art.

The pressure regulator assembly 1-206 includes one or more pressure regulator valves 1-220 that may be opened and closed by a user of the air compressor assembly 1-200 to regulate the pressure of compressed air provided at outlet ports 1-214. Indicators may be provided for indicating various pressures within the air compressor/air hose/manifold assembly/air powered tool system. For example, as shown in FIG. 6, the manifold assembly 1-202 includes a single pressure gauge 1-222 for indicating the regulated pressure of compressed air in the pneumatic manifold 1-204.

The manifold assembly 1-202 is pneumatically coupled to the air compressor assembly 1-200 via a short length of air hose 1-224 extending between the inlet port 1-226 of the manifold assembly's pressure regulator valve 1-220 and the outlet port 1-228 of a second pressure regulator assembly 1-230 mounted to the compressed air storage tank 1-212 and coupled to the compressed air storage tank's pressure manifold. As shown in FIG. 6, the second pressure regulator assembly 1-230 may include a pressure regulator valve 1-232 for regulating the pressure of compressed air provided at outlet port 1-228 and one or more indicators (pressure gauges 1-234 & 1-236 are shown) for indicating pressures within the air compressor/manifold assembly system. In this manner, the pressure provided to manifold assembly 1-202 may be regulated at the air compressor assembly 1-200 while the manifold assembly 1-202 is being used remotely. Further, the air compressor assembly 1-200 may be used independently of manifold assembly 1-202 if desired.

Quick-connect coupler devices 1-240 & 1-242 connect the air hose 1-224 to inlet port 1-226 and outlet port 1-228 allowing the air hose 1-224 to be easily disconnected from either port. In this manner, a longer length of air hose may be provided between the air compressor assembly 1-200 and manifold assembly 1-202 when the manifold assembly 1-202 is removed from the compressed air storage tank 1-212, for example, when being used at a remote location. Such a longer length of air hose may, for example, be coupled between the inlet port 1-226 and air hose 1-224, between air hose 1-224 and outlet port 1-228, or directly between inlet port 1-226 and outlet port 1-228, air hose 1-224 being completely removed.

A latching assembly 1-244 may be provided for securing the manifold assembly 1-202 to the air storage tank 1-212. In an exemplary embodiment, the latching assembly 1-244 is comprised of clamps 1-246 & 1-248 which may be closed on flanges 1-250 & 1-252 formed in the manifold assembly's frame 1-208 to secure the manifold assembly to the side of the air tank 1-212. When opened, the clamps 1-246 & 1-248 release the flanges 1-250 & 1-252 allowing the manifold assembly to be lifted from the side of the air storage tank 1-212 for use at a remote location. It will now be appreciated that the latching assembly 1-244 may utilize other latching mechanisms for securing the manifold assembly to compressed air storage tank and substitution of such alternative latching mechanisms for those specifically described herein by those of skill in the art is possible and such substitution would not depart from the scope and spirit of the present invention as set forth in the appended claims.

In FIGS. 2 through 7, manifold assemblies in accordance with the present invention are shown configured for use with an air compressor having a single horizontally disposed, cylindrical compressed air storage tank, typically referred to informally in the art as a "hot-dog" style tank. However, it should be appreciated that air compressors utilizing manifold assemblies in accordance with the present invention may employ a wide variety of compressed air storage tank configurations. For example, instead of the generally horizontal compressed air storage tank shown in FIGS. 2 through 7, an air compressor employing the manifold assembly of the present invention may, for example, comprise a vertically disposed "hot-dog" style tank or a flattened oval tank, often referred to informally in the art as a "pancake" style tank. Similarly, instead of the single large tank shown, an air compressor employing a manifold assembly in accordance with the present invention may utilize two or more smaller air storage tanks. For example, such an air compressor may employ two horizontally disposed cylindrical compressed air storage tanks positioned side by side, a tank configuration often referred to informally in the art as a "double hot-dog" style tank. Use of such tank configurations would not depart from the scope and spirit of the present invention.

Referring now to FIGS. 8 through 11, exemplary portable air compressor assemblies 1-300, 1-400 are shown wherein the air compressor assemblies 1-300, 1-400 are equipped with a roll cage 1-302, 1-402 to which a manifold assembly is mounted in accordance with an exemplary embodiment of the present invention. Each air compressor assembly 1-300, 1-400, respectively includes a roll cage 1-302, 1-402 which supports the air compressor assembly's compressed air storage tank or tanks 1-304, 1-404 and compressor 1-306, 1-406. Preferably, the roll cage 1-302, 402 at least partially encloses the compressed air storage tanks 1-304, 1-404, compressor 1-306, 1-406, pressure switch assembly 1-308, 1-408, and pressure manifold 1-310, 1-410 for protecting these components from damage due to contact with foreign objects. The roll cage 1-302, 1-402 may further provide grips or handles 1-312, 1-412 allowing a user or users to lift the air compressor assembly 1-300, 1-400 for transport.

Figure 8:
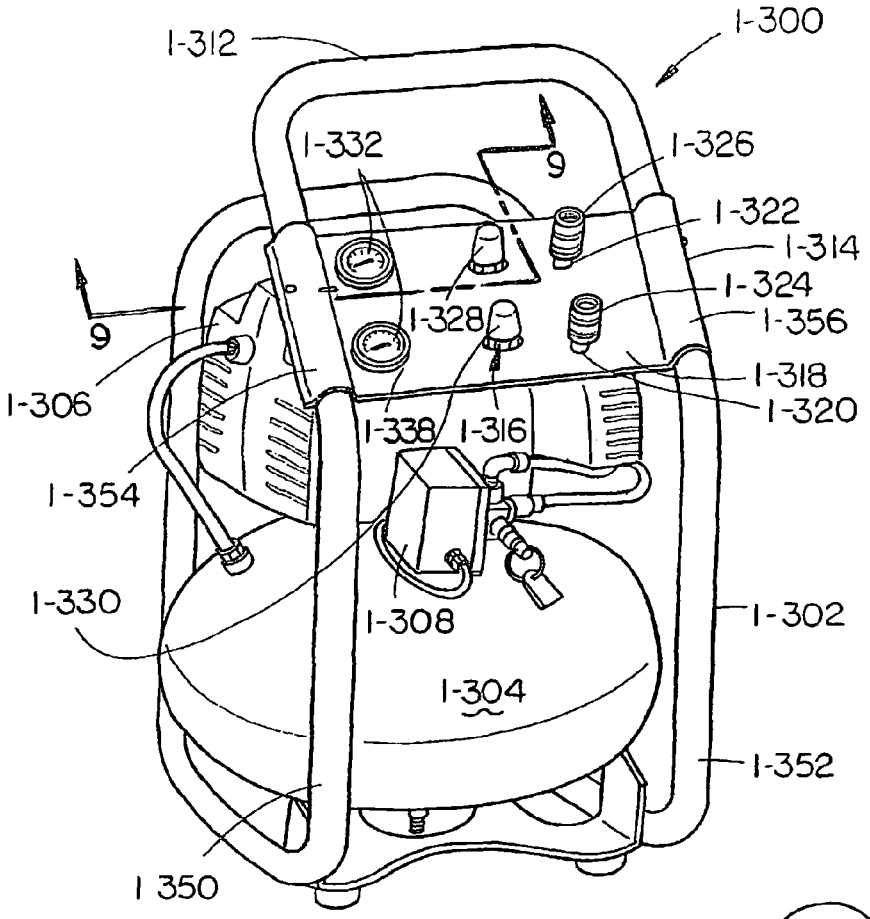
FIG. 8 is an isometric view of a "pancake" type air compressor assembly having a removable manifold assembly suitable for use at locations remote to the air compressor assembly in accordance with an exemplary embodiment of the present invention.

In one embodiment, shown in FIG. 8, the compressed air storage tank 1-304 of air compressor assembly 1-300 may be comprised of a flattened oval or "pancake" style tank. In such an embodiment, the roll cage 1-302 may form a cradle substantially surrounding the tank 1-304 and compressor 1-306. In another embodiment, shown in FIG. 10, the air compressor assembly 1-400 may include two horizontally disposed cylindrical compressed air storage tanks 1-404 positioned side by side in a vertically oriented "double hot-dog" configuration. In this embodiment, the compressed air storage tanks 1-404 are mounted to, and form part of the back portion of the roll cage 1-402, while only the compressor 1-406, pressure switch assembly 1-408, and pressure manifold 1-410 are substantially surrounded by the cage 1-402.

Figure 10:
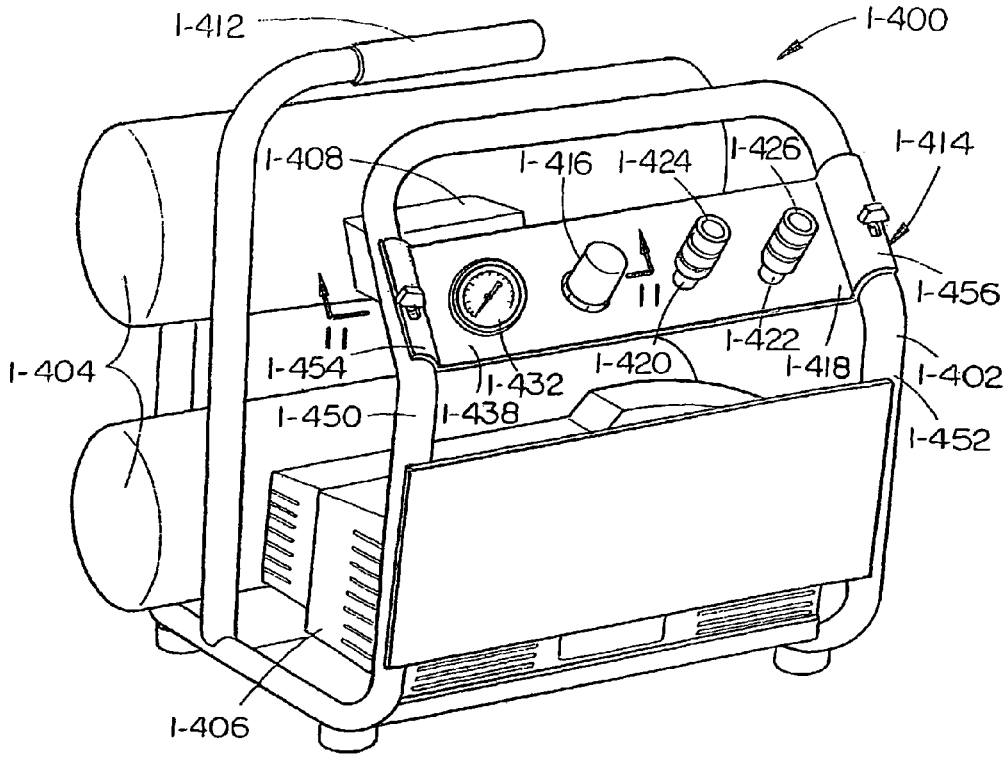
FIG. 10 is an isometric view of a "double hot-dog" type air compressor assembly having a removable manifold assembly suitable for use at locations remote to the air compressor assembly in accordance with an exemplary embodiment of the present invention.
Figure 12:
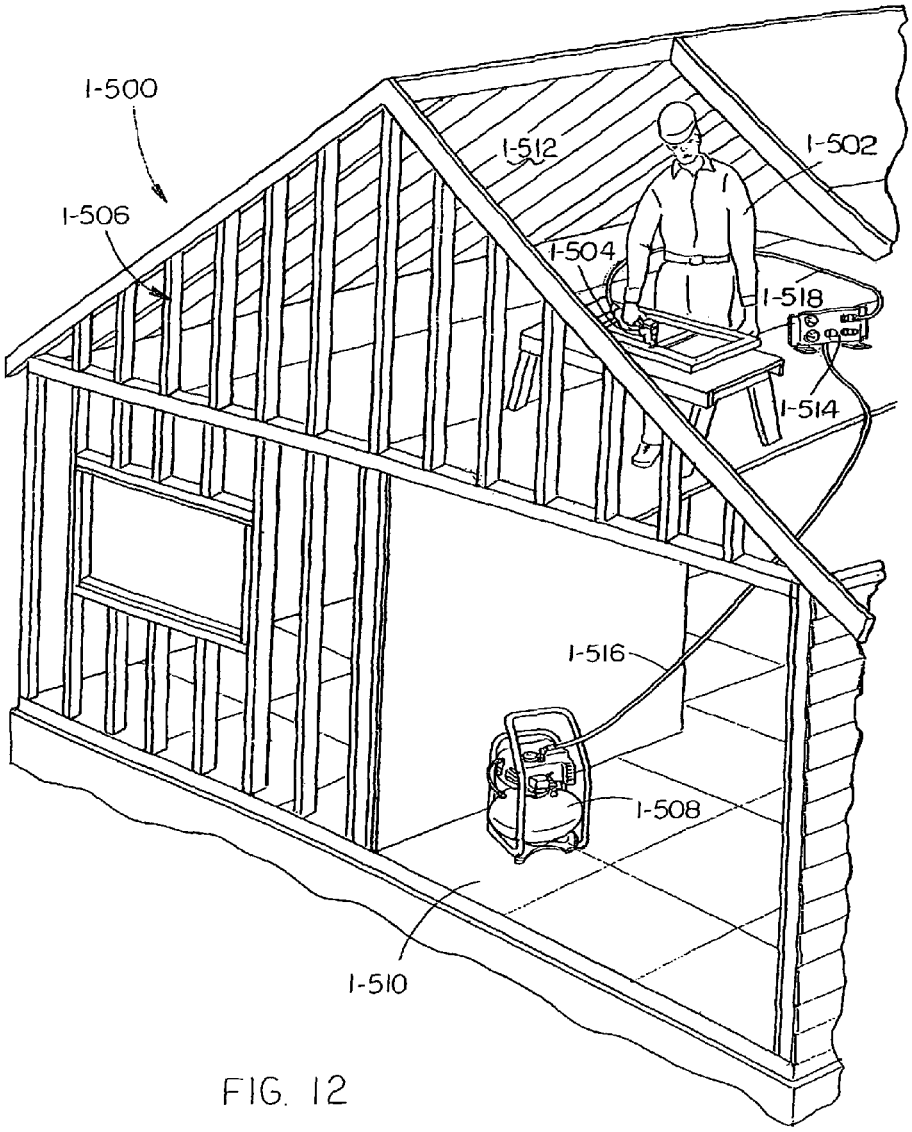
FIG. 12 is an isometric view illustrating an air compressor assembly having a manifold assembly in accordance with an exemplary embodiment of the present invention wherein the manifold assembly is used at a location remote from the air compressor assembly being coupled to the air compressor assembly by an air hose.
Figure 13:
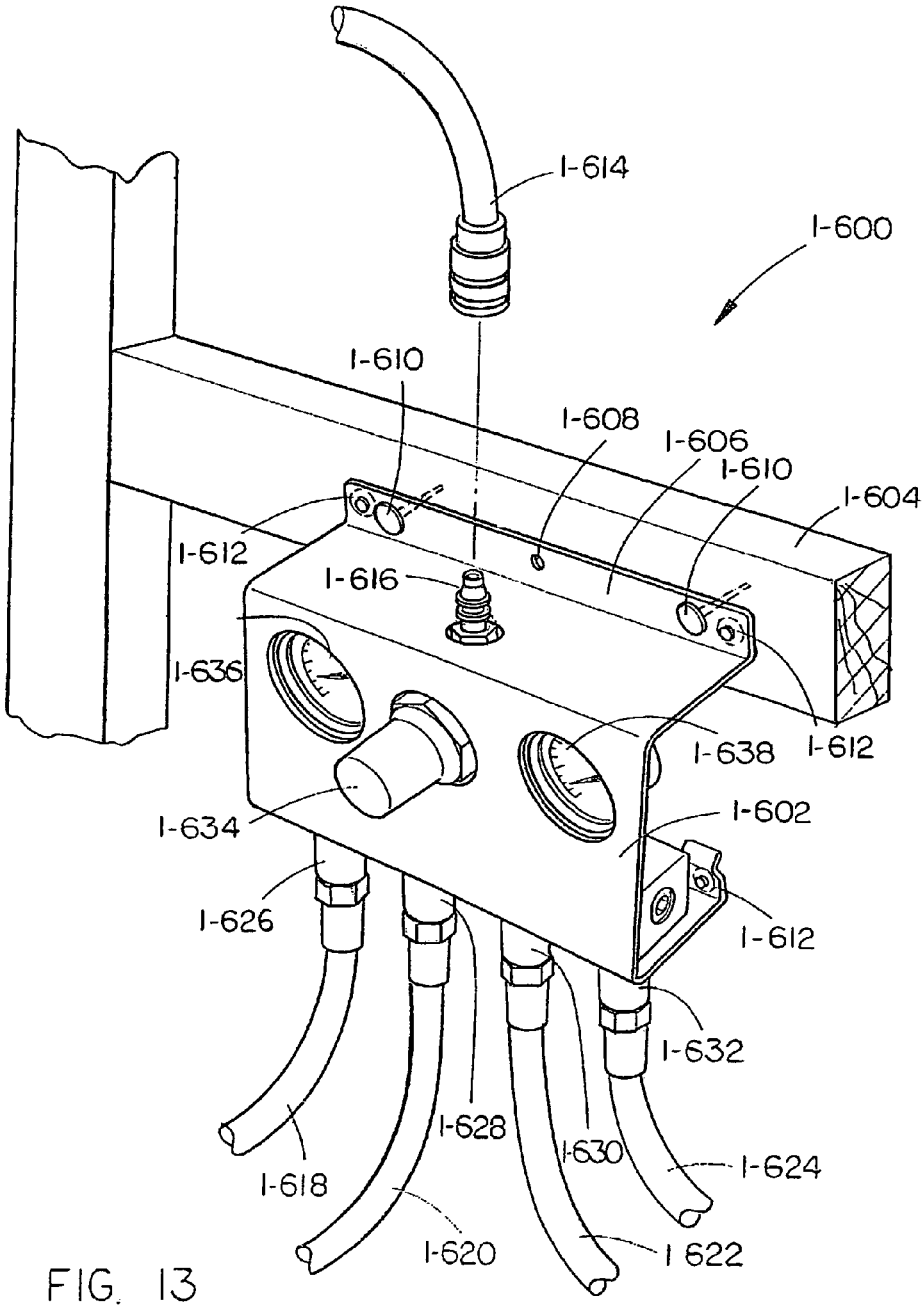
FIG. 13 is an isometric view illustrating an exemplary manifold assembly attached to a supporting structure at a site remote from the air compressor assembly.
Figure 14:
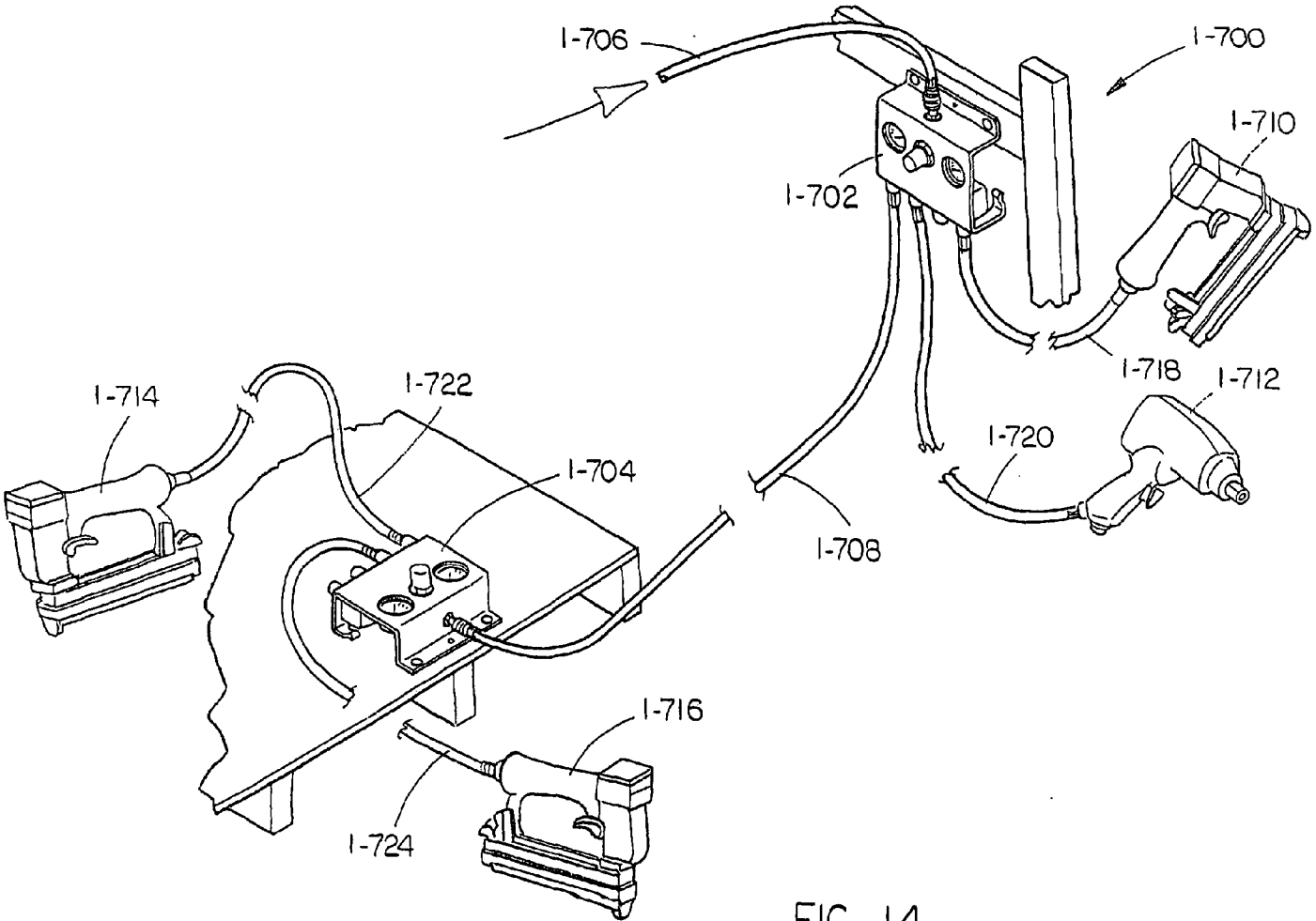
FIG. 14 is an isometric view illustrating a plurality of manifold assemblies utilized in tandem at a location remote from the air compressor assembly being coupled to the air compressor assembly by an air hose.

In accordance with an exemplary embodiment of the present invention, the air compressor assemblies 1-300, 1-400 shown in FIGS. 8 and 10 are provided with a manifold assembly 1-314, 1-414 for controlling and distributing compressed air from the air compressor assembly 1-300, 1-400 to one or more air powered tools (see FIGS. 12, 13 and 14). The manifold assembly 1-314, 1-414 may be attached directly to the air compressor assembly 1-300, 1-400, or, alternately, removed from the air compressor assembly 1-300, 1-400 and coupled thereto via a single air hose so the manifold assembly 1-314, 1-414 may be utilized at locations remote from the air compressor assembly 1-300, 1-400 (see FIGS. 12, 13 and 14).

As shown in FIGS. 8 and 10, the manifold assemblies 1-314, 1-414 include a pneumatic manifold (not shown) and at least one pressure regulator assembly 1-316, 1-416 coupled to a supporting frame 1-318, 1-418. Outlet ports 1-320, 1-322, 1-420 & 1-422 within the pneumatic manifold are fitted with suitable couplers or connectors 1-324, 1-326, 1-424 & 1-426 which extend through apertures in the frame 1-318, 1-418 for allowing attachment and removal of air hoses to provide compressed air to one or more air powered tools (see FIGS. 12, 13 and 14). In exemplary embodiments of the invention, couplers 1-324, 1-326, 1-424 & 1-426 may be comprised of quick-connect coupler bodies for allowing attachment and removal of air hoses without the use of tools. Alternately, one or more of the outlet ports 1-320, 1-322, 1-420 & 1-422 may be fitted with a quick-connect coupler plug or stud allowing attachment of air hoses equipped with a quick-connect coupler bodies, a threaded connector (male or female), or the like as contemplated by one of ordinary skill in the art.

The pressure regulator assembly 1-316, 1-416 includes one or more pressure regulator valves 1-328, 1-330, 1-428 that may be opened and closed by a user of the air compressor assembly 1-300, 1-400 to regulate the pressure of compressed air provided by the pneumatic manifold. In one embodiment, shown in FIG. 8, a separate pressure regulator valve 1-328 & 1-330 may be provided for independently regulating the pressure provided at each outlet port 1-320 & 1-322 of manifold assembly 1-314. Alternately, as shown in FIG. 10, a single pressure regulator valve 1-428 may be provided for regulating the pressure provided at all ports 1-422, 1-424. Indicators may be provided for indicating various pressures within the air compressor/air hose/manifold assembly/air powered tool system. For example, indicators 1-332, 1-334 & 1-432 may be provided to indicate the pressure of unregulated compressed air in the compressed air storage tank 1-304, 1-404, and/or for indicating the regulated pressure of compressed air in the pneumatic manifold of the manifold assembly 1-314, 1-414. In exemplary embodiments, the indicators 1-332, 1-334 & 1-432 are comprised of high pressure gauges coupled to ports 1-336 & 1-436 in the pressure regulator valve 1-328, 1-428 (FIGS. 9 and 11), and oriented so that the dials of the gauges are viewable through apertures formed in the face 1-338, 1-438 of the manifold assembly frame 1-318, 1-418.

Figure 9:
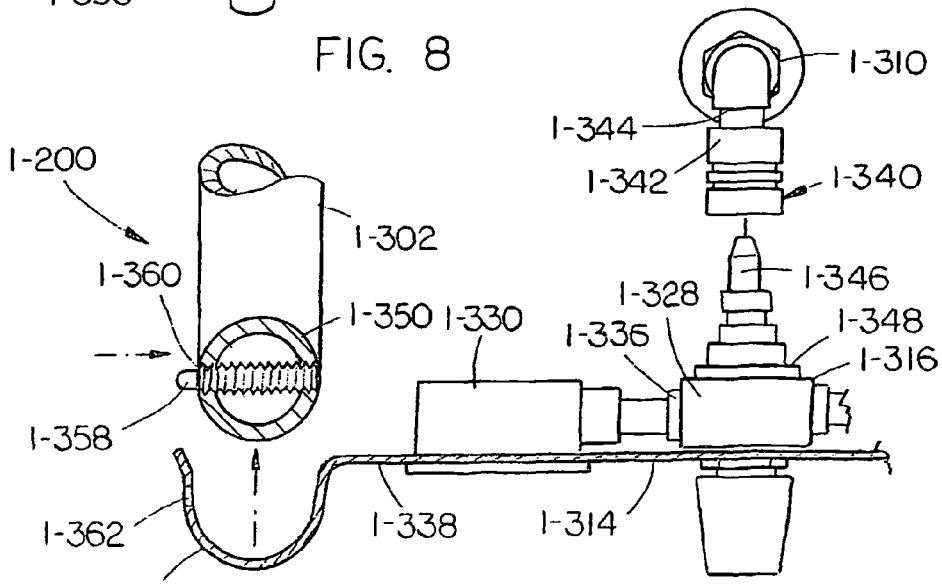
FIG. 9 is a partial cross-sectional side elevational view illustrating manifold assembly of the air compressor assembly shown in FIG. 8.
Figure 11:
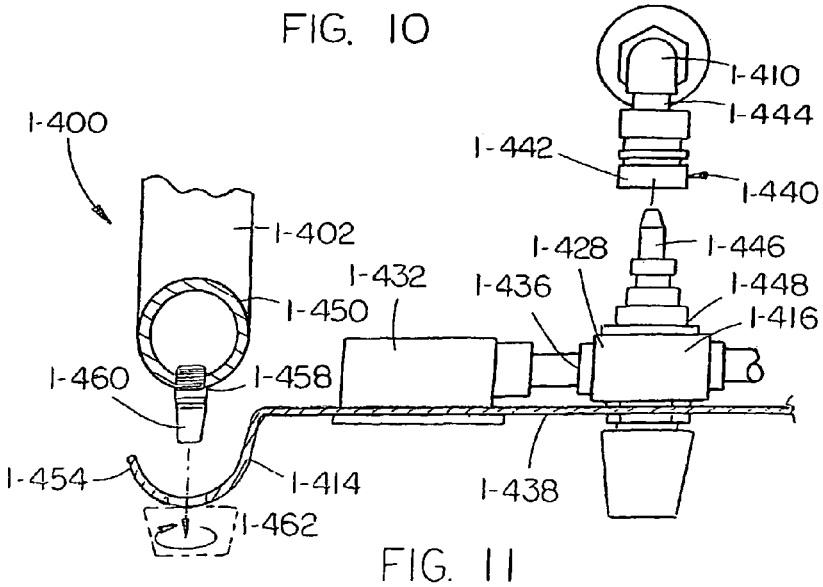
FIG. 11 is a partial cross-sectional side elevational view illustrating manifold assembly of the air compressor assembly shown in FIG. 10.

As shown in FIGS. 9 and 11, the manifold assembly 1-314, 1-414 is coupled to the pressure manifold 1-310, 1-410 via a suitable coupling device 1-340, 1-440 allowing it to be quickly and easily removed from the air compressor assembly 1-300, 1-400. In the exemplary embodiments shown, the coupling device 1-340, 1-440 is comprised of a quick-connect coupler body 1-342, 1-442 fitted to the outlet port 1-344, 1-444 of the pressure manifold 1-310, 1-410. This quick-connect coupler body 1-342, 1-442 mates with a corresponding quick-connect coupler plug or stud 1-346, 1-446 fitted to the inlet port 1-348, 1-448 of the manifold assembly's pressure regulator assembly 1-316, 1-416 when the manifold assembly 1-314, 1-414 is directly attached to the air compressor assembly 1-300, 1-400. In this manner, the coupling device 1-340, 1-440 provides a pneumatic connection between the manifold assembly 1-314, 1-414 and the pressure manifold 1-310, 1-410. Further, when the manifold assembly 1-314, 1-414 is removed from the air compressor assembly 1-300, 1400, the quick-connect coupler body 1-342, 1-442 may be mated to a quick connect coupler plug fitted to a first end of the air hose (not shown) providing a pneumatic connection between the pressure manifold 1-310, 1-410 and air hose. Likewise, the quick connect coupler plug 1-346, 1-446 may be mated to a quick connect coupler body fitted to a second end of the hose, pneumatically coupling the air hose to the manifold assembly 1-314, 1-414 thereby connecting the manifold assembly 1-314, 1-414 and air compressor assembly 1-300, 1-400 so that air may be provided to the manifold assembly 1-314, 1-414.

The manifold assembly 1-314, 1-414 may be supported by the air compressor's roll cage 1-302, 1-402 so that it may be pneumatically attached to the air compressor assembly 1-300, 1-400 via the coupling device 1-340, 1-440. As shown in FIGS. 8 and 10, the front portion of the roll cage 1-302, 1-402 may include distal upright cage members 1-350, 1-352, 1-450, and 1-452. Edge portions 1-354, 1-356, 1-454 & 1-456 of the manifold assembly frame 1-314, 1-414 may be shaped to fit over these cage members 1-350, 1-352, 1-450 & 1-452 so that the manifold assembly 1-314, 1-414 is suspended there between when mounted to the air compressor assembly 1-300, 1-400. For instance, in the exemplary embodiment shown in FIGS. 8 through 11, the roll cage 1-302, 1-402 may be formed of steel tubing having a generally circular cross-sectional shape. In such an embodiment, the edge portions 1-354, 1-356, 1-454 & 1-456 of frame 1-318, 1-418 may be comprised of channels having a substantially semi-circular cross-section sized to fit over a corresponding cage member 1-350, 1-352, 1-450, and 1-452.

A latching assembly 1-358, 1-458 may be provided for securing the manifold assembly 1-314, 1-414 to the air compressor assembly's roll cage 1-302, 1-402. Preferably, the latching assembly 1-358, 1-458 allows the user to easily remove the manifold assembly 1-314, 1-414 from the roll cage 1-302, 1-402 for remote use. For example, as shown in FIGS. 8 and 9, an exemplary latching assembly 1-358 may be comprised of a spring loaded plunger 1-360 positioned in each cage member 1-350 & 1-352 for engaging corresponding apertures 1-362 formed in edge portions 1-354 & 1-356 of frame 1-318. Similarly, a second exemplary latching assembly 1-458, shown in FIGS. 10 and 11, may comprise one or more one-quarter turn fasteners 1-460 mounted to each cage member 1-450 & 1-452 and positioned to extend through holes 1-462 formed in the edge portions 1-454 & 1-456 of frame 1-418. It will now be appreciated that the latching assembly 1-358, 1-458 may utilize other latching mechanisms for securing the manifold assembly to the roll cage depending on the particular design requirements of the air compressor. Consequently, substitution of alternative latching mechanisms for those specifically described herein by those of skill in the art is anticipated, and such substitution would not depart from the scope and spirit of the present invention as set forth in the appended claims.

Referring now to FIG. 12, use of an air compressor assembly having a manifold assembly in accordance with an exemplary embodiment of the present invention is described. In a typical work site 1-500, such as a residential home construction site (shown), a worker 1-502 may utilize an air powered tool 1-504 (a nailing tool is shown) to perform a task or series of tasks. For example, in the construction of a residential structure 1-506, a worker 1-502 may utilize air powered tools 1-504 for performing tasks such as framing walls within the structure 1-506, hanging dry wall, installing windows or doors, installing roofing, installing flooring, providing interior finishing of the structure, and the like.

Because of constraints at the work site, it may be necessary that the air compressor assembly 1-508, providing a source of compressed air for operating the tool 1-504 be located remotely from the worker 1-502. For example, when building a multiple level structure 1-506, the air compressor assembly 1-508 may be located in a lower level 1-510 of the structure 1-506, while the worker 1-502 must perform a task in an upper level or floor 1-512 of the structure 1-506. In such applications, the manifold assembly 1-514 may be detached from the air compressor assembly 1-508 and coupled thereto via an air hose 1-516 allowing the manifold assembly 1-514 to be taken to the worker's location, e.g., in FIG. 12, the upper level 1-512 of the structure 1-506. The worker 1-502 may then couple the air powered tool 1-504 to the manifold assembly 1-514 via a second air hose 1-518 to provide compressed air for powering the tool 1-504. As discussed in the description of FIGS. 2 through 11, the manifold assembly may include a pressure regulator assembly and indicators for indicating various pressures within the air compressor assembly 1-508 and manifold assembly 1-514 thereby allowing the user to monitor and control the pressure of the air provided to the tool 1-504 without returning to the air compressor assembly's location, e.g., in FIG. 12, the lower level 1-510 of the structure 1-506.

Turning now to FIG. 13, an exemplary manifold assembly is shown secured to a supporting structure at a work site. In a typical work site 1-600, such as a construction site or the like, the manifold assembly 1-602 may be secured to a supporting structure 1-604, such as a 2.times.4 framing member, a wall, a floor surface, a work table, or the like to provide a convenient means of locating the manifold assembly at the site 1-600. In an exemplary embodiment, the manifold assembly's frame 1-606 may include a flange 1-608 having one or more holes formed therein. Fasteners 1-610 such as a nails (shown), screws, bolts, or the like may extend or be driven though these holes for attaching the manifold assembly to the supporting structure 1-604. Alternately, one or more clamps may be provided for clamping the manifold assembly 1-602 to the supporting structure 1-604, or, the manifold assembly may be provided with a stand or base suitable for supporting the manifold assembly on a generally horizontal surface such as a tabletop, a floor, or the ground (see FIG. 12).

Small knobs or feet 1-612 formed of a non-marring, wear resistant material such as plastic, a composite, or the like on the bottom surface of the frame 1-606 prevent direct contact with the frame 1-606 and supporting structure 1-604 for preventing unnecessary damage to the supporting structure 1-604 or manifold assembly 1-602 due to contact or rubbing during use. An air hose 1-614 is connected to inlet port 1-616 of the manifold assembly 1-602 for pneumatically coupling the manifold assembly 1-602 to an air compressor assembly (not shown). Similarly, one or more air hoses 1-618, 1-620, 1-622 & 1-624 may be connected to outlet ports 1-626, 1-628, 1-630 & 1-632 for coupling one or more air powered tools (not shown) to the manifold assembly 1-602. A pressure regulator assembly 1-634 and indicators such as pressure gauges 1-636 & 1-638 allow users to monitor and control the pressure of air provided at the outlet ports 1-626, 1-628, 1-630 & 1-632.

Referring now to FIG. 14, in accordance with an exemplary embodiment of the invention multiple manifold assemblies may be chained together to provide compressed air to air powered tools at several locations in a work site. In a typical work site 1-700, such as a construction site or the like, a first manifold assembly 1-702 may be pneumatically coupled to an air compressor assembly via an air hose 1-706. As shown in FIG. 14, the first manifold assembly 1-702 may be secured to a supporting structure, such as a 2.times.4 framing member (shown), a wall, a floor surface, a work table, or the like at a first location at the work site 1-700. A second manifold assembly 1-704 is coupled to an outlet port of the first manifold assembly 1-702 via an air hose 1-708. The second manifold assembly 1-704 may be secured to a supporting structure, such as a floor surface, a 2.times.4 framing member, a wall, a work table, or the like at a second location at the work site 1-700. One or more air powered tools 1-710, 1-712, 1-714 & 1-716 may by pneumatically coupled to either the first manifold assembly 1-702 or second manifold assembly 1-704 via air hoses 1-718, 1-720, 1-722 & 1-724 for use at either the first location or the second location, respectively. In this manner, compressed air may be supplied to multiple locations within a work site from a single air compressor assembly (not shown) for powering air powered tools at each location. Alternately, multiple manifold assemblies may be located within close proximity to each other so that compressed air may be supplied to a greater number of tools that would be possible with a single manifold assembly.

In FIGS. 2 through 14, the air compressor assembly is illustrated as having a compressor of the type having a reciprocating piston pump driven by an electric motor. However, it should be appreciated that air compressor assemblies having manifold assemblies in accordance with the present invention may employ other compressor technologies. For instance, an air compressor might employ a reciprocating piston pump driven by a small internal combustion engine via a belt drive, a rotary or turbine pump driven by an electric motor or internal combustion engine, and the like. Use of such alternate compressor technologies would not depart from the scope and spirit of the present invention.

It will be appreciated that manifold assemblies in accordance with the present invention may at times be removed from the air compressor assembly and used within the immediate vicinity of the air compressor assembly. Consequently, the terms "remote", "remotely located" and "remote location" utilized herein should not be limited by the distance separating the manifold assembly and air compressor assembly. Instead, such terms should be construed as encompassing any use of the manifold assembly while detached from the air compressor assembly regardless of the distance of separation between the manifold assembly and air compressor assembly.

Referring generally now to FIGS. 15 through 27, exemplary embodiments of a second aspect of the present invention directed to an air compressor assembly including a lifting handle are shown.

Air compressor assemblies may include an air tank for the storage of compressed air. In portable applications, air compressor assemblies are typically transported with the use of a wheel assembly and a transport handle assembly used to guide the air compressor assembly when utilizing the wheel assembly. However, a typical transport handle assembly is not suited for lifting the air compressor, such as when the air compressor assembly is loaded into a truck, needs to be transported over stairs, is lifted over uneven ground, and the like. Therefore, by supplying lifting handles as a part of the air compressor assembly, the assembly may be more easily lifted.

Figure 15:
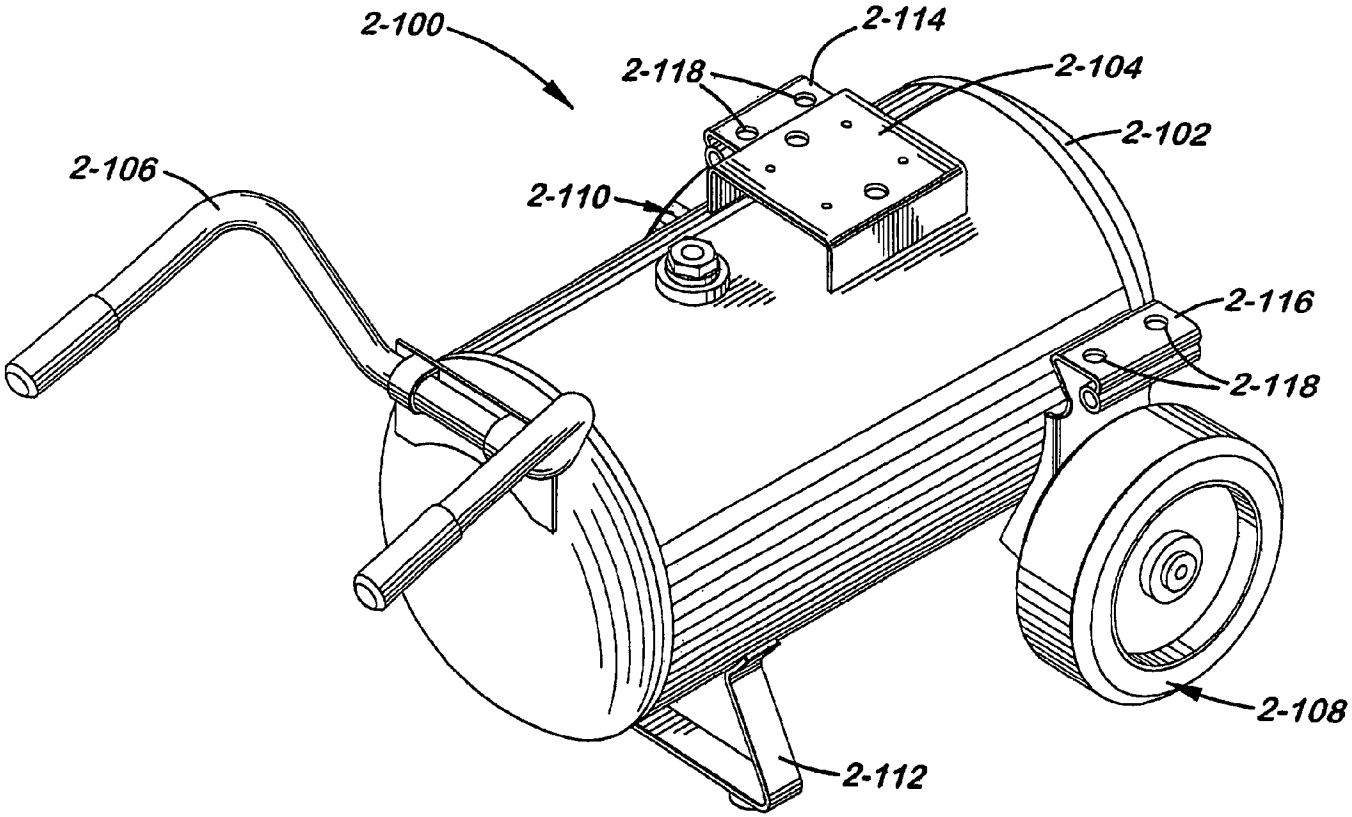
FIG. 15 is an isometric drawing of an exemplary embodiment of the present invention wherein an air compressor assembly includes lifting handles.

Referring now to FIG. 15, an exemplary embodiment of the present invention is shown wherein an air compressor assembly 2-100 includes lifting handles so as to enable the air compressor assembly to be lifted in an easier manner. The air compressor assembly 2-100 generally includes an air tank 2-102 for the storage of compressed air. Typically, the supply of compressed air is accomplished through the use of a compressor and motor, which may be gasoline, electric, and the like which may be mounted to the air tank 2-102 with the use of an engine mount 2-104. A transport handle 2-106 may be utilized to control the movement of the air compressor assembly 2-100 when utilizing the wheel assemblies 2-108 and 2-110. In this way, the air compressor assembly 2-100 is capable of portable operation by tilting the base 2-112 from the ground thereby permitting the wheel assemblies 2-108 and 2-110 to proceed. However, the use of transport handles 2-106 alone is not well suited for lifting the air compressor assembly 2-100. Therefore, a lifting handle 2-116 and 2-114 is positioned on each side of the air tank 2-102 proximally to the wheel assemblies 2-108 and 2-110 to enable the air compressor assembly 2-100 to be lifted without the necessity of the unsure grasping and wrestling of an air compressor assembly as previously required.

It may also be preferable to include tie-down points 2-118 with the lifting handles 2-114 and 2-116 to secure the air compressor assembly 2-100 during transport. For example, an air compressor assembly 2-100 is typically not well suited for transport in the back of a truck. During transport, the air compressor assembly 2-100 may be subjected to jostling and bumps which may cause the air compressor assembly to move in unwanted and unpredictable ways, such as tipping, sliding, and the like. Thus, by providing tie-down points 2-118, the air compressor assembly 2-100 may be secured, thereby preventing damage not only to the air compressor assembly 2-100, but also its surroundings.

Figure 16:
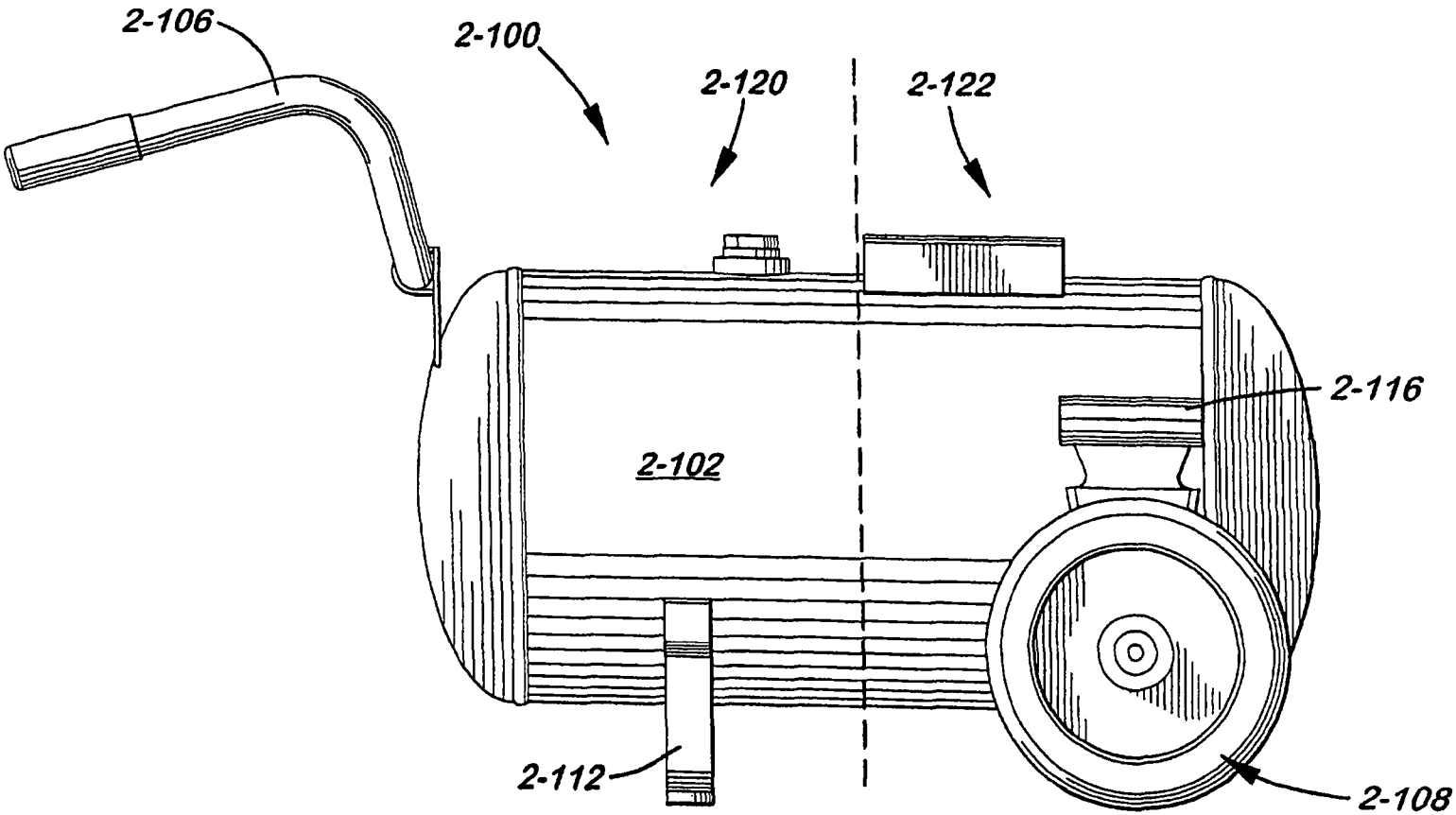
FIG. 16 is a side view of the exemplary embodiment illustrated in FIG. 15, wherein a lifting handle is formed as an integral part of a wheel assembly.

Referring now to FIG. 16, a side view of the exemplary embodiment of FIG. 15 is shown. An air compressor assembly 2-100 includes an air tank 2-102. The air tank 2-102 includes a transport handle 2-106 and wheel assembly 2-108 for rolling the air compressor assembly 2-100. The air tank 2-102 may be defined to include a first end portion 2-120 and a second end portion 2-122. Accordingly, in the present example, the first end portion 2-120 may include the transport handle 2-106, and the second end portion 2-122 may include the wheel assembly 2-108 and the lifting handle 2-116. In this way, both the first end portion 2-120 and the second end portion 2-122 are supported when the air compressor assembly 2-100 is lifted. Thus, the breakage and effort previously associated with lifting an air compressor assembly may be greatly diminished.

Figure 17:
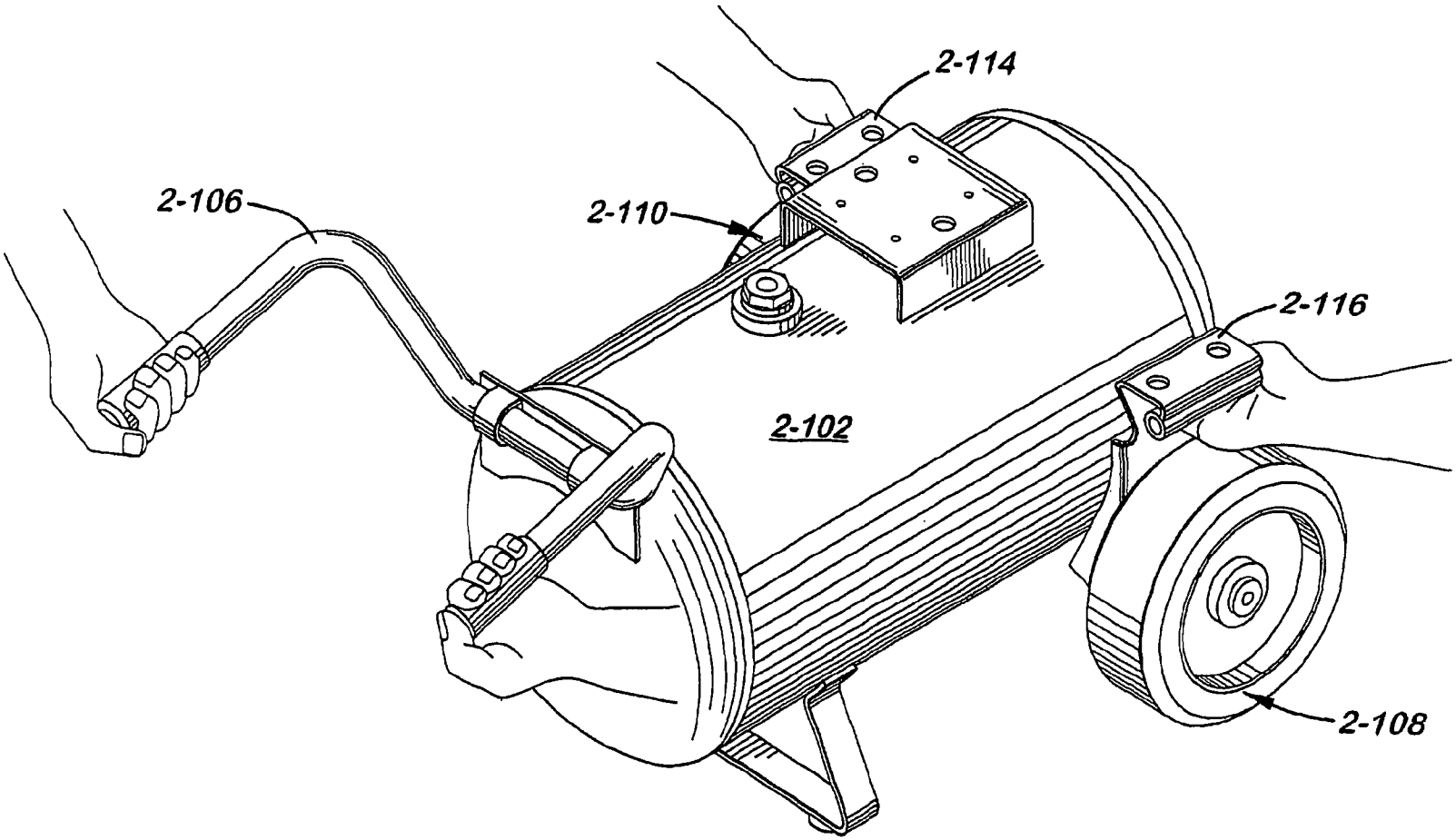
FIG. 17 is an additional side view of the exemplary embodiment illustrated in FIG. 15, wherein a lifting handle is employed to lift the air compressor assembly.

As shown in FIG. 17, lifting handles 2-114 and 2-116 positioned on an air tank 2-102 enable users to lift the air compressor assembly 2-100 in an efficient manner. In this example, a user grasps the first lifting handle 2-114 and the transport handle from one side while another user grasps the second lifting handle 2-116 and the transport handle 2-106 to be able to lift the air compressor assembly 2-100 in a secure manner. In another example, a user may be positioned on the end of the air compressor assembly to grasp both lifting handles 2-114 and 2-116 while another user grasps the transport handle 2-106 to lift the air compressor assembly 2-100 from the ends.

Figure 18:
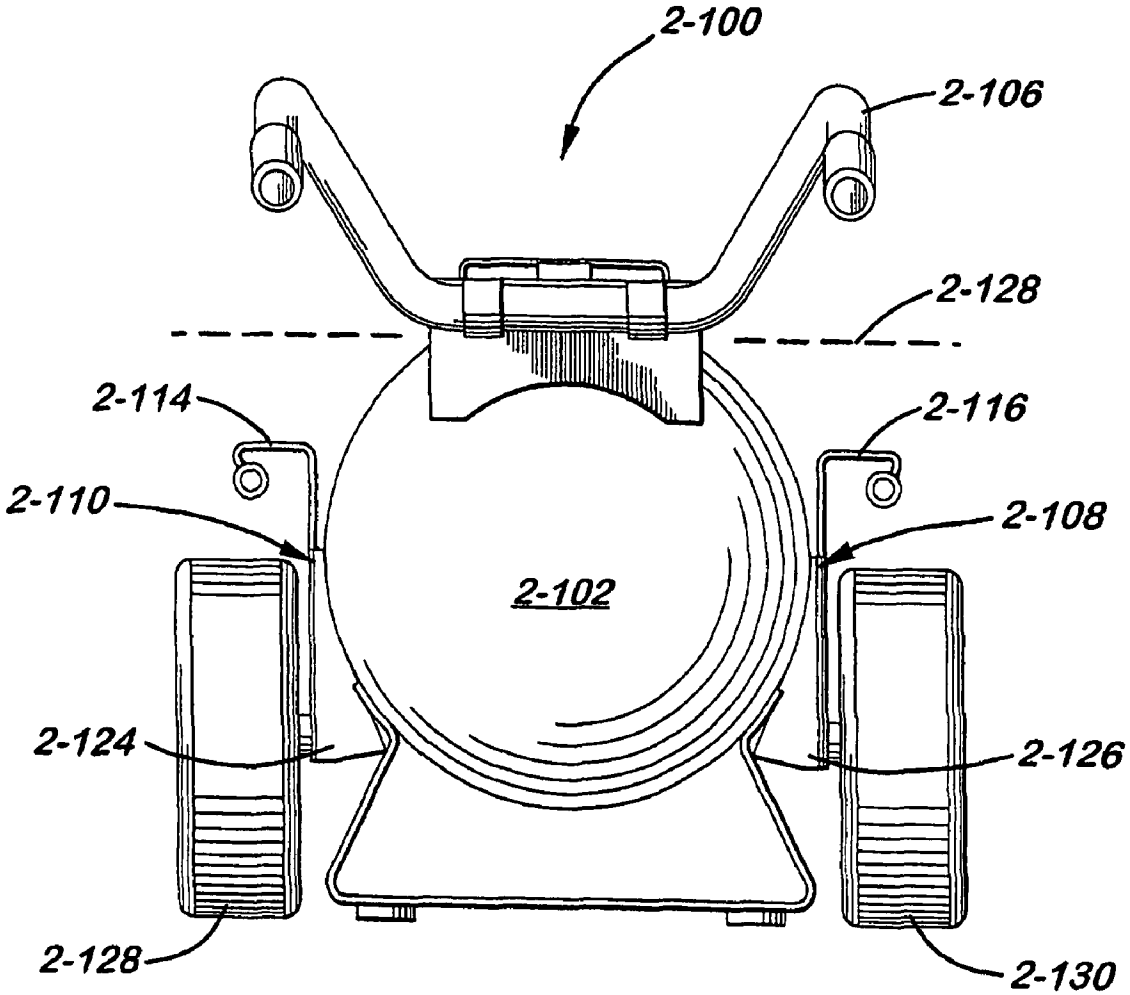
FIG. 18 is an end view of an additional exemplary embodiment wherein an integrated lifting handle and wheel assembly is shown.

Referring now to FIG. 18, an end view of the exemplary embodiment of FIG. 15 is shown. It may be preferable to include the lifting handles 2-114 and 2-116 as an integral part of the wheel assemblies 2-108 and 2-110 to provide an integrated part that may be manufactured and attached in a cost-effective manner. The wheel assemblies 2-108 and 2-110 may include wheel mounts 2-124 and 2-126 suitable for attaching wheels 2-128 and 2-130, thereby enabling the air compressor assembly 2-100 to be rolled. In this example, the wheel assemblies 2-108 and 2-110 are shown as two separate wheel assemblies 2-108 and 2-110, which may be preferable so as to reduce the cost of materials. However, a single wheel assembly may also be utilized which includes two wheels, a single wheel, a plurality of wheels and brackets, and the like without departing from the spirit and scope of the present invention.

It may also be preferable to locate the lift handles 2-114 and 2-116 below or generally equal to the top edge 2-128 of the air tank 2-102. By locating the lifting handles 2-114 and 2-116 below the top edge of the air tank 2-128, a user may be better able to control the lifting of the air compressor assembly 2-100 as well as have an increased lifting range. For example, a user, grasping a transport handle 2-106 may not be able to lift the air compressor assembly 2-100 as high as with a lower located lifting handle 2-114 and 2-116, which may be required when loading the air compressor assembly in the back of a truck, carrying the air compressor assembly over rough terrain, and the like. Thus, the location of the lifting handles 2-114 and 2-116 below the top edge of the air tank 2-102 may enable the air compressor assembly 2-100 to be lifted in an improved manner.

Figure 19:
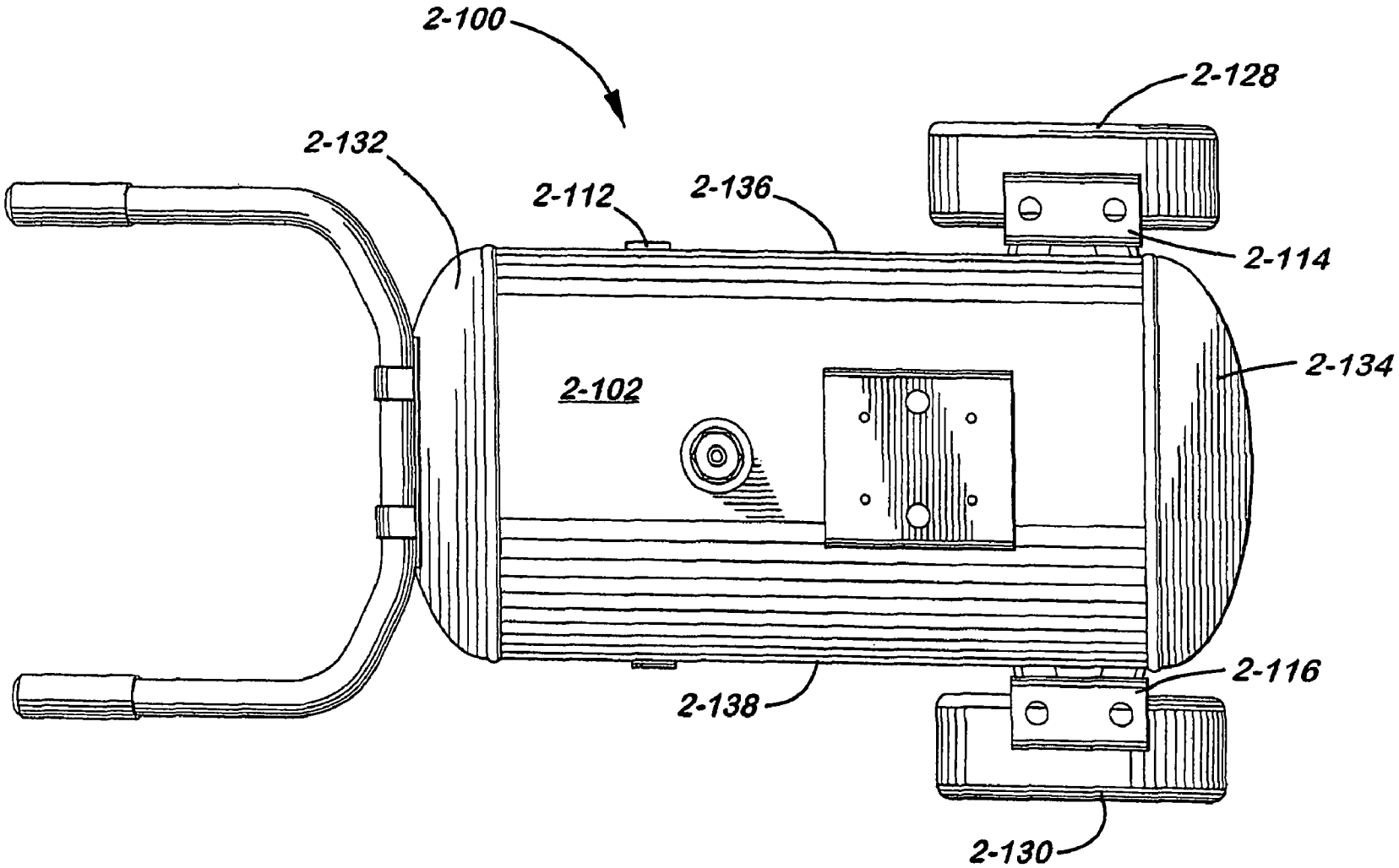
FIG. 19 is a top view of the exemplary embodiment illustrated in FIG. 15 indicating the position of the lifting handle.

Referring now to FIG. 19, a top view of the exemplary embodiment of FIG. 15 is shown. An air compressor assembly 2-100 suitable for storing compressed air includes an air tank 2-102. The air tank 2-102 includes a front-end portion 2-132, a rearward portion 2-134, a first side portion 2-136, and a second side portion 2-138. Lift handle assemblies 2-114 and 2-116, suitable for use in lifting the air compressor assembly 2-100, are at least partially disposed on at least one of the first 2-136 and second 2-138 side portions. In this way, users positioned at both sides 2-136 and 2-138 may be able to lift the air compressor assembly 2-100, as shown in FIG. 17. This may prove especially useful when trying to lift the air compressor assembly 2-100 onto a higher surface. For example, users may lift the air compressor assembly 2-100 from the side 2-136 and 2-138, position the wheels 2-128 and 2-130 on the surface, and then roll the air compressor assembly 2-100 so that the base 2-112 is also placed on the surface. Thus, lifting the air compressor assembly 2-100 is much easier than the wrestling that was required to lift previous air compressor assemblies.

Figure 20:
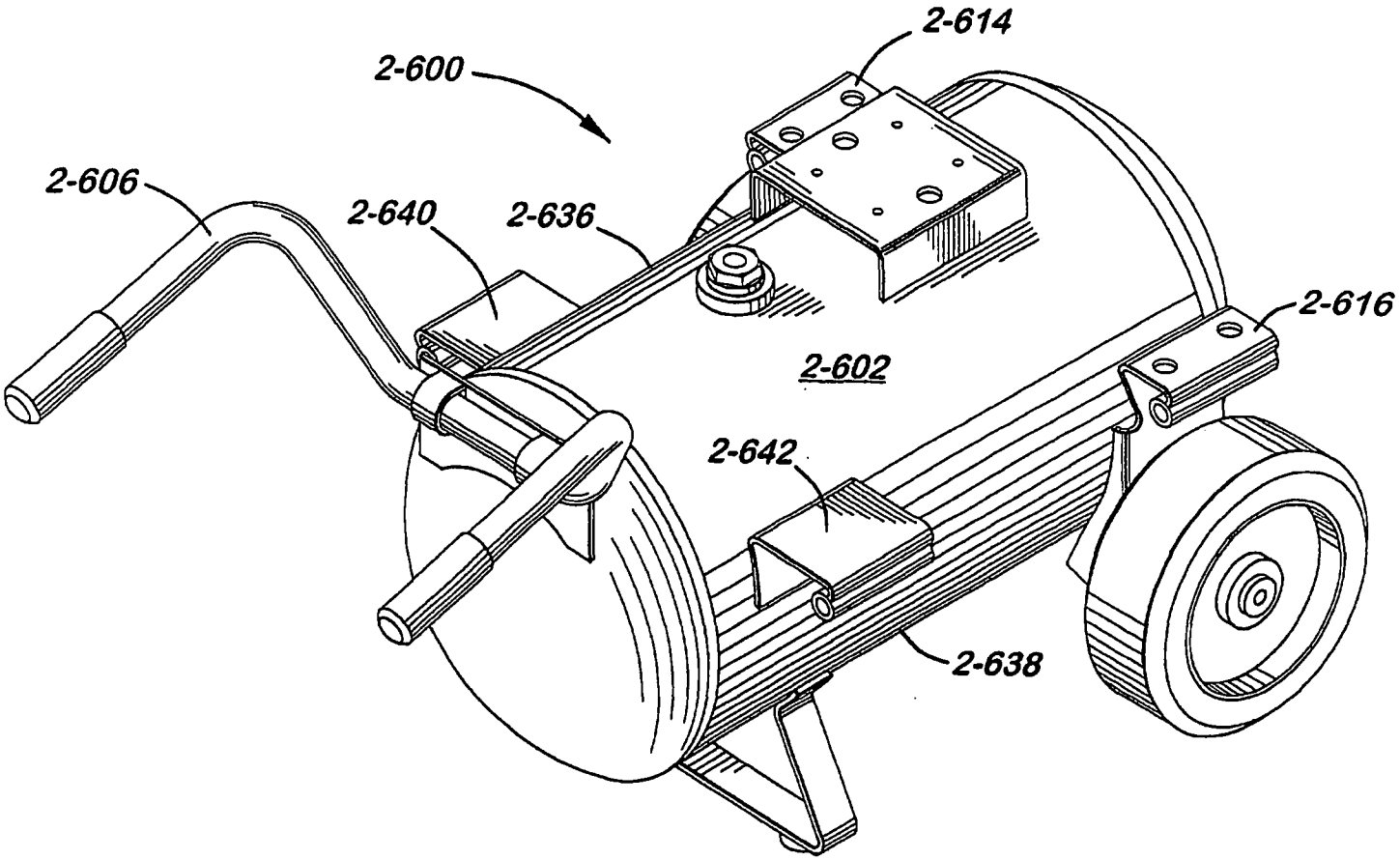
FIG. 20 illustrates an additional exemplary embodiment of the present invention wherein additional lifting handle placement is shown.

Lifting handles may take many different forms and be placed at a variety of positions without departing from the spirit and scope of the present invention. For example, as shown in FIG. 20 in an additional exemplary embodiment of the present invention, a plurality of lifting handles may be placed on the side of an air compressor assembly 2-600. In this example, a second lifting handle 2-642 and 2-640 is added to each side 2-636 and 2-638 of the air compressor assembly 2-600. Thus, each side of the air tank 2-602 includes a first lifting handle 2-616 and 2-614 and a second lifting handle 2-640 and 2-642 to enable a user positioned at a side 2-636 and 2-638 of the air compressor assembly 2-600 to lift the assembly 2-600 without having to reach for the transport handle 2-606. This may further enable a user to lift the air assembly in an efficient manner, without causing damage to the air compressor assembly 2-600 or injury to the user. For example, the weight and size of an air compressor assembly 2-600 may be quite substantial. By enabling a user to lift the air compressor assembly 2-600 in a more natural manner, the chances of injury due to over-reaching and the damage that may be caused to the assembly if dropped may be greatly reduced.

Figure 21:
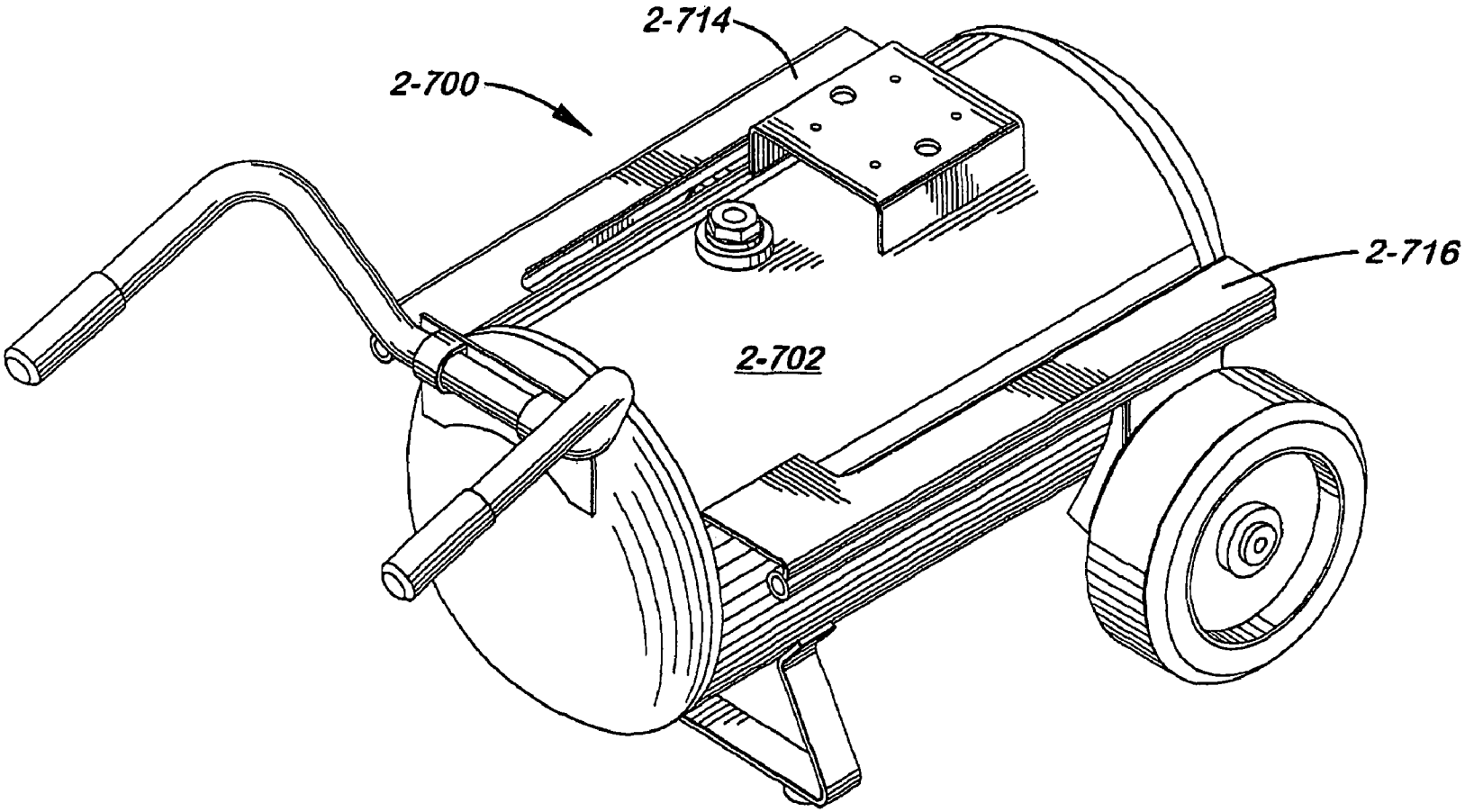
FIG. 21 depicts an additional exemplary embodiment of the present invention wherein a lifting handle is shown extending substantially along the length of an air tank.

Additionally, the lifting handles may extend along the sides of the air compressor assembly, an example of which is shown in FIG. 21. A first lifting handle 2-714 and a second lifting handle 2-716 extend generally along the side of the air compressor assembly 2-700. These handles 2-714 and 2-716 may be attached to the air tank 2-702 and extend generally along the middle section of the air tank to provide an extended gripping region. Thus, multiple users may utilize the lifting handles 2-714 and 2-716 to lift the air compressor assembly 2-700, which may further prevent injury and damage.

Figure 22:
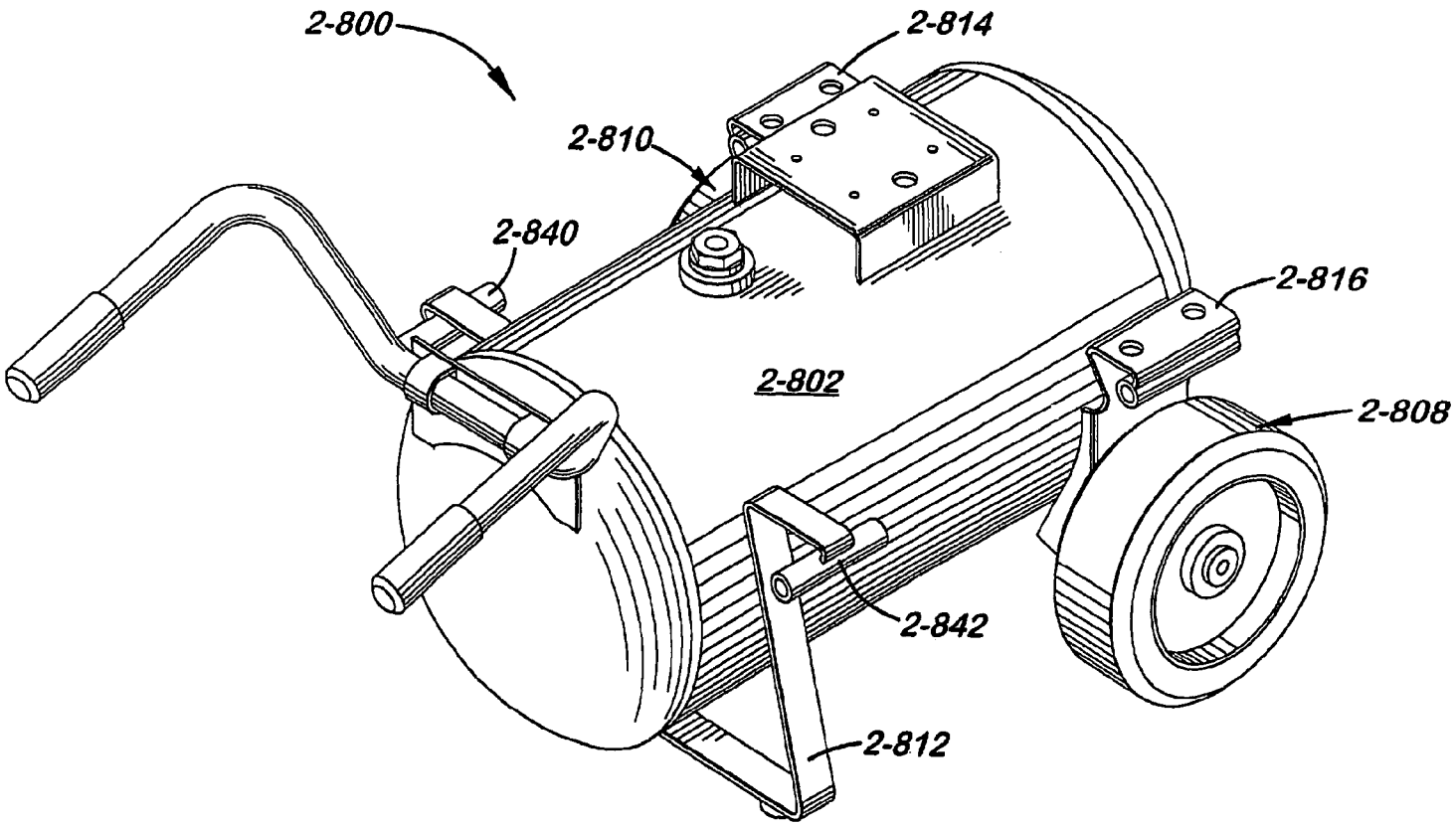
FIG. 22 illustrates an additional exemplary embodiment of the present invention wherein a lifting handle is shown formed as an integral part of an air tank support assembly.

Furthermore, the lifting handles may be formed as an integral part of the base of the air compressor assembly. For example, as shown in FIG. 22, an air compressor assembly 2-800 may incorporate a wheel assembly 2-808 and 2-810 with integral lifting handles 2-814 and 2-816. A base 2-812 of the air compressor assembly may also incorporate lifting handles 2-840 and 2-842 to provide an additional gripping region. In this way, the handles 2-840 and 2-842 may be manufactured with the base 2-812, resulting in a cost saving in both production and assembly. Further the additional set of handles 2-840 and 2-842 provide increased control and ease of use as described in FIG. 20.

Figure 23:
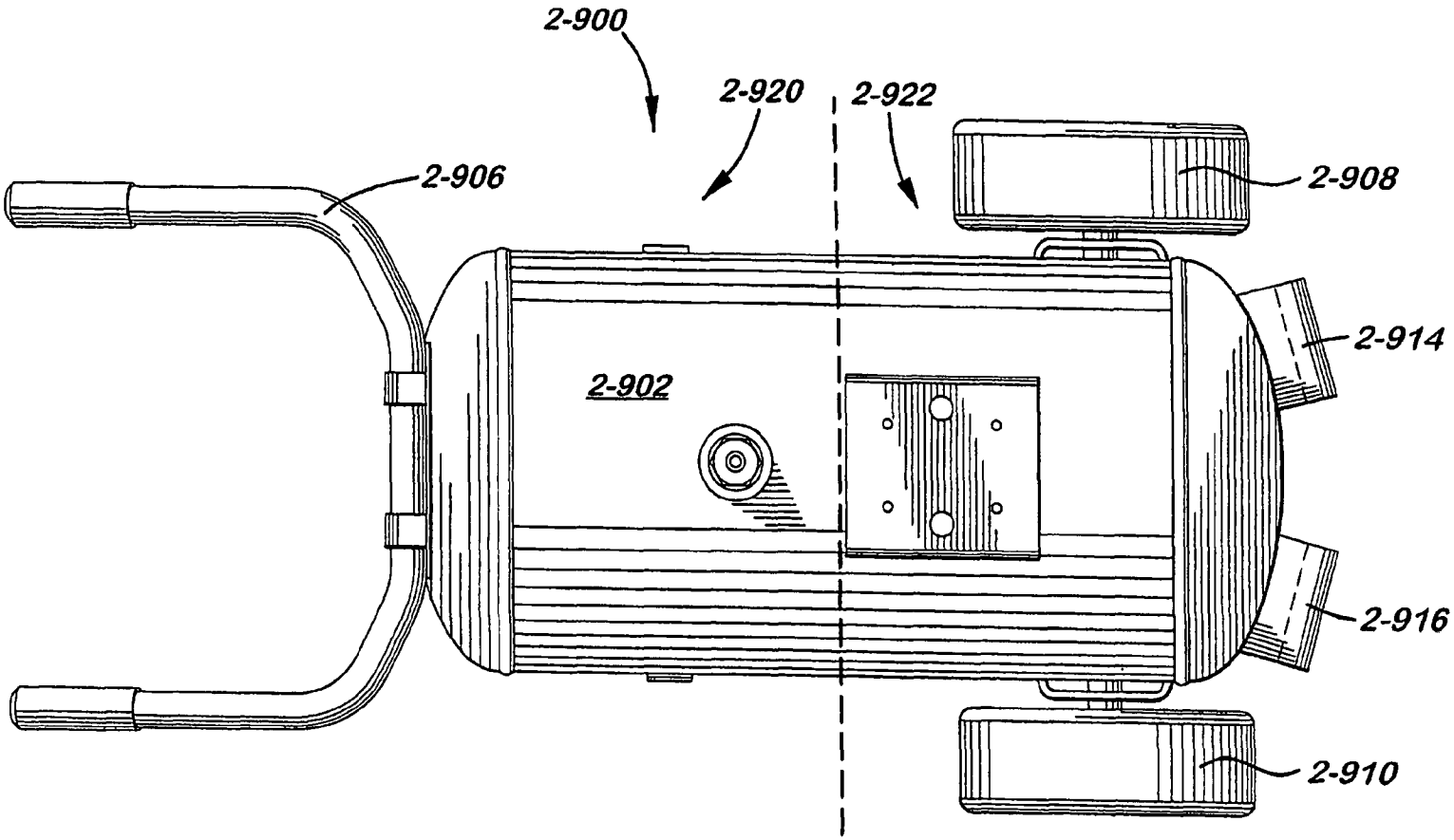
FIG. 23 illustrates an additional exemplary embodiment wherein a lifting handle position on the rearward portion of an air tank is shown.

Lifting handles may also be positioned at the end of the air compressor assembly, an example of which is shown in FIG. 23. The air tank 2-902 may include a first end portion 2-920 and a second end portion 2-922. The first end portion 2-920 may include the transport handle 2-906 and the second end portion 2-922 may include the wheel assembly 2-908, 2-910 and a first lifting handle 2-914 and a second lifting handle 2-916. Thus, both the first end portion 2-920 and the second end portion 2-922 are supported when the air compressor assembly 2-900 is lifted.

Figure 24:
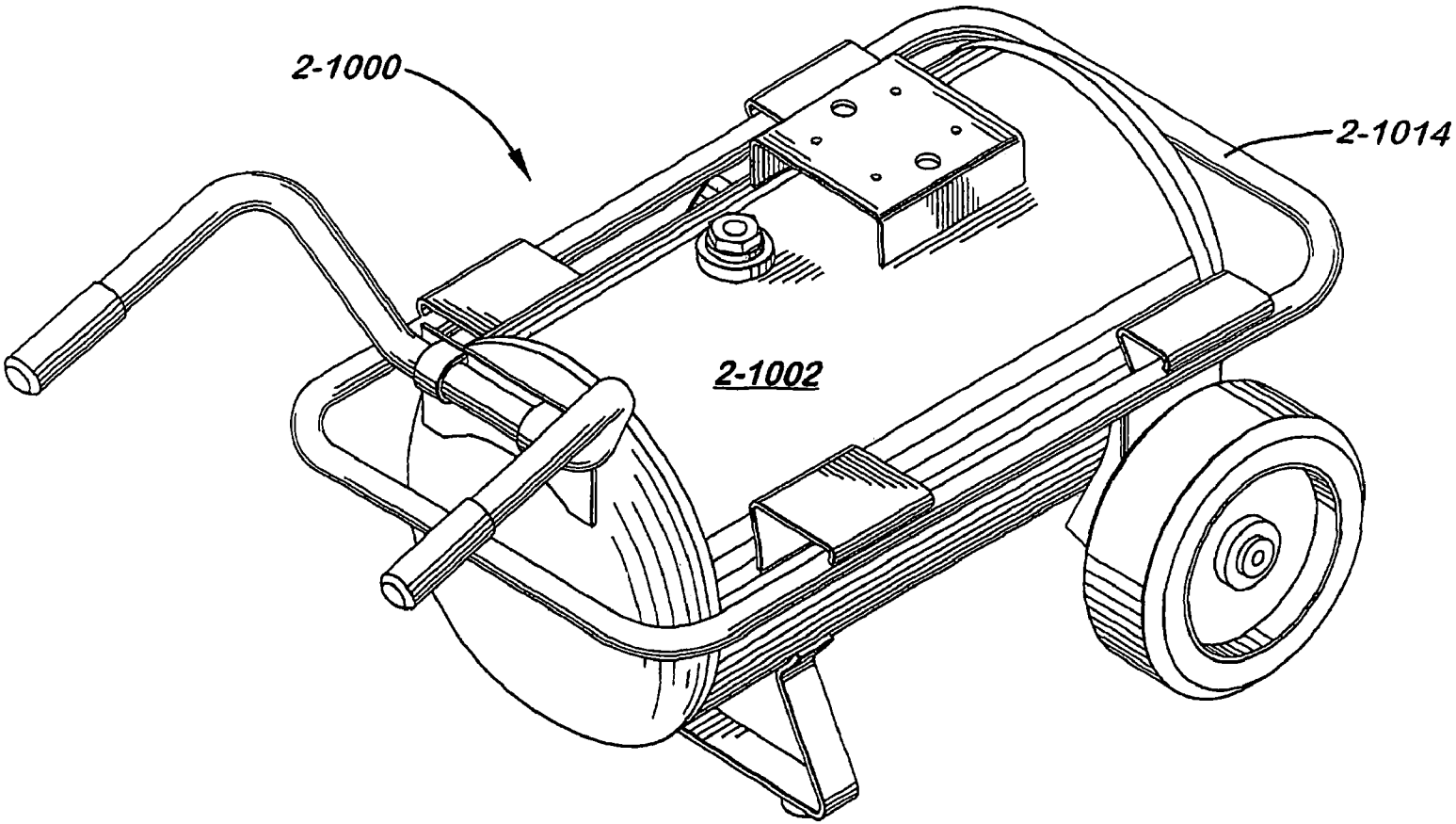
FIG. 24 depicts an additional exemplary embodiment wherein a lifting handle is shown extending substantially around an air tank in a horizontal manner.

Lifting handles may also be formed so as to surround the air tank. For example, as shown in FIG. 24, an air compressor assembly 2-1000 may include an air tank 2-1002 with a lifting handle 2-1014 extending substantially around the air tank 2-1002 in a horizontal manner. In this example, the lifting handle 2-1014 extend through both the first end portion 2-920 and the second end portion 2-922 as discussed in FIG. 23. The air tank 2-1002 formed in a cylindrical shape, is positioned horizontally, i.e. the longest dimension of the air tank 2-1002 is horizontal. The lifting handle 2-1014, also positioned in a horizontal manner, may provide a variety of grasping regions to enable a user to lift the air compressor assembly 2-1000. Additionally, the lifting handle 2-1014 may provide protection to the air compressor assembly 2-1000 from damage as well as supply multiple tie-down points, as discussed in FIG. 15, to secure the air compressor assembly 2-1000.

Figure 25:
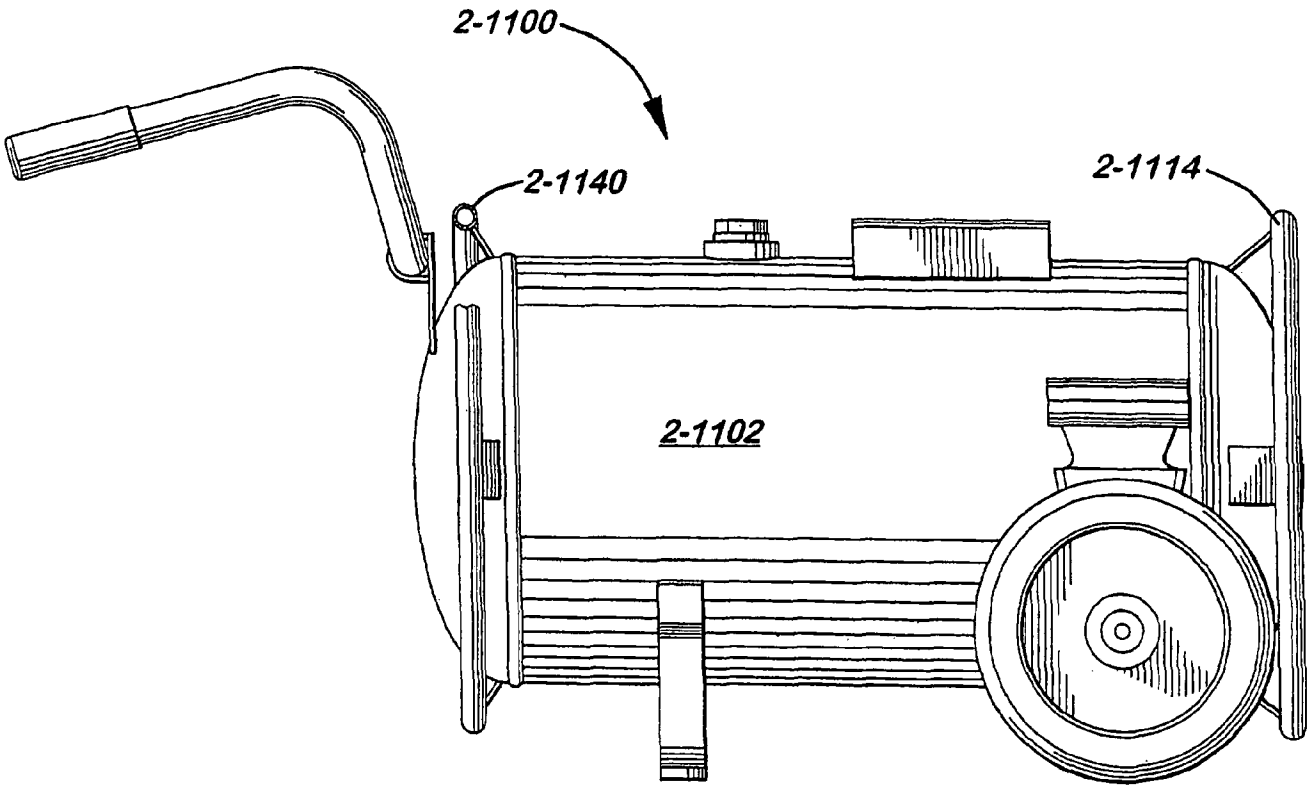
FIG. 25 illustrates an additional exemplary embodiment wherein lifting handles are shown extending substantially around an air tank in a vertical manner.

The lifting handles may also be formed so as to surround the air tank in a vertical manner, an example of which is shown in FIG. 25. An air compressor assembly 2-1100 includes an air tank 2-1102 positioned in a horizontal manner. Lifting handles 2-1114 and 2-1140 extend substantially around the air tank 2-1102 in a vertical manner. In this way, a plurality of grasping regions may be provided with the added benefit of protecting the air compressor assembly 2-1100.

Figure 26:
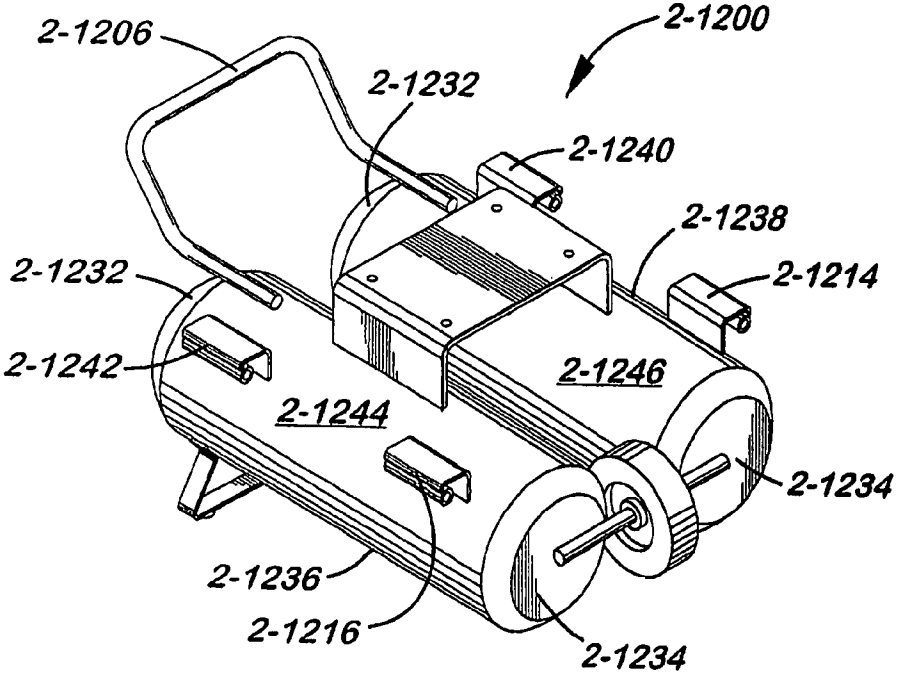
FIG. 26 depicts an additional exemplary embodiment wherein a lifting handle is shown positioned on two air tanks.

An air tank may take a variety of shapes and positions without departing from the spirit and scope of the present invention. For example, as shown in FIG. 26, an air compressor assembly 2-1200 includes a first air tank 2-1244 and a second air tank 2-1246 formed in generally cylindrical shapes. The air tanks 2-1244 and 2-1246 include a front-end portion 2-1232, a rearward portion 2-1234, a first side portion 2-1236, and a second side portion 2-1238. Lift handle assemblies 2-1214 and 2-1216, suitable for use in lifting the air compressor assembly 2-1200, are at least partially disposed on at least one of the first 2-1236 and second 2-1238 side portions. A second lifting handle 2-1242 and 2-1240 is added to each side 2-1236 and 2-1238 of the air compressor assembly 2-1200. In this way, each side portion 2-1236 or 1238 includes a first lifting handle 2-1216 and 2-1214 and a second lifting handle 2-1240 and 2-1242 to enable users positioned at the sides 2-1236 and 2-1238 of the air compressor assembly 2-1200 to lift the assembly 2-1200 without having to reach for the transport handle 2-1206.

Figure 27:
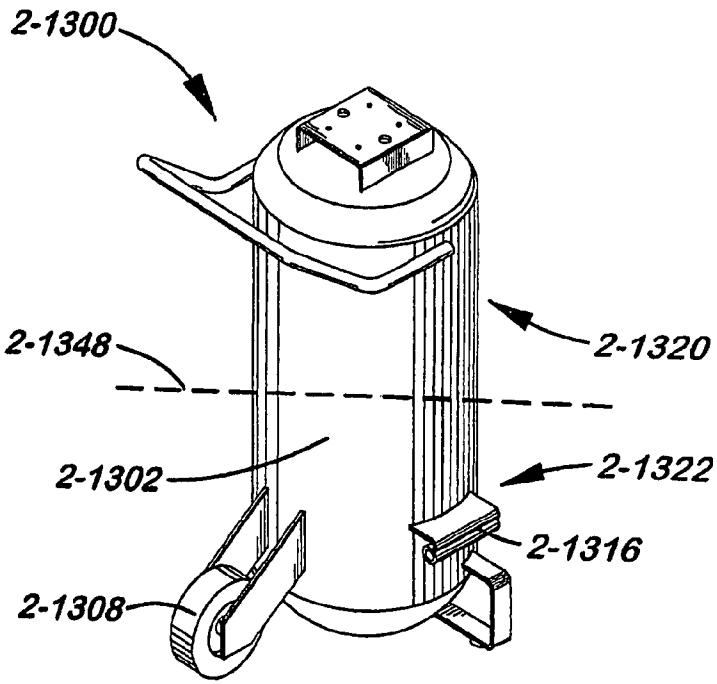
FIG. 27 depicts an additional exemplary embodiment of the present invention wherein a lifting handle is shown positioned on a vertical air tank.

The air compressor assembly may also include an air tank oriented in a vertical direction, an example of which is shown in FIG. 27. An air compressor assembly 2-1300 includes an air tank 2-1302 oriented in a vertical manner, i.e. the longest dimension of the air tank is positioned generally vertical. The air tank 2-1302 may be described so that the longest dimension of the air tank 2-1302 includes a first end portion 2-1320 and a second end portion 2-1322. The first end portion 2-1320 and the second end portion 2-1322 may be divided generally at a midpoint 2-1348 along a length of the longest dimension of the air tank 2-1302. Thus, the second end portion 2-1322 may include the wheel assembly 2-1308 and the lifting handle 2-1316, and the first end portion 2-1320 may include the transport handle 2-1306 to enable improved lifting of the air compressor assembly 2-1300.

Referring generally now to FIGS. 28 through 41, exemplary embodiments of a third aspect of the present invention directed to an air compressor assembly including a handle assembly capable of assuming multiple positions are shown.

Figure 28:
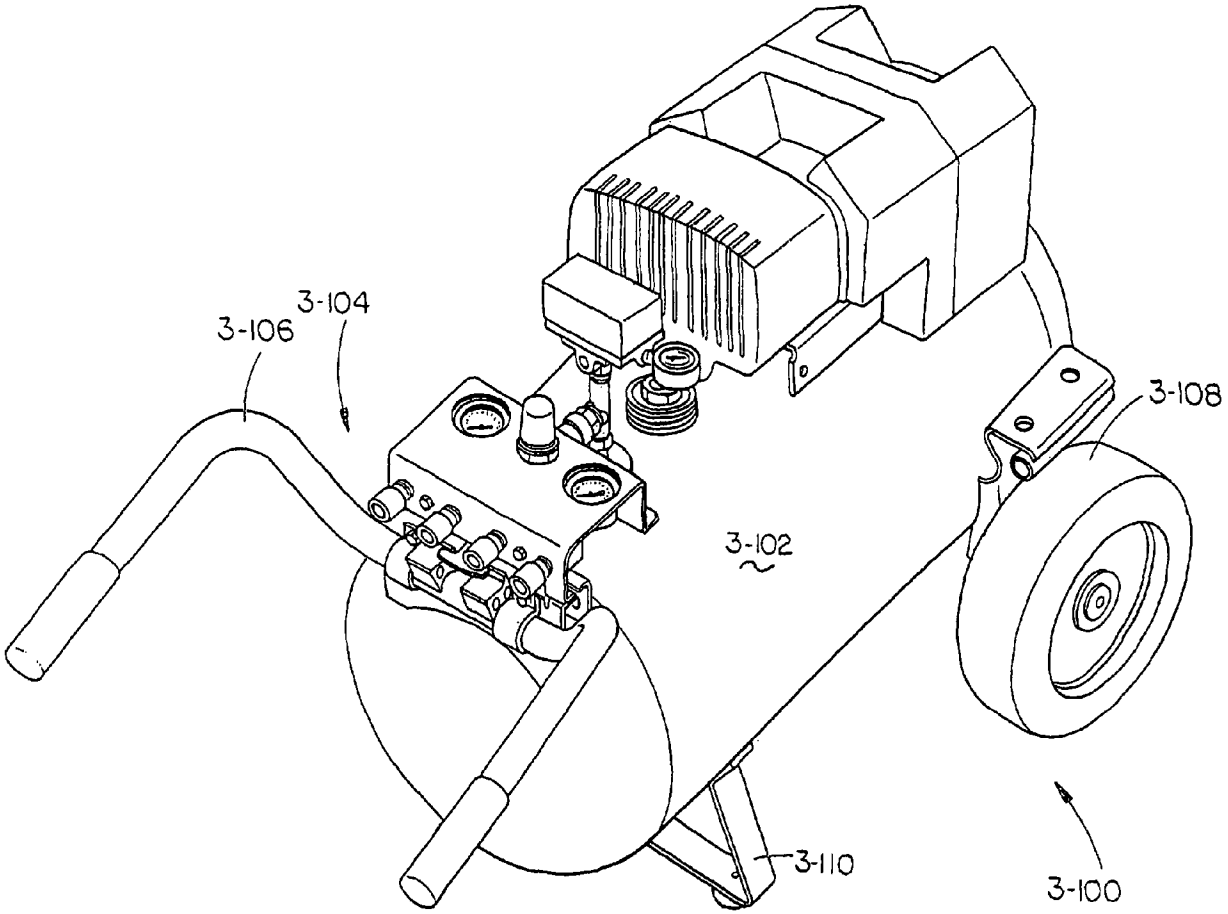
FIG. 28 is an isometric drawing of an exemplary embodiment of the present invention wherein an air compressor assembly includes a handle assembly including a handle capable of assuming a plurality of positions.

Referring to FIG. 28, an exemplary embodiment of the present invention is shown wherein an air compressor assembly 3-100 includes a handle suitable for attaining a plurality of positions, thereby enabling the assembly 3-100 to be lifted in an easier manner. The air compressor assembly 3-100 generally includes an air tank 3-102 for the storage of compressed air. Typically, the supply of compressed air is accomplished through the use of a compressor and motor, which may be gasoline, electric, and the like. A handle assembly 3-104 including a handle 3-106 may be utilized to control the movement of the air compressor assembly 3-100 when utilizing the wheel assembly 3-108. In this way, the air compressor assembly 3-100 is capable of portable operation by tilting a base 3-110 of the air compressor assembly 3-100 from a surface thereby permitting the wheel assembly 3-108 to roll.

Figure 29:
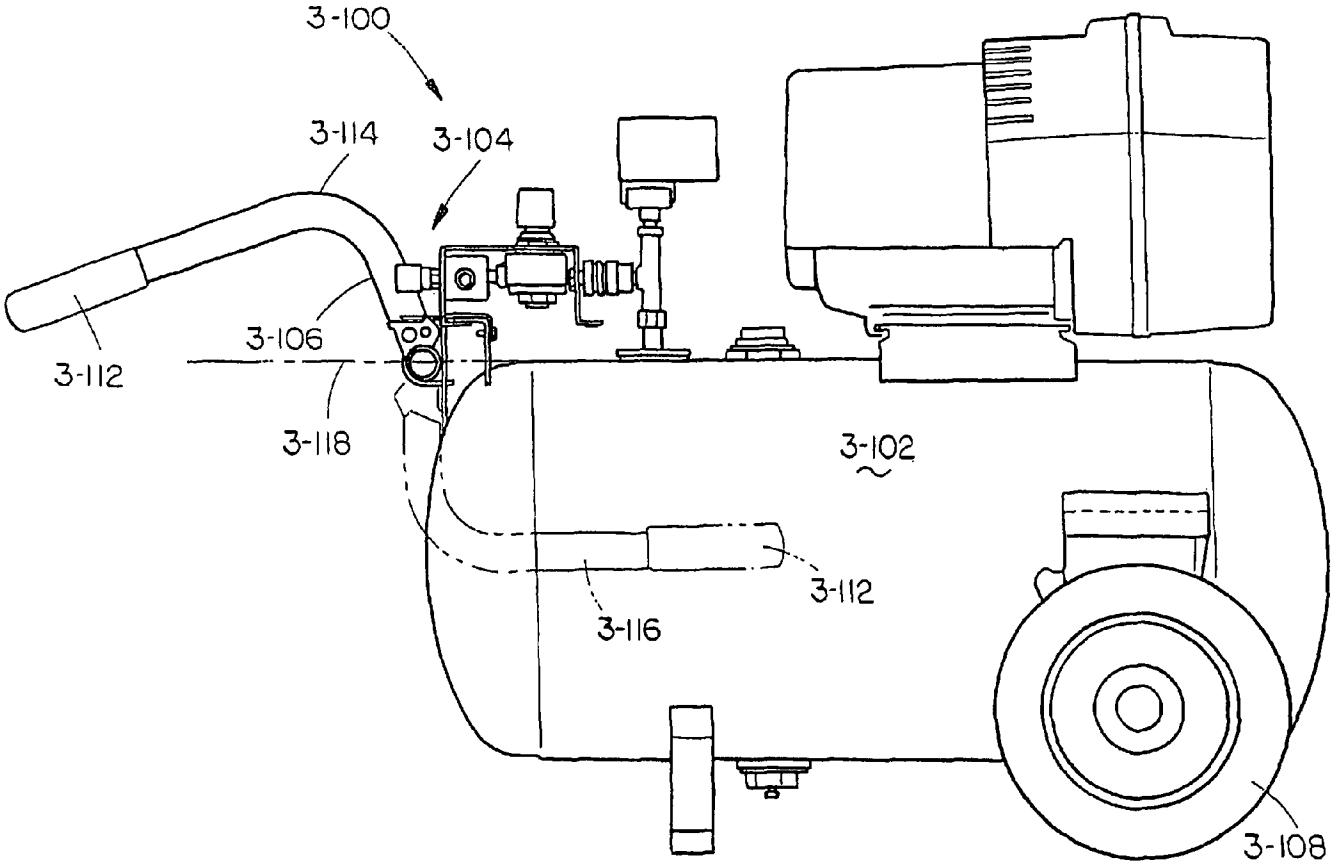
FIG. 29 is a side view of the exemplary embodiment as shown in FIG. 28, wherein a handle assembly suitable for attaining a plurality of positions is shown in a first position and a second position.

The air compressor assembly 3-100 includes a handle assembly 3-106 capable of assuming multiple positions, an example of which is shown in FIG. 29. The handle assembly 3-104, including a handle 3-106 with a grasping region 3-112 suitable for being manually grasped by a user, is capable of attaining both a first position 3-114 and a second position 3-116. The air tank 3-102 is oriented in a generally horizontal direction wherein the longest dimension of the air tank 3-102 is arranged generally horizontal. A top edge 3-118 of the air tank 3-102 includes a plane generally positioned at the highest portion of the air tank 3-102. The first position 3-114 arranges the handle 3-106 and grasping region 3-112 generally above the top edge 3 118 of the air tank 3-102 and the second position 3-116 arranges the handle 3-106 and grasping region 3-112 generally below the top edge 3-118 of the air tank 3-102. By orienting the handle 3-106 generally below the top edge 3-118 of the air tank 3-102, the handle assembly 3-104 provides an improved lifting surface for being grasped by a user when lifting the air compressor assembly 3-100. In this way, a user may lift the air compressor assembly 3-100 in an improved manner without the struggle previously required, such as gripping the wheel assembly 3-108, compressor and motor assembly, trying to grasp the air tank 3-102, and the like. Further, this also results in the ability to lift the air compressor assembly 3-100 higher. This results in a greatly decreased likelihood of causing injury to the user and damage to the air compressor assembly 3-100. In the present embodiment, the handle assembly 3-104 is formed to be capable of moving between a first position and a second position without contacting the surface the air compressor assembly is disposed upon.

Figure 30:
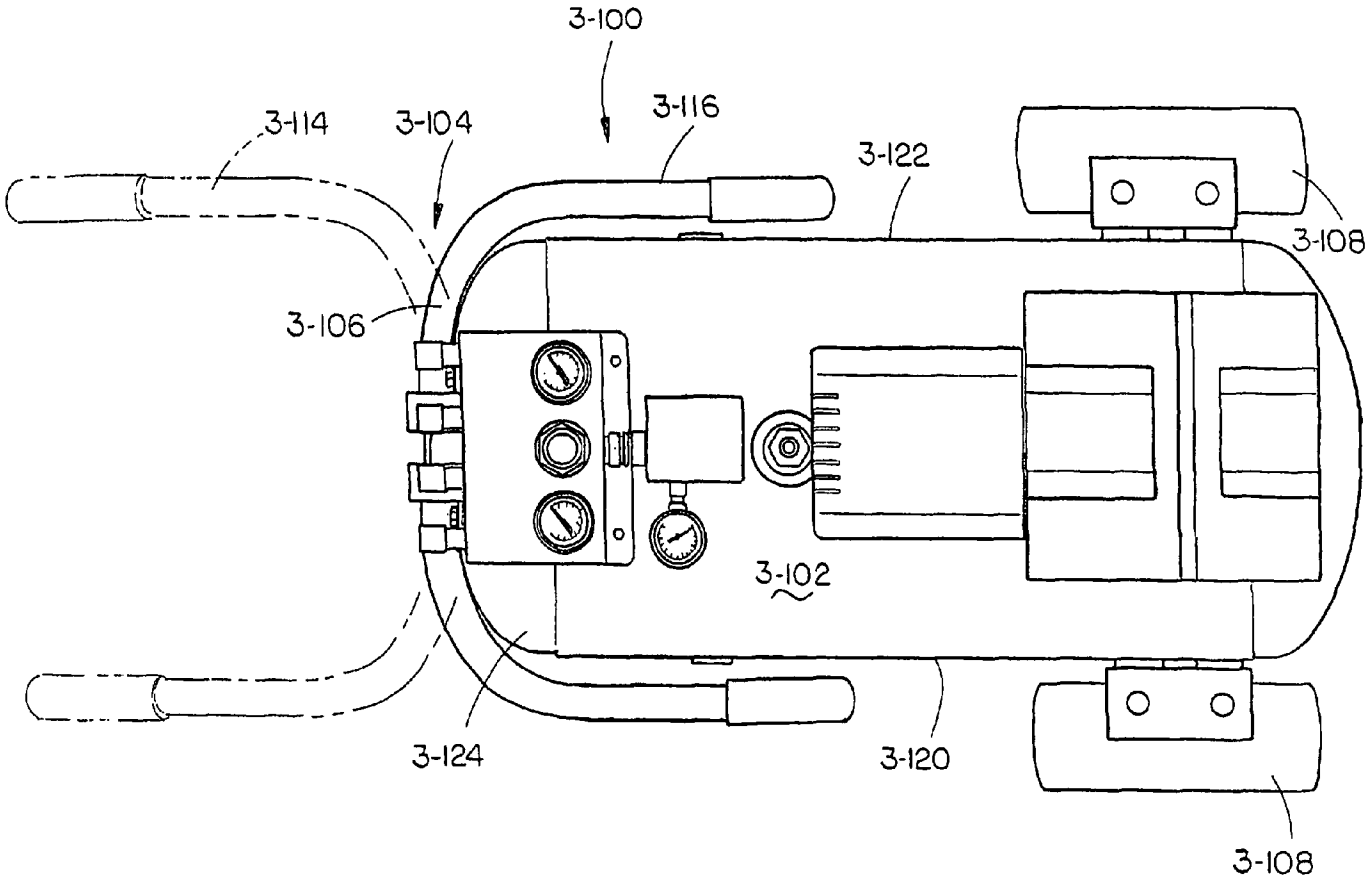
FIG. 30 is a top view of the exemplary embodiment as shown in FIG. 29 further illustrating the placement and orientation of an exemplary embodiment of the present invention.

Referring now to FIG. 30, a top view of the exemplary embodiment of the present invention as shown in FIG. 29 is illustrated. The air compressor assembly 3-100 includes an air tank 3-102 having a first side portion 3-120 and a second side portion 3-122. The handle assembly 3-104, when attaining the second position 3-116, generally aligns the handle 3-106 at least partially along at least one of the first 3-120 and second 3-122 side portions. Thus, a user grasping the handle 3-106 in the second position 3-116 need not reach as far to lift the air compressor assembly 3-100 as when the handle 3-106 is in the first position 3-114. Further, when the handle 3-106 is oriented in the second position 3-116, a user may have more control over the air compressor assembly 3-100 when lifting. When arranged in the first position 3-114, the handle 3-106 may be positioned so that it extends outward from the end portion 3-124 thus enabling a user to roll and control the air compressor assembly 3-100 when utilizing a wheel assembly 3-108. In this way, the handle assembly 3-104 may be oriented in a first position 3-114 with the handle 3-106 oriented outward from the end portion 3-106 to roll the air compressor assembly 3-100. Additionally, the handle assembly 3-104 may also be oriented in a second position 3-116 wherein the handle 3-106 is oriented inward from the end portion 3-124 to supply improved lifting capabilities.

Figure 31:
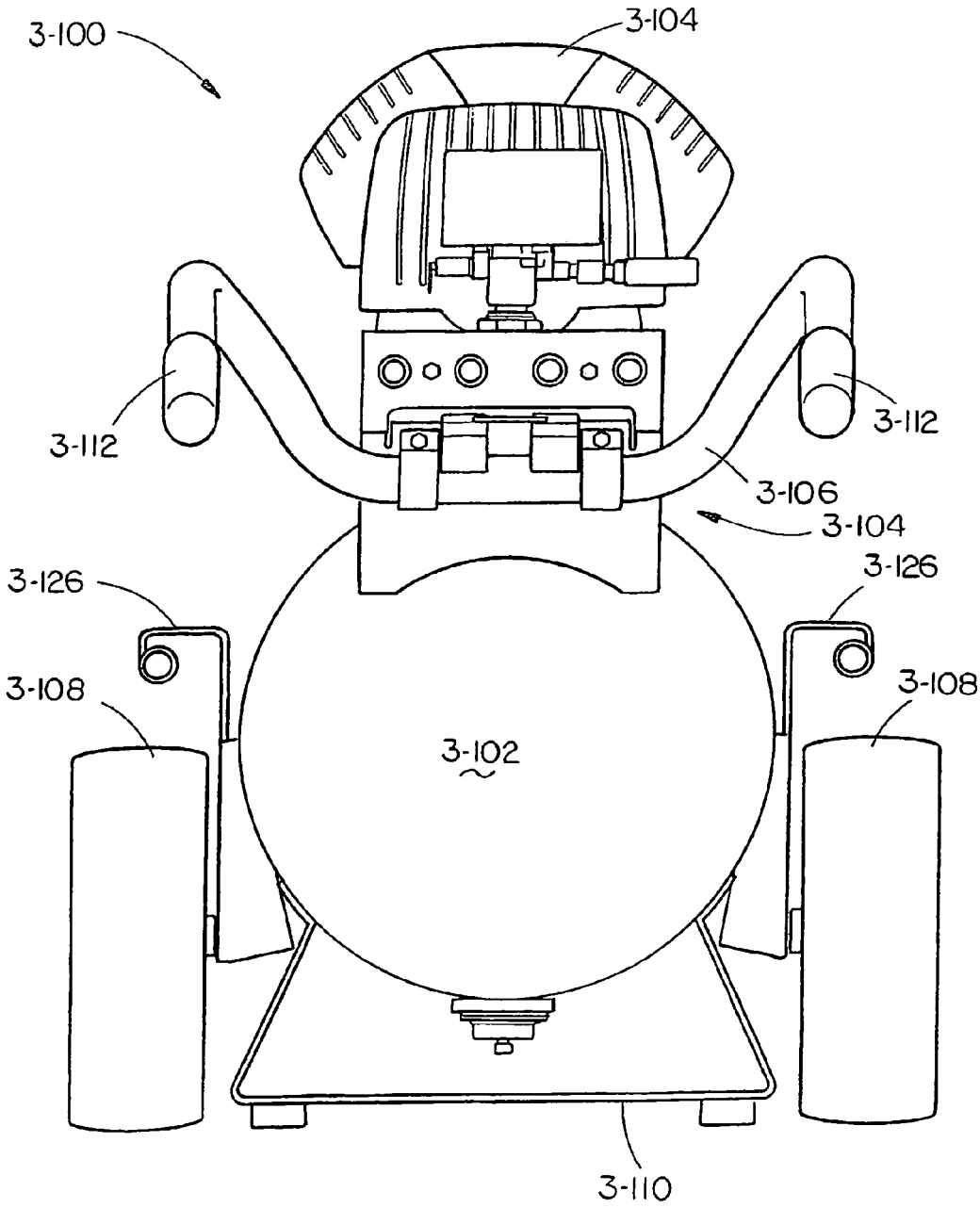
FIG. 31 is an end view of the exemplary embodiment of the present invention shown in FIG. 28.

Referring now to FIG. 31, an end view of the exemplary embodiment of the present invention as shown in FIG. 28 is depicted. An air compressor assembly 3-100 includes an air tank 3-102 with a compressor and motor assembly for supplying compressed air. A handle assembly 3-104, with a handle 3-106 including a grasping region 3-112, may be utilized to tilt the base 3-110 and the air compressor assembly 3-100 so as to utilize the wheel assembly 3-108. The wheel assembly 3-108 may include a wheel, axle, bearings, mounting devices for attaching the wheel assembly 3-108 to an air tank 3-102, and the like. Additionally, a second handle assembly 3-126 may be included to provide an additional support for lifting the air compressor assembly 3-100. It may be preferable to form the second handle assembly 3-126 as an integral part of the wheel assembly 3-108 so as to minimize manufacturing and production costs.

Figure 32:
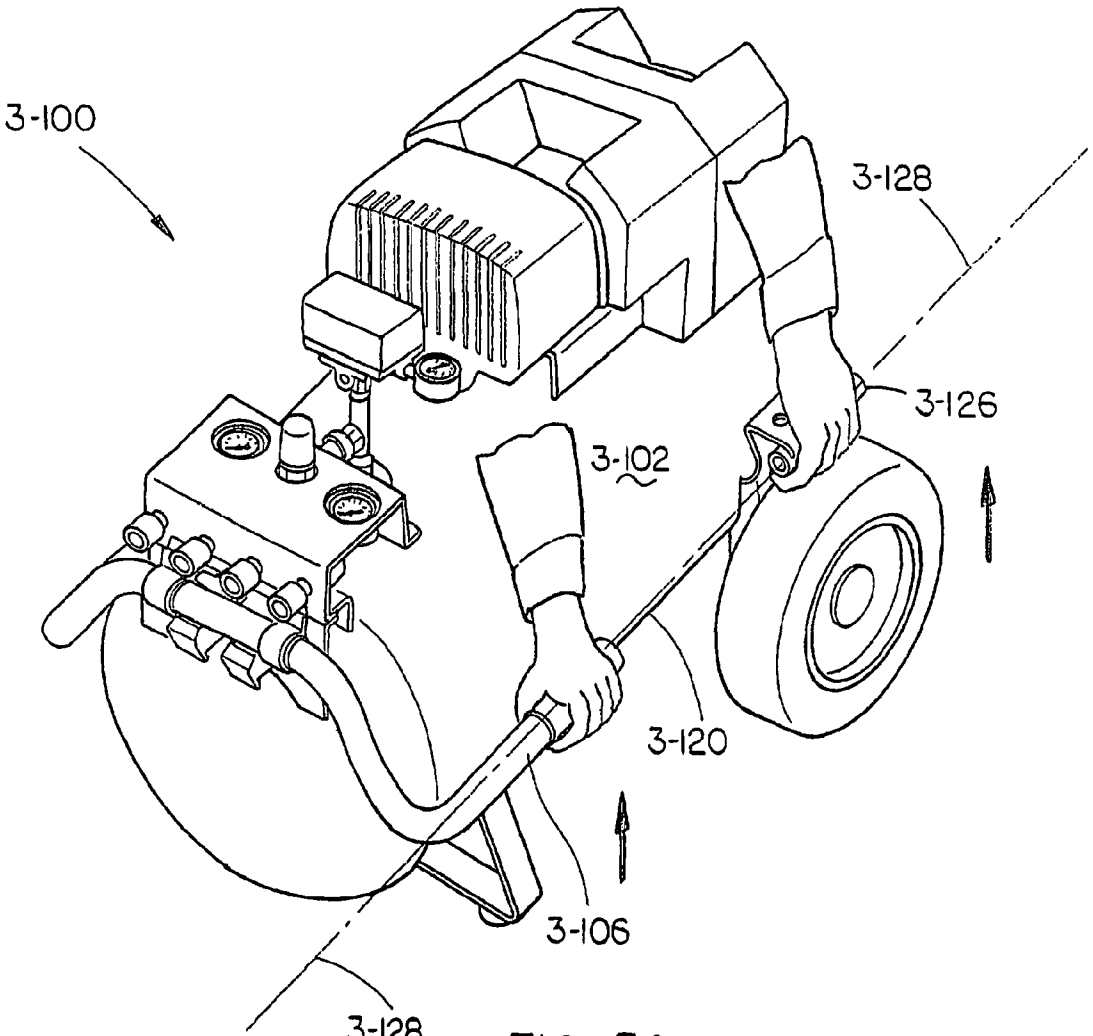
FIG. 32 is an illustration of the exemplary embodiment of FIG. 28 wherein the placement and orientation of exemplary handle assemblies is shown.

By providing a second handle assembly 3-126, an air compressor assembly 3-100 may be supported and lifted in an improved manner. For example, as shown in FIG. 32, a user may be positioned along the side 3-120 of the air tank 3-102 to grasp both the first handle 3-106 oriented in a second position 3-116, as described in FIG. 29, and a second handle assembly 3-126. In this way, the air compressor assembly 3-100 is supported from both the front and rearward portions, enabling the assembly 3-100 to be lifted in an improved manner. It may also be preferable to align the first 3-106 and second 3-126 handles along a same general line 3-128 of the air tank 3-102 to further enable balanced lifting. For instance, by locating the handles 3-106 and 3-126 at the same general height along the air tank 3-102, a user may lift the air compressor assembly 3-100 in a natural manner, without skewing or other uneven lifting motions that may be required if the handles 3-106 and 3-126 were not generally even. Thus, the potential for injury to the user and damage to the air compressor assembly 3-100 may be greatly diminished.

Figure 33A:
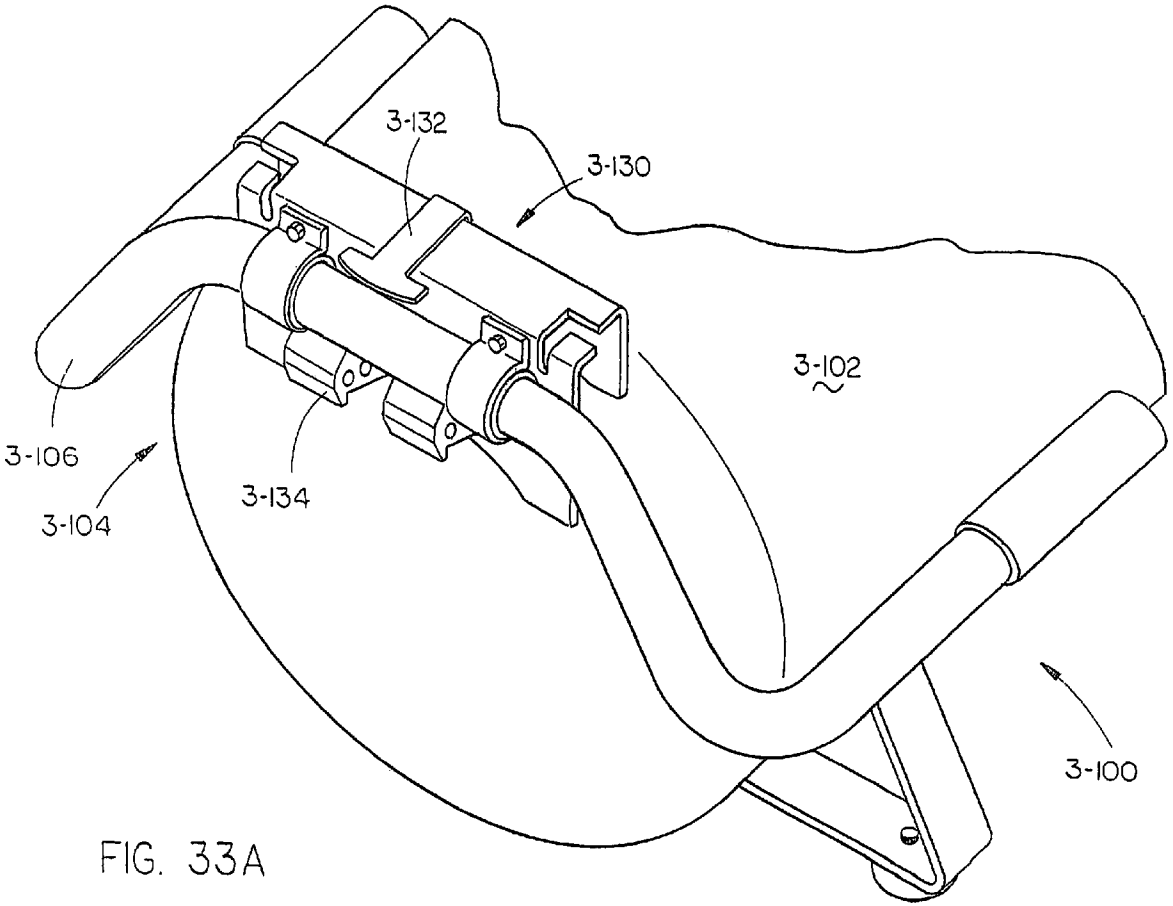
FIGS. 33A and 33B are isometric drawings of the exemplary embodiment of the present invention as shown in FIG. 28 further depicting a securing mechanism.
Figure 33B:
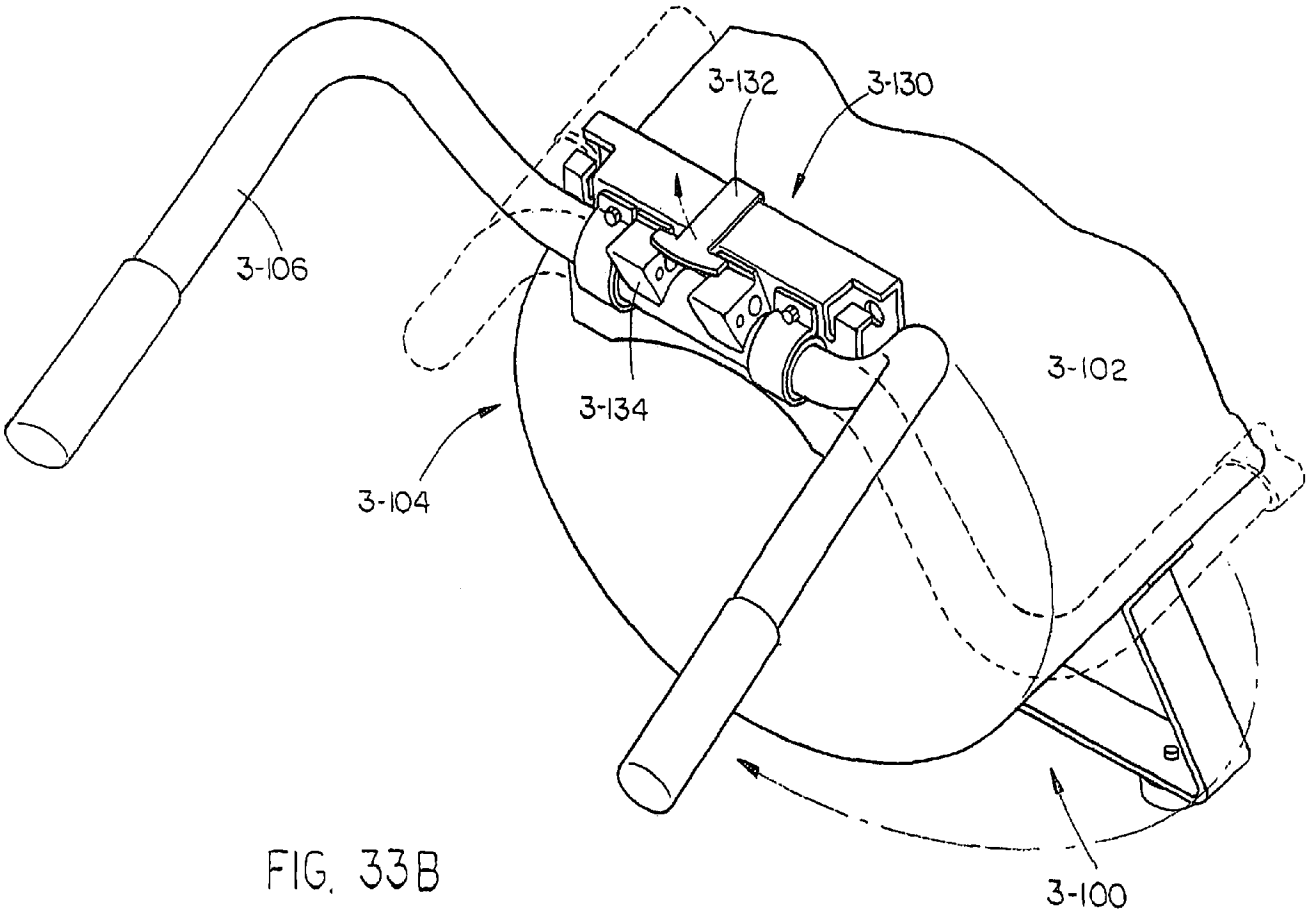

Referring now to FIGS. 33A and 33B, an exemplary embodiment of the present invention is shown wherein a securing mechanism is provided for securing the handle assembly. The air compressor assembly 3-100 may include a securing mechanism 3-130 for fastening the handle assembly 3-104 to limit unwanted movement, thereby increasing user control. For example, the securing mechanism 3-130 may include a latch 3-132 and bracket 3-134 for securing the handle assembly 3-104 in at least one position. The bracket 3-134 may be attached to the handle 3-106 so that when the handle assembly 3-104 is in a desired position the handle 3-106 is secured with respect to the air tank 3-102, an example of which is shown in FIG. 33B. As the handle is rotated, the bracket 3-134 flexes the latch 3-132 upward until the latch 3-132 engages the bracket 3-134, thereby securing the handle 3-106 to the air tank 3-102 in a position for transporting the air compressor assembly 3-100 utilizing the wheel assembly 3-108 (FIG. 28). Thus, the handle may be secured and unsecured by a user in an efficient manner.

Figure 34:
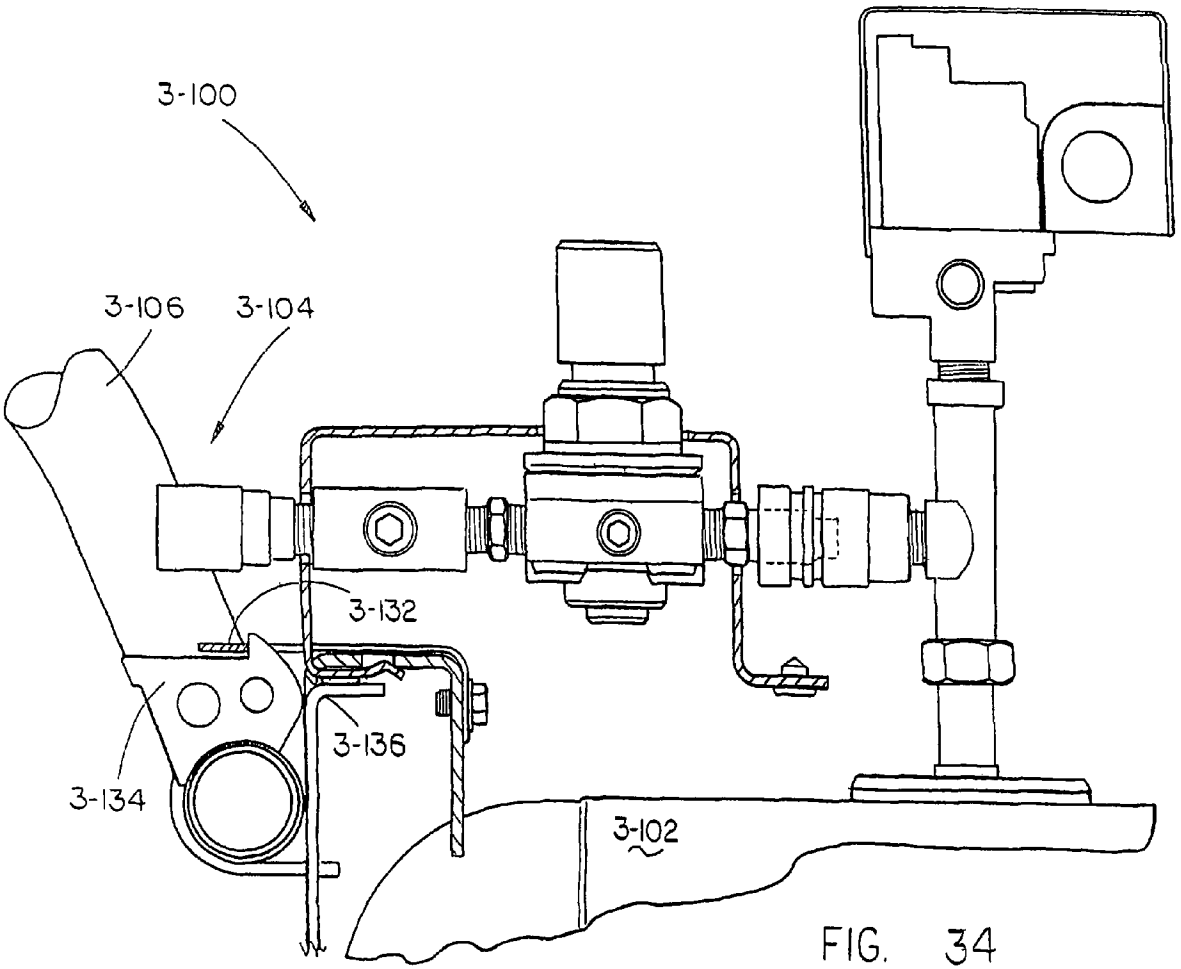
FIG. 34 is a side view of the exemplary embodiment as shown in FIG. 33 wherein a securing mechanism with a handle assembly in a raised position is shown.

As shown in FIG. 34, the bracket 3-134 may also be formed so as to rest against a handle assembly mounting bracket 3-136 so as to limit movement of the handle 3-106 when in the secured position. In this way, the handle assembly 3-104 (FIG. 29) is secured in the first position 3-114 (FIG. 29) so as to limit unwanted movement of the handle when the air compressor assembly 3-100 is positioned to utilize the wheel assembly 3-108 (FIG. 29).

Figure 35:
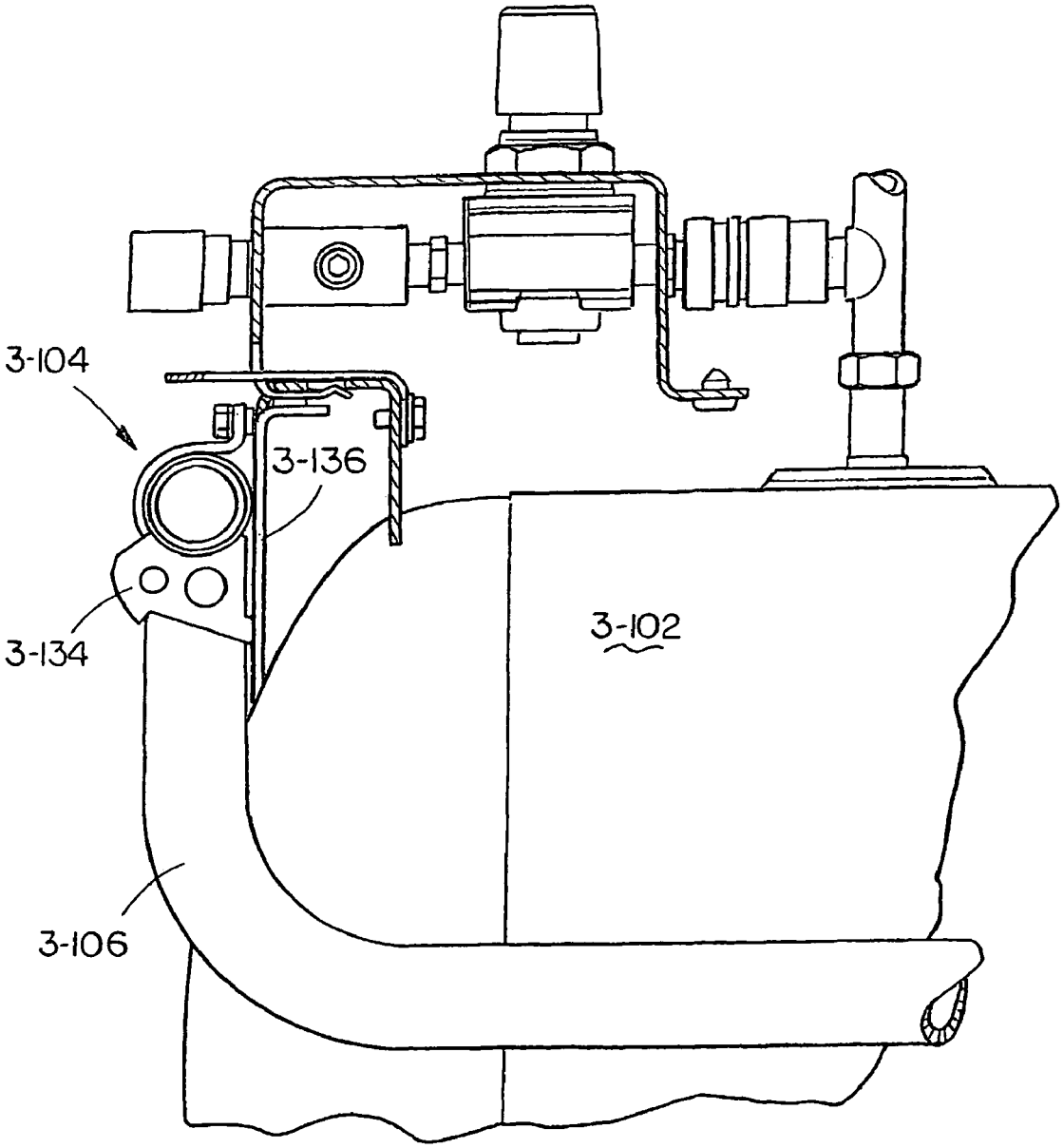
FIG. 35 is a side view of the exemplary embodiment as shown in FIG. 33 wherein a securing mechanism with a handle assembly in a lowered position is shown.

Additionally, the securing mechanism 3-130 may be formed to limit unwanted movement in a second position, an example of which is shown in FIG. 35. The bracket 3-134 may be formed to limit movement in a second position 3-116 (FIG. 29). For example, the bracket 3-134 may engage a handle assembly mounting bracket 3-136 to limit the movement of the handle 3-106 when the handle assembly 3-104 is in a second position 3-116. It may be preferable to limit the movement of the handle assembly 3-104 so that the handle 3-106 is aligned 3-128 (FIG. 32) with a second handle assembly 3-126 (FIG. 32). Thus, a user may have increased control thereby enabling improved lifting of an air compressor assembly 3-100. It should be apparent that a handle assembly may be secured utilizing a variety of devices to fasten the handle and may also be secured in a variety of positions without departing from the spirit and scope of the present invention, the previous discussion involving merely exemplary embodiments thereof.

Referring generally now to FIGS. 36 through 41, additional embodiments of the present invention are shown. Handle assemblies may assume a first position and a second position utilizing a variety of techniques without departing from the spirit and scope of the present invention. Additionally, the present invention contemplates a variety of handle shapes and orientations without departing from the spirit and scope of the present invention.

Figure 36:
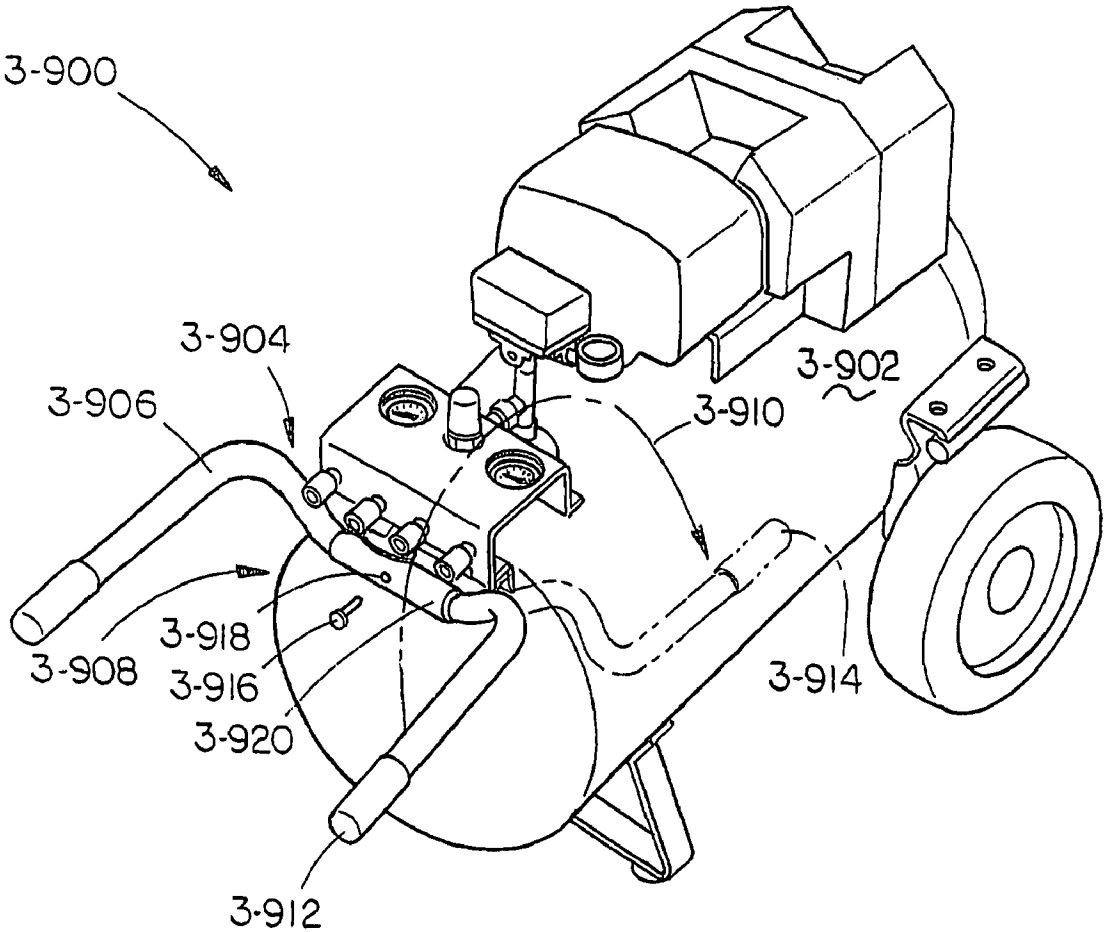
FIG. 36 is an illustration of an additional exemplary embodiment of the present invention wherein a handle assembly rotates above an air tank.

Referring now to FIG. 36, an additional exemplary embodiment of the present invention is shown wherein a handle assembly, including a handle, rotates above an air tank. An air compressor assembly 3-900 includes a handle assembly 3-904 capable of rotating a handle 3-906 above the top edge of the air tank 3-902. A securing mechanism 3-908 is provided for locking the handle 3-906 along a plurality of positions along the arc 3-910 of the handle 3-906 rotation wherein the handle assembly 3-906 moves between a first position 3-912 and a second position 3-914. The securing mechanism 3-908 utilizes a pin assembly in which a pin 3-916 is inserted through a hole 3-918 in a handle assembly mounting bracket 3-920 into a receiving portion of the handle 3-906. Thus, the handle 3-906 may be secured in a plurality of positions as desired by a user.

Figure 37:
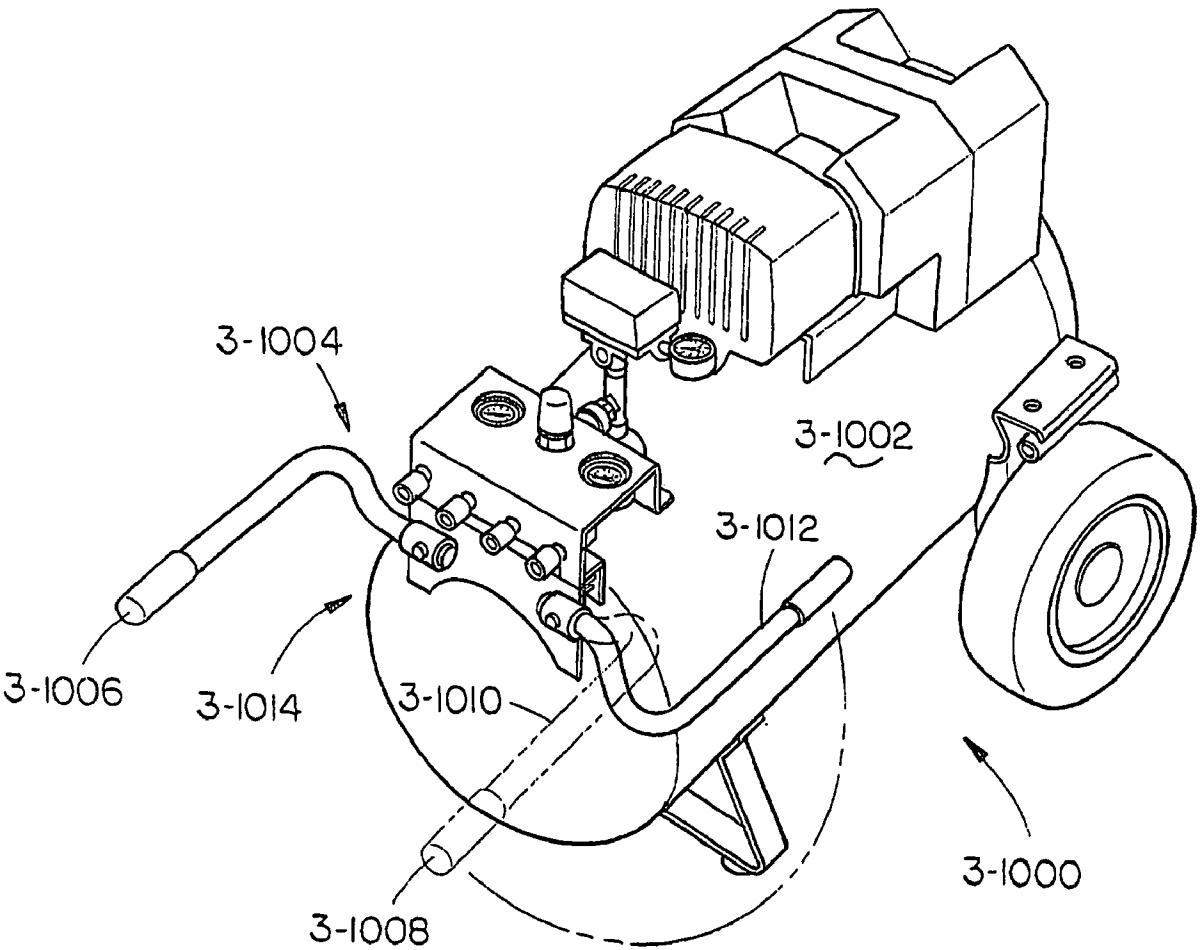
FIG. 37 is an illustration of an additional exemplary embodiment of the present invention wherein an air compressor assembly includes a handle assembly including multiple handles.

Referring now to FIG. 37, an additional exemplary embodiment of the present invention is shown wherein an air compressor assembly includes a handle assembly including multiple handles. An air compressor assembly 3-1000 includes an air tank 3-1002 with a handle assembly 3-1004 disposed thereon, the handle assembly 3-1004 having a first handle 3-1006 and a second handle 3-1008. The first handle 3-1006 and the second handle 3-1008 are each capable of separate movement from a first position 3-1010 to a second position 3-1012. A securing mechanism 3-1014 is provided to fasten the handles 3-1006 and 3-1008 at a plurality of positions to which the handles 3-1006 and 3-1008 are moved. Thus, the handle assembly 3-1004 and particularly the handles 3-1006 and 3-1008 are capable of being placed in a variety of separate and different positions from each other as desired by a user, thereby increasing the flexibility of the air compressor assembly 3-1000.

Figure 38:
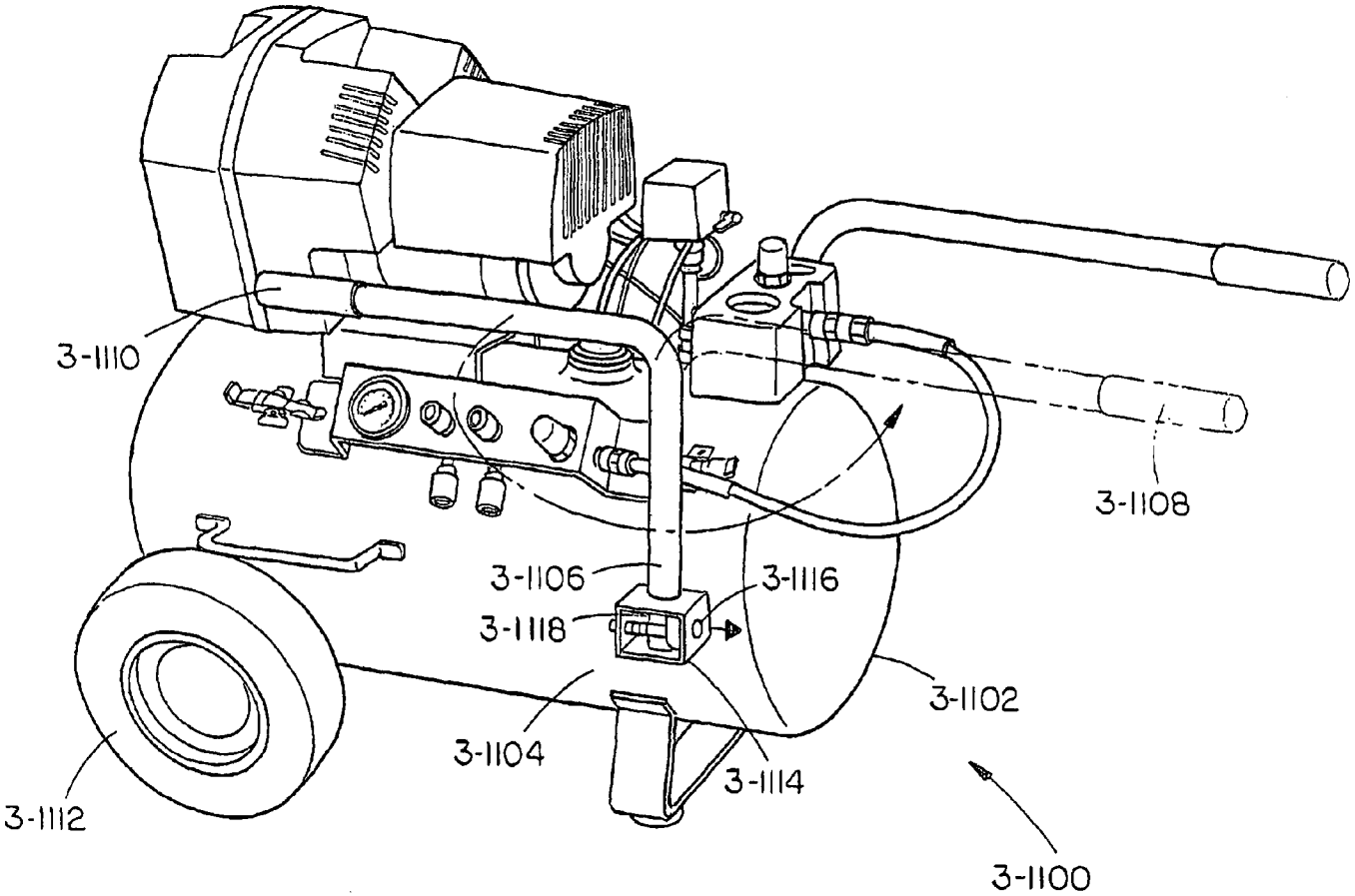
FIG. 38 an illustration of an additional exemplary embodiment of the present invention wherein an air compressor assembly includes a handle assembly capable of pivotal movement.

Referring now to FIG. 38, an additional exemplary embodiment of the present invention is shown wherein an air compressor assembly includes a handle assembly capable of pivotal movement. An air compressor assembly 3-1100 may include an air tank 3-1102 with a handle assembly 3-1104 disposed thereon. A handle 3-1106 of the handle assembly 3-1104 is capable of pivoting between a first position 3-1108 and a second position 3-1110. The first position 3-1108 is suitable transporting the air compressor assembly utilizing the wheel assembly 3-1112 and the second position 3-1110 is suitable for providing a lifting surface wherein a user may grasp the handle 3-1106 of the handle assembly 3-1104. A securing mechanism 3-1114 may also be provided for securing the handle 3-1106 in a desired position. The securing mechanism 3-1114 may include a pin 3-1116 to engage a knuckle portion 3-1118 of the handle 3-1106 thereby securing the handle 3-1106 in position.

Figure 39:
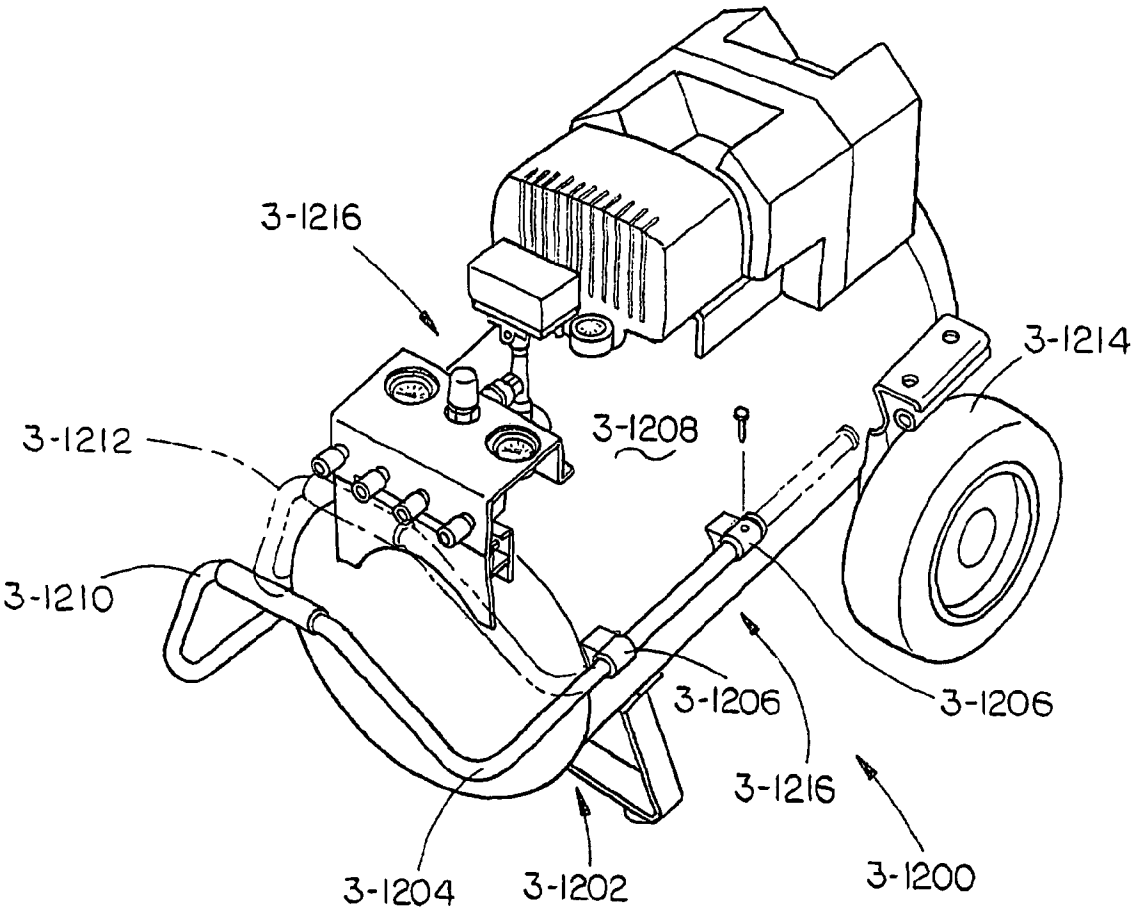
FIG. 39 is an illustration of an additional exemplary embodiment of the present invention wherein an air compressor assembly includes a handle assembly capable of telescopic movement.

Referring now to FIG. 39, an additional exemplary embodiment is shown wherein an air compressor assembly includes a handle assembly capable of telescopic movement. An air compressor assembly 3-1200 may include a handle assembly 3-1202 including a handle 3-1204 mounted with the use of brackets 3-1206 disposed on an air tank 3-1208. The brackets 3-1206 enable the handle 3-1204 to telescope between a first position 3-1210 and a second position 3-1212. The first position 3-1210 is suitable for rolling the air compressor assembly 3-1200 utilizing the wheel assembly 3-1214. It may be preferable to form the brackets 3-1206 so that the handle 3-1204 is at a sufficient distance from the air tank 3-1208 to enable the handle 3-1204 to be gripped by a user at the sides 3-1216 of the air tank 3-1208. Thus, the handle assembly 3-1202 may provide a greater gripping area when placed in the second position 3-1212 yet enable the air compressor assembly to be rolled when placed in the first position 3-1210.

Figure 40:
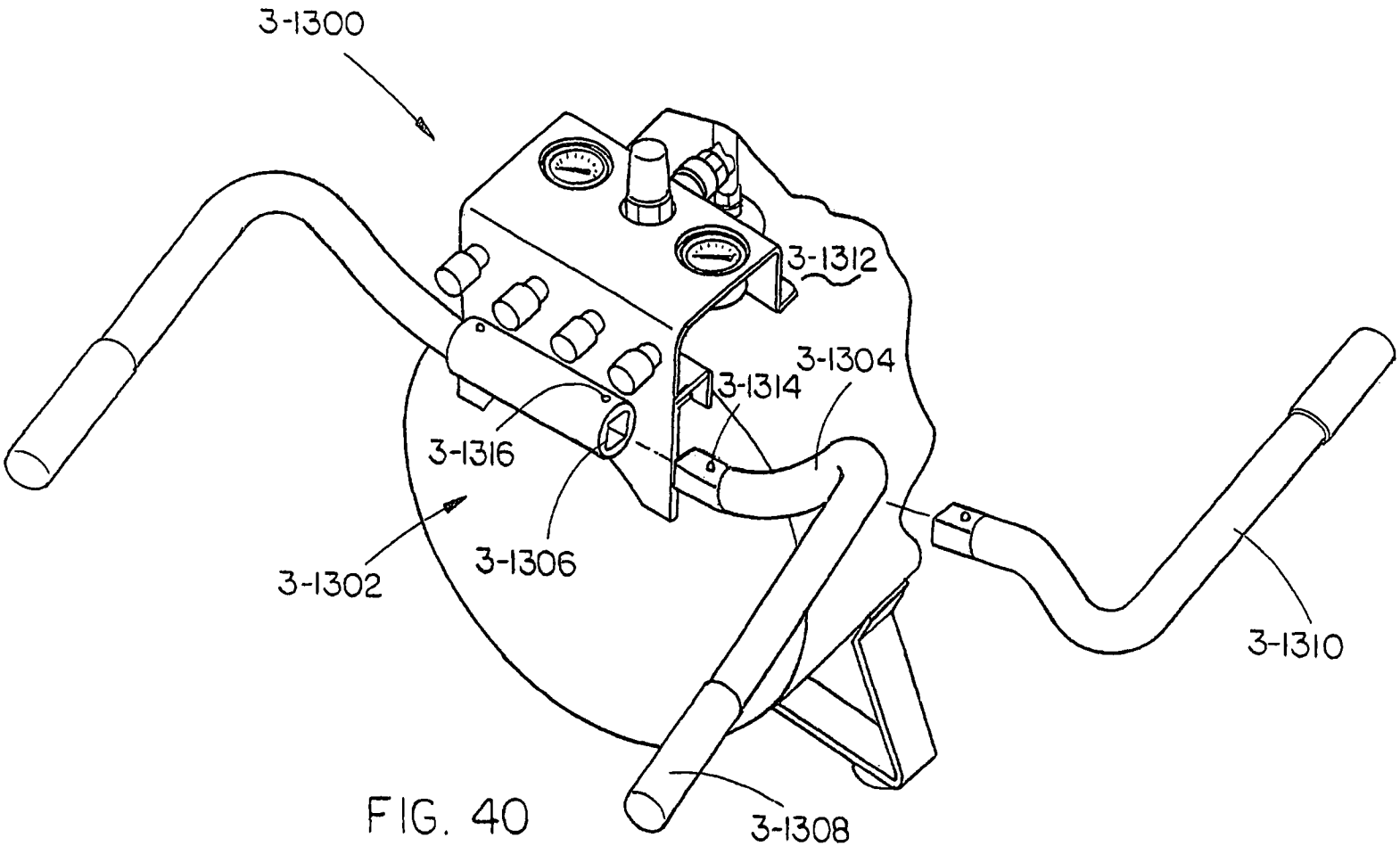
FIG. 40 is an illustration of an additional exemplary embodiment of the present invention wherein an air compressor assembly includes a handle assembly with a handle capable of being removed and placed in a plurality of positions.

Referring now to FIG. 40, an additional exemplary embodiment of the present invention is shown wherein an air compressor assembly includes a handle assembly with a handle capable of being removed and placed in a plurality of positions. An air compressor assembly 3-1300 includes a handle assembly 3-1302. The handle assembly 3-1302 may include a handle 3-1304 capable of assuming multiple positions by withdrawing the handle 3-1304 from a receptacle 3-1306 formed as a part of the handle assembly 3-1302. By utilizing this arrangement, the handle 3-1304 may be removed, repositioned and inserted into the receptacle 3-1306 to provide a plurality of positions. For instance, a user may wish to transport the air compressor assembly 3-1300 by utilizing a wheel assembly 3-108 (FIG. 29). To accomplish this, the user may place the handle 3-1304 in a first position 3-1308 so that the user may grasp the handle 3-1304 to tilt a base 3-110 (FIG. 29) and thereby enable the air compressor assembly 3-1300 to be rolled. In another instance, the user may wish to lift the air compressor assembly 3-1300 to a higher surface. Thus, the user may reposition the handle 3-1304 in a second position 3-1310 so that it is disposed adjacent to a side of an air tank 3-1312. It should be apparent that the handle 3-1304 and handle assembly 3-1302 may be placed in a variety of positions and orientations without departing from the spirit and scope of the present invention.

It may also be preferable to provide a securing mechanism to fasten the handle 3-1304 to the receptacle 3-1306. For example, the securing mechanism may include a retractable pin assembly 3-1314 formed on the handle 3-1304 and an receiving portion 3-1316 formed on the receptacle 3-1306 to receive the pin assembly 3-1314 and thereby secure the handle 3-1304 in the receptacle 3-1306. Further, the handle 3-1304 and the receptacle 3-1306 may be formed so as to limit unwanted movement of the handle assembly 3-1302. It is contemplated that a person of ordinary skill in the art may change the form of the securing mechanism, including the orientation and shape of the handle and receptacle, in a variety of ways without departing from the present invention.

Figure 41:
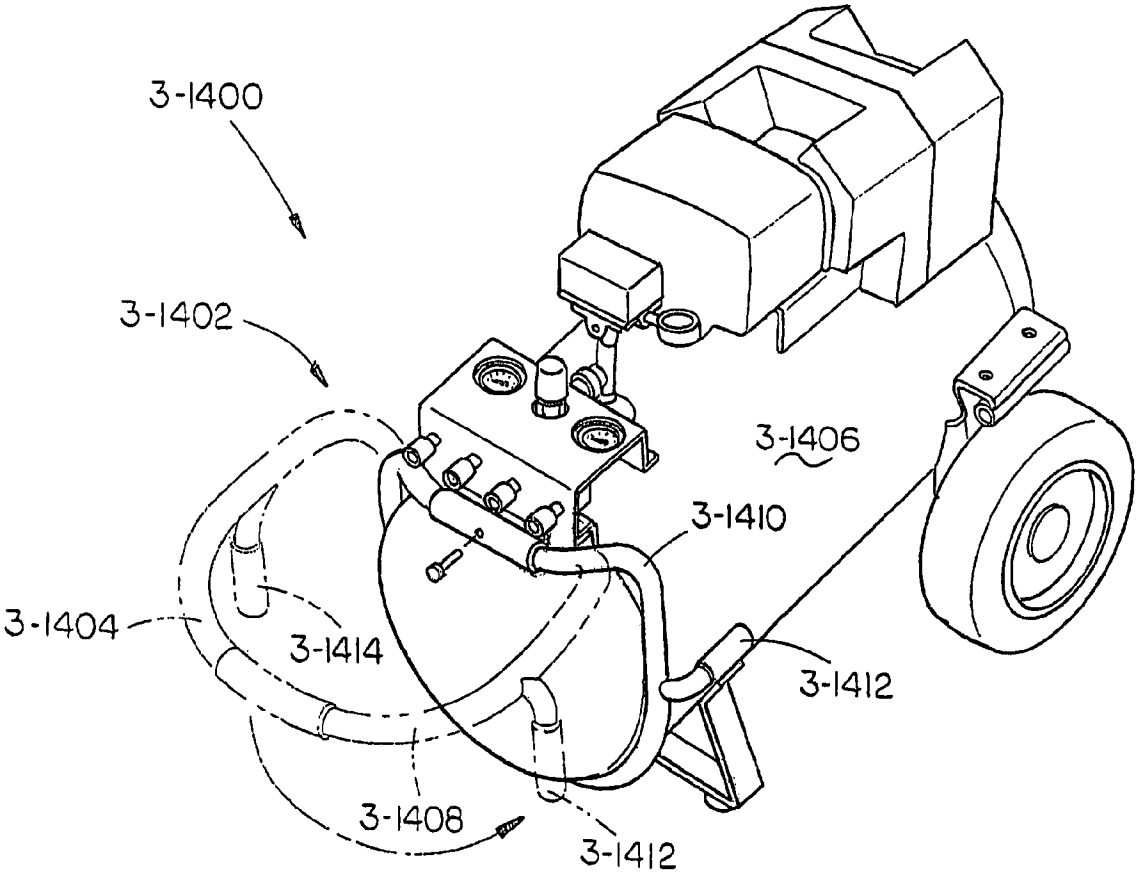
FIG. 41 is an illustration of an additional exemplary embodiment of the present invention wherein a handle assembly is formed so as to provide protection to an air compressor assembly.

Referring now to FIG. 41, an additional exemplary embodiment of the present invention is shown wherein a handle assembly is formed so as to provide protection to an air compressor assembly. An air compressor assembly 3-1400 includes a handle assembly 3-1402 with a handle 3-1404 formed to be capable of at least partially surrounding an air tank 3-1406. The handle 3-1404 of the handle assembly 3-1402 is capable of assuming a first position 3-1408 for transporting the air compressor assembly 3-1400 and a second position 3-1410 for lifting and protecting the air compressor assembly 3-1400. The second position 3-1410 orients the handle assembly 3-1402 so as to protect the air tank 3-1406 from bumps from foreign objects, jarring during transport, and the like. A first grasping portion 3-1412 and a second grasping portion 3-1414 may be provided for lifting the air compressor assembly 3-1400 when the handle assembly 3-1404 is in the second position 3-1410.

Referring generally now to FIGS. 42 through 48, exemplary embodiments of a fourth aspect of the present invention directed to a novel apparatus for protecting the condensate removal device from damage caused by contact with foreign objects are shown.

Figures 42A, 42B, 42C:
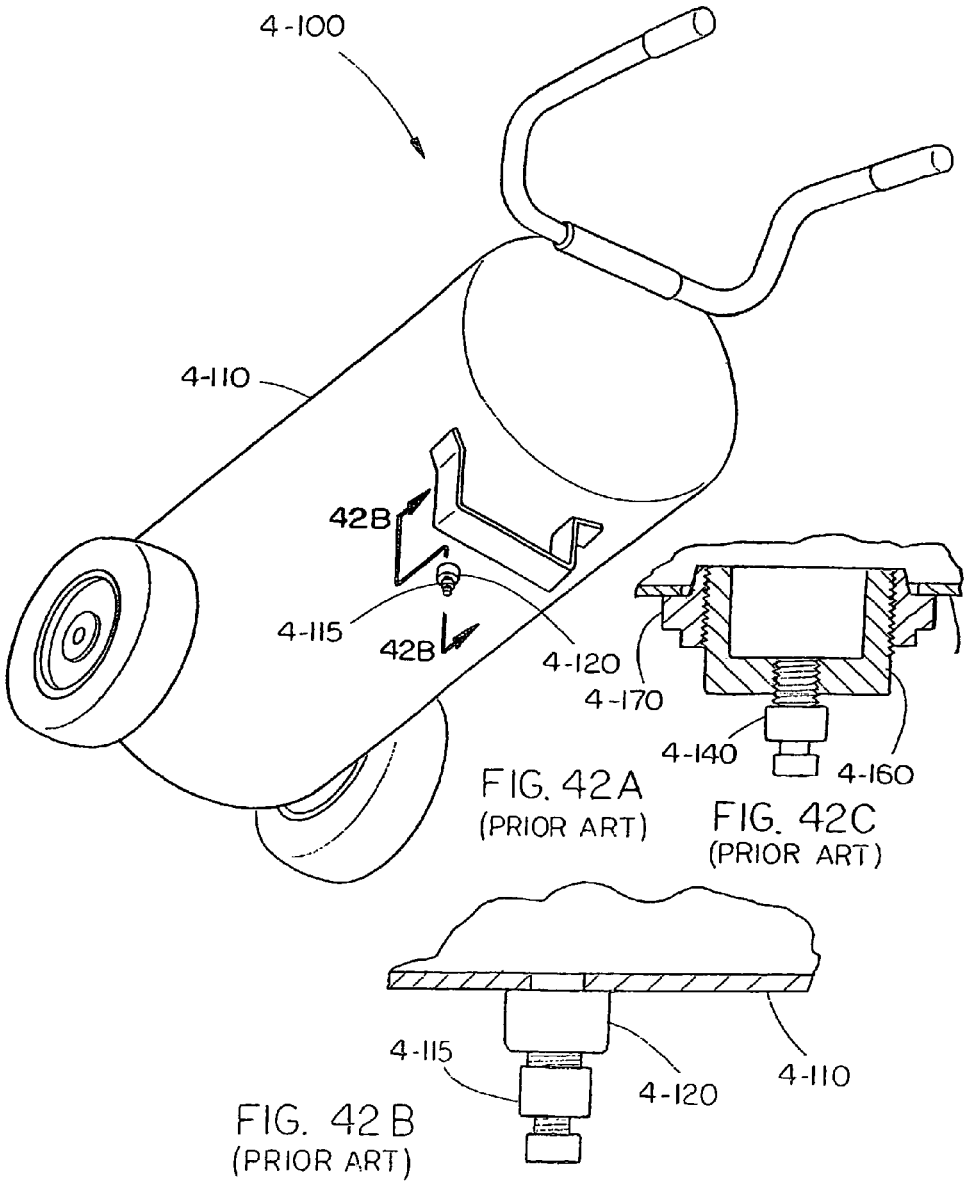
FIG. 42A (PRIOR ART)
FIG. 42C (PRIOR ART)
FIG. 42B (PRIOR ART)
FIG. 42A depicts a compressed air tank known to the art.
FIG. 42B is a side view of a compressed air tank known to the art as shown in FIG. 42A.
FIG. 42C is a detailed view of a mounting assembly known to the art.

Referring to FIGS. 42A and 42B, an exemplary compressed air tank 4-100 known to the art is shown. Compressed air tanks 4-100 typically comprise an air tank 4-110 and a tank drain valve 4-115. A tank drain valve 4-115 may be connected to an air tank 4-110 via a mounting assembly 4-120. The mounting assembly may include a weld flange 4-170 (FIG. 42C) and a plug 4-160 (FIG. 42C) that is capable of being threaded within the weld flange 4-170 (FIG. 42C). The tank drain valve 4-115 may be threaded to allow the valve 4-115 mounted within the mounting assembly 4-120.

Referring specifically to FIG. 42C, a detailed view of a mounting assembly for a valve is shown. The weld flange 4-170 is welded to the air tank 4-150. A mounting device 4-160 may be threaded and placed within the weld flange 4-170. This type of mounting assembly allows for a greater opening in the tank 4-150 as required per ASME standards for some types of compressed air tanks 4-100. By removing the valve 4-140, an inspection of the inside of air tank 4-150 may be more easily accomplished. Drain valves known to the art project a great distance away from the air tank. This leaves the drain valves exposed to possible damage as a result of contact with foreign objects.

Figure 43A:
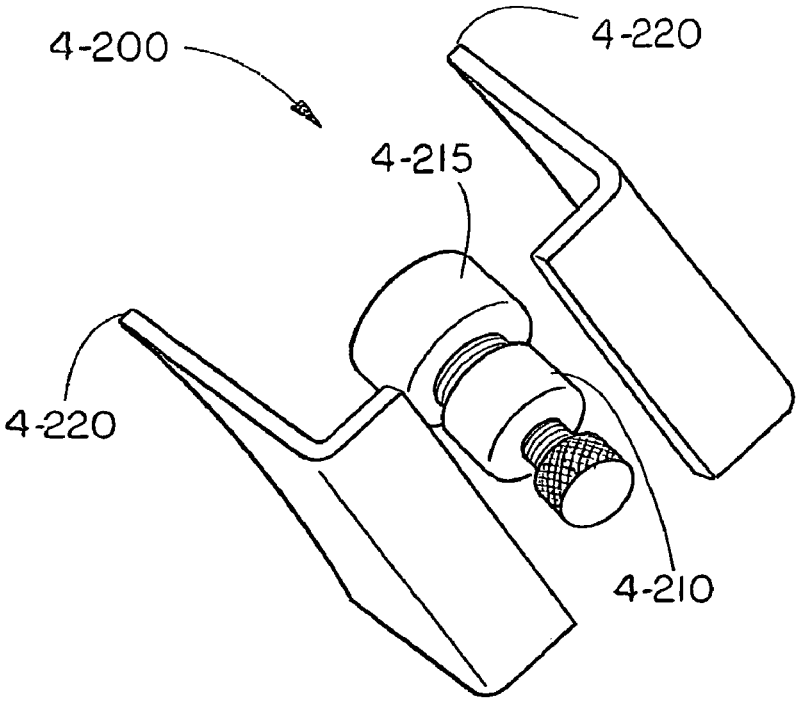
FIG. 43A depicts a view of an exemplary condensate removal protection apparatus of the present invention.
Figure 43B:
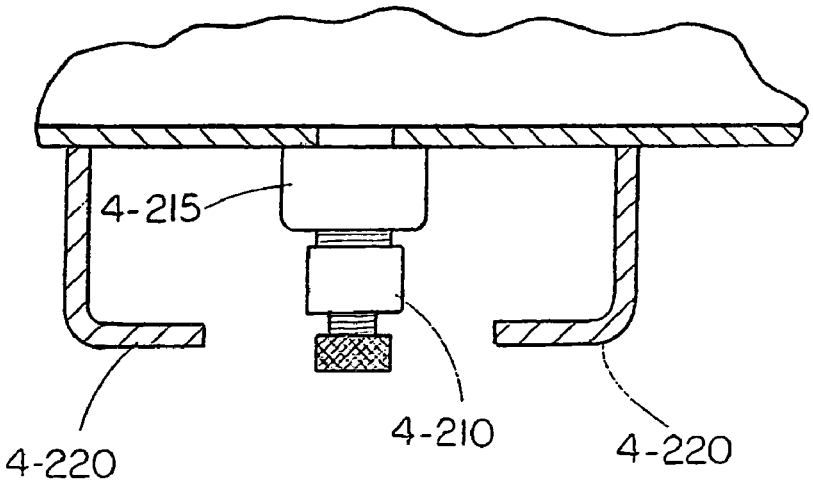
FIG. 43B is a side view of the exemplary condensate removal protection apparatus as shown in FIG. 43A.

Referring to FIGS. 43A and 43B, an exemplary embodiment 4-200 of a condensate removal protection apparatus of the present invention is shown. A condensate removal device may be mounted to an air tank (not shown) at a low point of the air tank in order to remove condensate from the air tank. As shown in FIGS. 43 through 48, the condensate removal device is a valve 4-210. However, the present invention is not limited to valves. Any condensate removal device that allows ease in opening and closing a removable closure and may maintain a constant pressure inside the tank when the removable closure is closed may be utilized without departing from the scope and spirit of the present invention. Further, different types of mounting assemblies may be incorporated with the present invention to a person of ordinary skill in the art and thus various types of mounting assemblies may be incorporated with the present invention without departing from the scope and spirit of the present invention. An example of a condensate removal device is a plug. A plug may be utilized yet is not recommended because it does provide the necessary ease in removing and replacing the plug when draining is necessary. Typically, manufacturers recommend that a compressed air assembly be drained at least once a day to prevent against corrosion on the inside of the air tank. Thus, ease in opening and closing the removal device is paramount. Further, different types of mounting assemblies may be incorporated with the present invention to a person of ordinary skill in the art and thus various types of mounting assemblies may be incorporated with the present invention without departing from the scope and spirit of the present invention.

Referring specifically to FIGS. 43A and 43B, in an exemplary embodiment two I-shaped support pieces 4-220 may be placed on opposite sides of the valve 4-210 to prevent the valve 4-210 from coming into contact with any foreign objects. The valve 4-210 may be connected to a mounting assembly 4-215 that connects the valve 4-210 to an air tank. The exemplary support pieces as shown in FIGS. 43 through 45 may be manufactured from any strong and durable material including metal, plastic, fiberglass, and wood. For ease in manufacturing, a preferred material for the support may be metal as it may be easily welded to an air tank. Foreign objects may include but are not limited to mud, dirt, rocks, tools, equipment, concrete, wood, and hose. Along with providing a shield against contact with foreign objects, the condensate removal protection apparatus 4-200 provides room to allow access by tools or hands in order to open and close the valve 4-210.

Figure 44A:
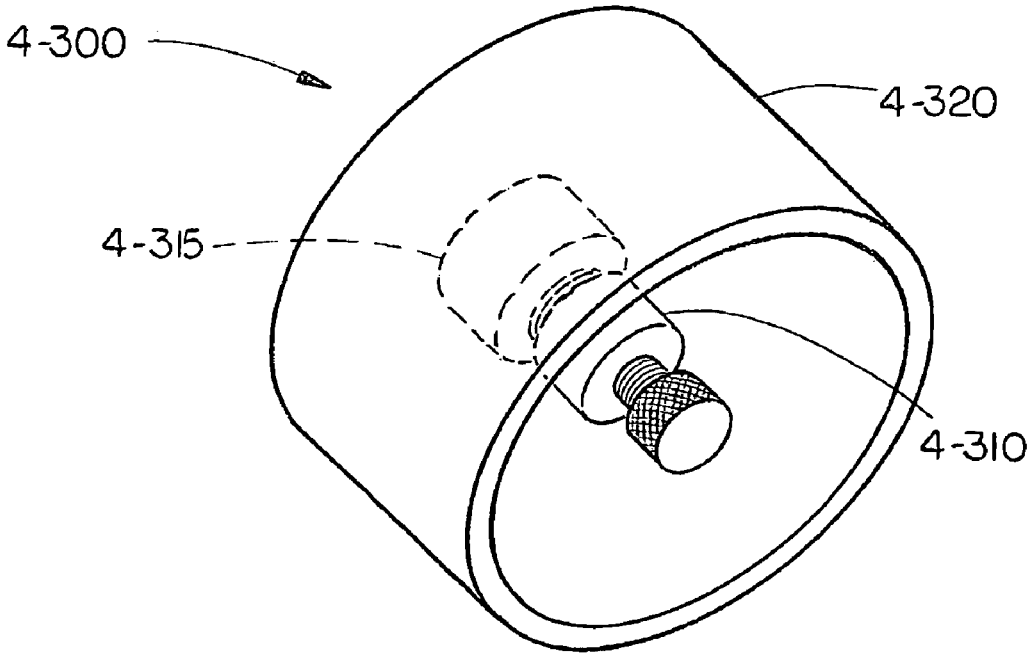
FIG. 44A depicts an alternative exemplary condensate removal protection apparatus of the present invention.
Figure 44B:
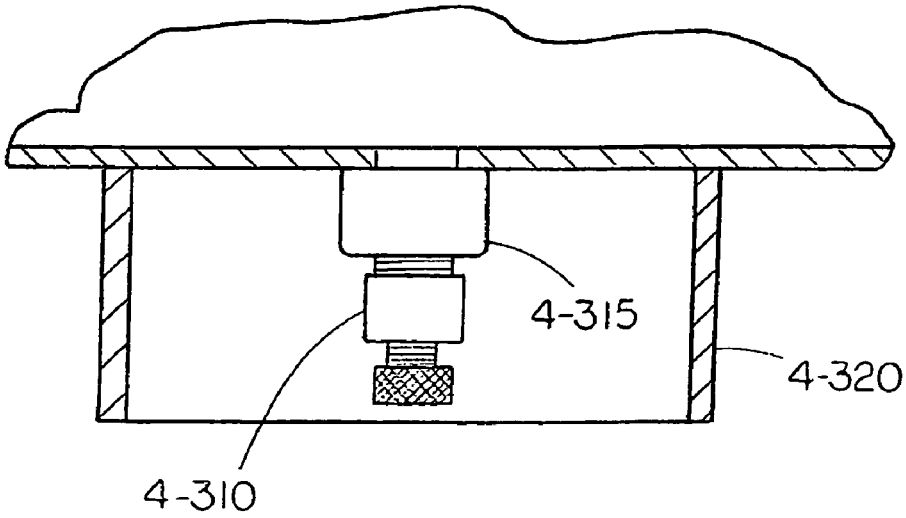
FIG. 44B is a side view of the alternative exemplary condensate removal protection apparatus as shown in FIG. 44A.

Alternate embodiments may be utilized in order to protect a condensate removal device from coming into contact with foreign objects. Referring now to FIGS. 44A and 44B, an alternative exemplary embodiment 4-300 of the condensate removal protection apparatus of the present invention is shown. Surrounding the valve 4-310 and the mounting assembly 4-315, a cylindrical support 4-320 may be mounted to an air tank. This may allow coverage on all sides of the drain valve 4-310 and the mounting assembly 4-315, however, an opening is present to allow access to the valve 4-310 for draining of condensate from an air tank. It should be noted that a shape that is not cylindrical that surrounds the valve including but not limited to square, rectangular, trapezoidal may be recognized and utilized by a person with ordinary skill in the art without departing from the scope and spirit of the present invention.

Figure 45A:
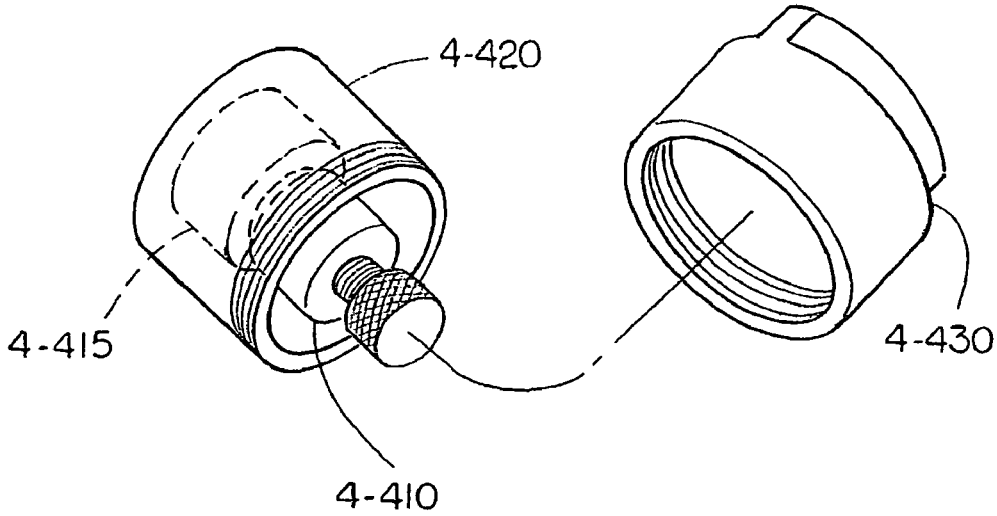
FIG. 45A depicts an exemplary condensate removal protection apparatus with full enclosure of the present invention.
Figure 45B:
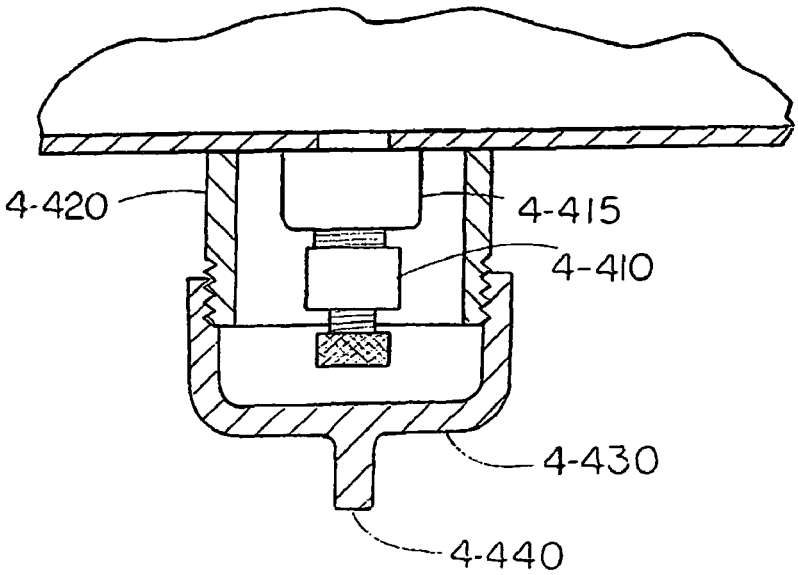
FIG. 45B is a side view of the exemplary condensate removal protection apparatus with full enclosure as shown in FIG. 45A.

Additionally, a cap may be placed on the bottom of the cylindrical support 4-320 to protect the valve from contact from any direction. Referring to FIGS. 45A and 45B, in an exemplary embodiment 4-400 a cylindrical support 4-420 surrounding a valve 4-410 and a mounting assembly 4-415 may be threaded to allow a cap 4-430 to be connected to the cylindrical support 4-420. The advantage of this embodiment is that the valve 4-410 may be completely enclosed within a protective apparatus, however, a cap 4-430 must be removed when draining is to take place. The cap 4-430 may be fitted with an extension 4-440 on the outer end of the cap to allow easier access to opening the cap 4-430. Once again, a shape that is not cylindrical and a cap formed to fit over the shape of the support may be utilized without departing from the scope and spirit of the present invention.

Figure 46A:
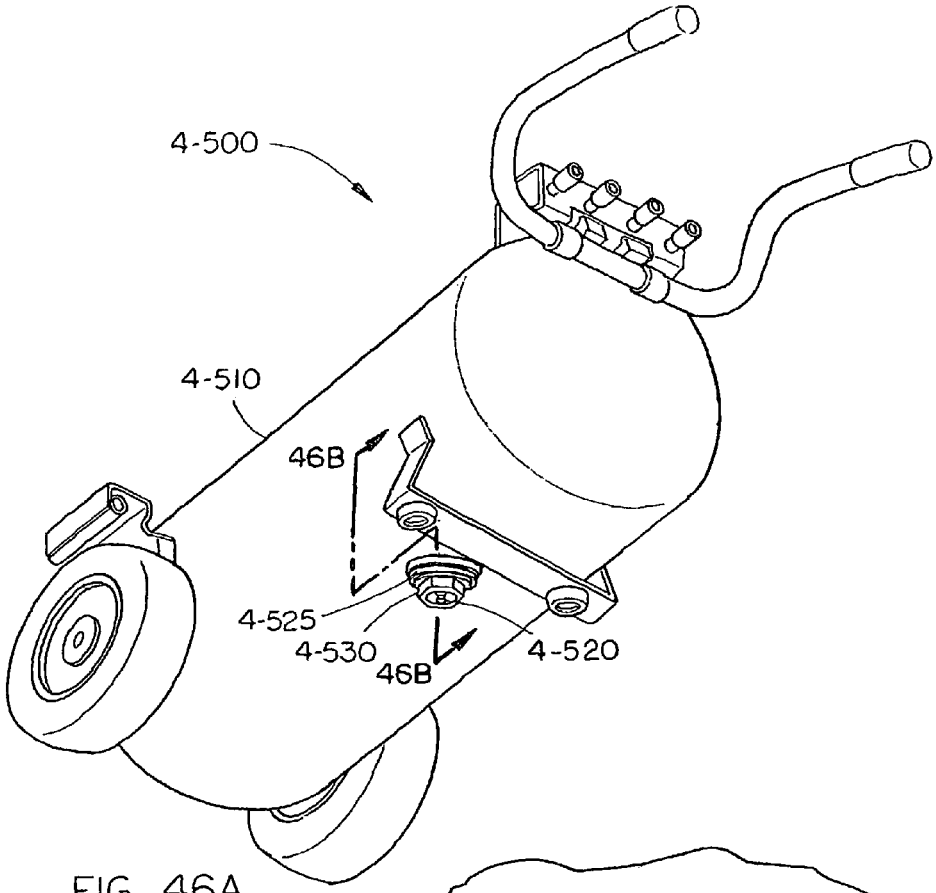
FIG. 46A depicts an exemplary recessed condensate removal device of the present invention.
Figure 46B:
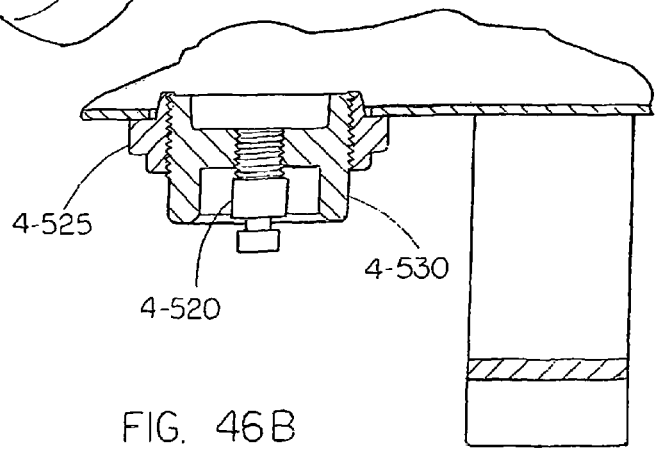
FIG. 46B is a side view of the exemplary recessed condensate removal device as shown in FIG. 46A.

Turning to an alternative way of protecting a valve from contact from foreign objects, in an exemplary embodiment 4-500 of the present invention a valve may be recessed within the mounting assembly as shown in FIGS. 46A and 46B. Referring specifically to FIG. 46A, an air tank 4-510 is shown comprising a valve 4-520 connected to a threaded plug 4-530. The plug 4-530 may be secured to the tank via a weld flange 4-525 that may be welded to an air tank 4-510. In this embodiment, the plug 4-530 may be thought of as a reducer as it covers a larger hole in the air tank 4-510 and reduces the hole to one that may fit the valve 4-520. The plug 4-530 provides a number of advantages. First, it provides a good seal to ensure pressurization within the air tank 4-510. Also, it allows for an easier inspection as dictated per ASME standards for some compressed air tanks. Further, by recessing the valve 4-520 within the plug 4-530, the valve 4-520 may be protected from contact with foreign objects. Yet there is enough space to allow access to the valve 4-520 by a user to open and close the valve 4-520. The plug 4-530 may be threaded to allow easy installation and removal from the tank via a threaded weld flange 4-525. As shown in FIG. 46B, the outer end of the valve 4-520 may protrude outside of the mounting 4-530. It should also be noted that protective supports as shown in FIGS. 43 through 45 may also be incorporated with the recessed valve embodiment to ensure greater protection from contact from foreign objects. Thus, for example, a recessed valve may be utilized in conjunction with two I-shaped supports in proximity of the valve to further protect the valve from contact with foreign objects. Also, it should be recognized that the plug 4-530 as shown in FIGS. 46A and 46B are exemplary only and various modifications may be made to the mounting device to allow recessing of the valve 4-520 within the mounting device 4-530 by one of ordinary skill in the art without departing from the scope and spirit of the present invention.

Figure 47:
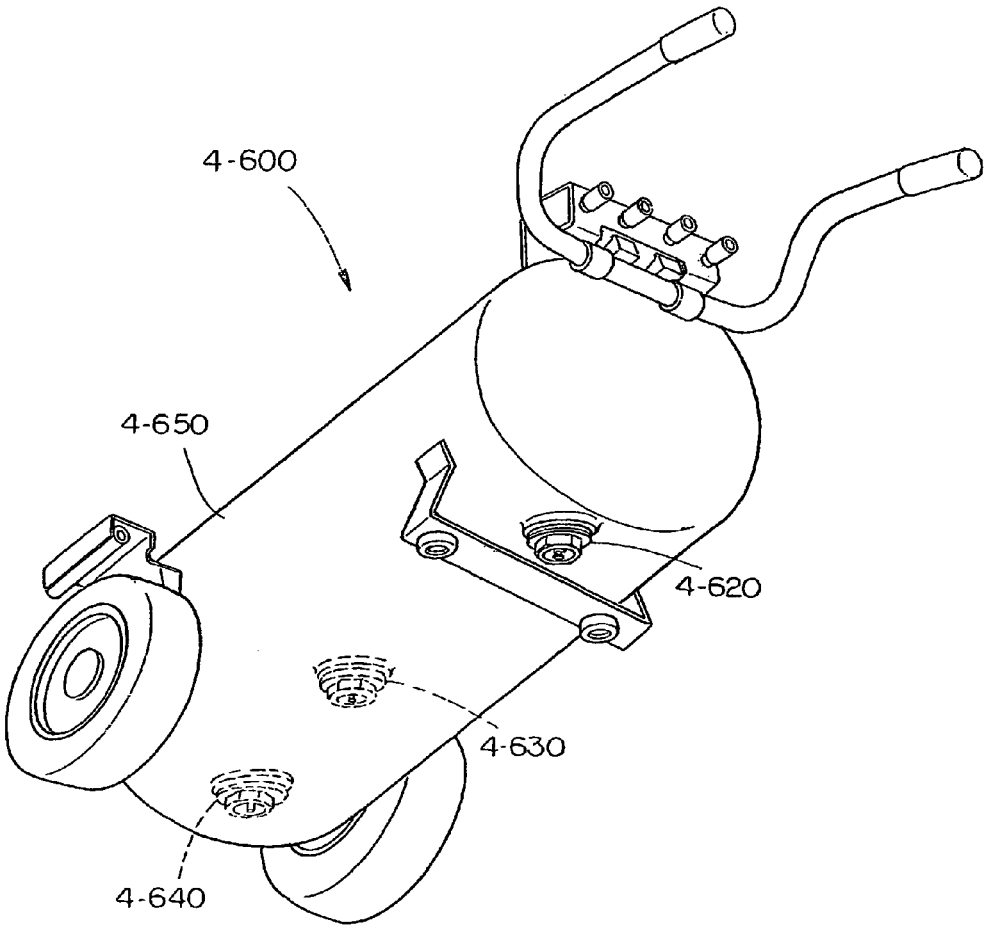
FIG. 47 depicts exemplary positions the condensate removal device may be placed on an air tank.

Referring now to FIG. 47, the placement of the condensate removal device need not be in the center of the air tank. For example, in exemplary embodiments 4-600 the condensate removal device may be placed near the bracket 4-620, in the middle 4-630, and near the wheels 4-640 along with areas in between the front and end of the air tank 4-650. Also, it should be noted that the present invention is not limited to a single style of air tank as the condensate removal protection apparatus may be utilized in all types of air tanks. An exemplary middle location 4-630 may be preferred as inspections made on the air tank may be made easier with a hole located in the center of the air tank on the bottom side and a hole in the center of the air tank on the top side. Typically, a check valve may be placed in the center of the air tank on the top side. With these two locations, a thorough inspection of the inside of air tank is possible to check for wear and corrosion. In all of the locations regarding placement of the condensate removal device, exemplary supports as shown in FIGS. 43 through 45 may be incorporated with the condensate removal device.

Figure 48A:
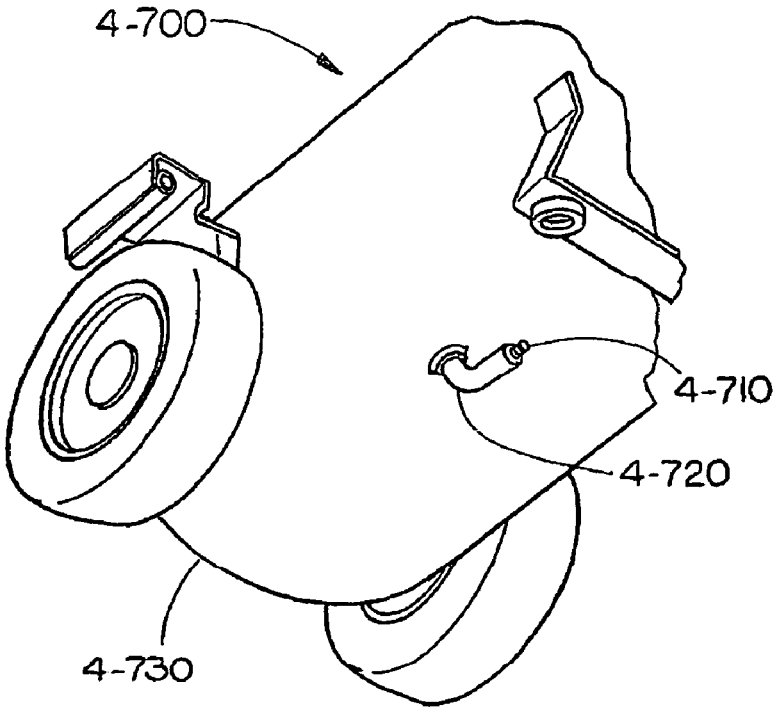
FIG. 48A depicts an additional exemplary embodiment of the condensate removal protection apparatus of the present invention.
Figure 48B:
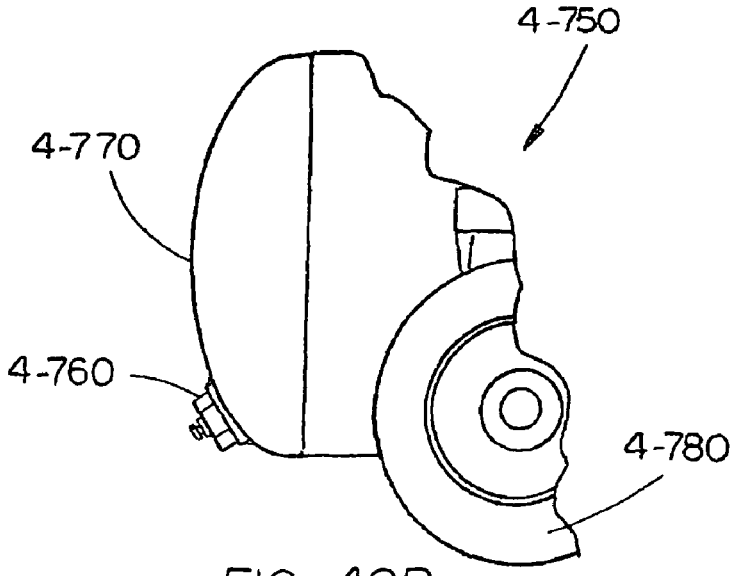
FIG. 48B depicts another additional exemplary embodiment of the condensate removal protection apparatus placed on a side of an air tank.
Figure 49:
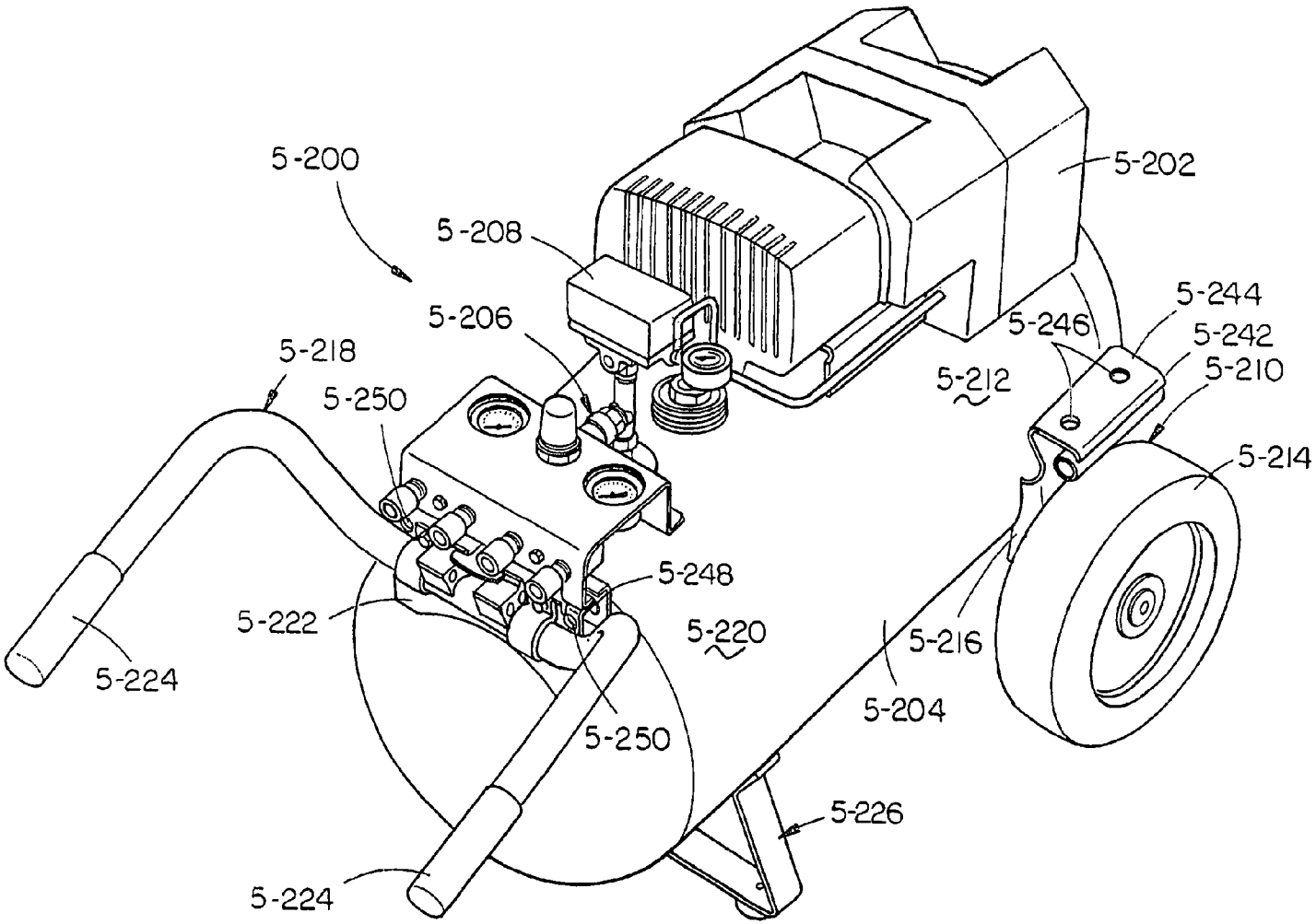
FIG. 49 is an isometric view illustrating a portable air compressor assembly in accordance with an exemplary embodiment of the present invention.

Further, in another exemplary embodiment 4-700, the condensate removal device 4-710 may be attached to a tube 4-720 that is connected to an air tank 4-730 as shown in FIG. 48A. This may reduce the distance that the condensate removal device 4-710 protrudes outwardly from the air tank 4-730. In another exemplary embodiment 4-750, the condensate removal device 4-760 may be placed on a side of an air tank 4-770. As shown in FIG. 48B, the condensate removal device may be placed on a side close to the wheels 4-780. In order to remove condensate from an air tank 4-770, lifting of the front of the air tank 4-770 may be required. Different embodiments may be available to a person with ordinary skill in the art in order to protect a condensate removal device from contact from foreign objects that do not depart from the scope and spirit of the present invention.

Referring generally now to FIGS. 49 through 52, exemplary embodiments of a fifth aspect of the present invention directed to a portable air compressor assembly of the type having a horizontal compressed air storage tank are shown.

Referring generally to FIGS. 49 through 52, a portable air compressor assembly in accordance with an exemplary embodiment of the present invention is described. The portable air compressor assembly 5-200 includes a compressor 5-202 mounted to a horizontal compressed air storage tank 5-204, often referred to in the art as a "hot-dog" style air tank. The compressed air storage tank 5-204 provides a tank or receiver for storing air under pressure. A pressure manifold assembly 5-206 is fitted to the compressed air storage tank 5-204 allowing compressed air to be drawn from the tank 5-204 for powering air powered tools such as nailing tools, socket driving tools, material shaping tools, sanding tools, spray painting tools, tire inflation chucks, and the like. In exemplary embodiments, a pressure switch assembly 5-208 is mounted to the pressure manifold assembly 5-206 for regulating pressure within the compressed air storage tank 5-204 by alternately starting and stopping the compressor 5-202 to periodically replenish the supply of air in the tank 5-204. Typically, when pressure within the tank 5-204 reaches a preset low pressure point, or "kick-in pressure", the pressure switch assembly 5-208 starts the compressor 5-202 to repressurize the tank 5-204. As the pressure within the tank 5-204 reaches a preset high pressure point, or "kick-out pressure", the pressure switch assembly 5-208 stops the compressor 5-202 to prevent over-pressurization of the tank 5-204. In this manner, the pressure of the compressed air in the compressed air storage tank 5-204 is maintained within a range generally suitable for powering one or more air powered tools.

The air compressor assembly 5-200 further includes a wheel assembly 5-210 mounted to a first end portion 5-212 of the compressed air storage tank 5-204. In an exemplary embodiment, the wheel assembly 5-210 includes a wheel 5-214 mounted to each side of the air storage tank 5-204 by a wheel bracket 5-216. A handle assembly 5-218 is mounted to a second end portion 5-220 of the compressed air supply tank 5-204 opposite the wheel assembly 5-210 by a handle bracket 5-222. The handle assembly 5-218 allows the air compressor assembly 5-200 to be transported by lifting upward on handles 5-224 and pushing the air compressor assembly 5-200 much like a common wheelbarrow.

A base 5-226 is mounted to the bottom of the horizontal compressed air storage tank 5-204 adjacent to the second end portion 5-220, e.g., opposite the wheel assembly 5-210. In an exemplary embodiment, the base 5-226 includes a bottom member 5-228 and distal side members 5-230 & 5-232. Preferably, side members 5-230 & 5-232 are joined at the outer ends of bottom member 5-228 and extend upward therefrom. The side members 5-230 & 5-232 are terminated at their upper end by tank attachment members 5-234 & 5-236 which are angled to provide a surface for attachment of the base 5-226 to the bottom surface 5-238 of the horizontal compressed air storage tank 5-204 via a suitable attachment method such as welding, or the like. Feet 5-240, formed of plastic, rubber or like material, are attached to the bottom member 5-228. The feet 5-240 prevent the bottom member 5-228 from directly contacting floor surfaces on which the air compressor assembly 5-200 may rest so that the base 5-226 does not damage (e.g., scratch, gouge, or mar) such surfaces.

In one embodiment of the present invention, the lower portion of base 5-226, e.g., bottom member 5-228, has a width ("w") at least substantially as wide as the outer diameter of the compressed air storage tank 5-204. The base 5-226 thus provides increased resistance to tipping as a result of external forces exerted on the compressed air storage tank 5-204 or compressor 5-202, for example, by a user or vehicle inadvertently bumping into the side of the air compressor, by a user pulling or jerking an air hose coupled to the air compressor's pressure manifold assembly 5-206, or the like. In this manner, the base 5-226 provides increased stability to the air compressor assembly 5-200, especially in austere environments.

Figure 50:
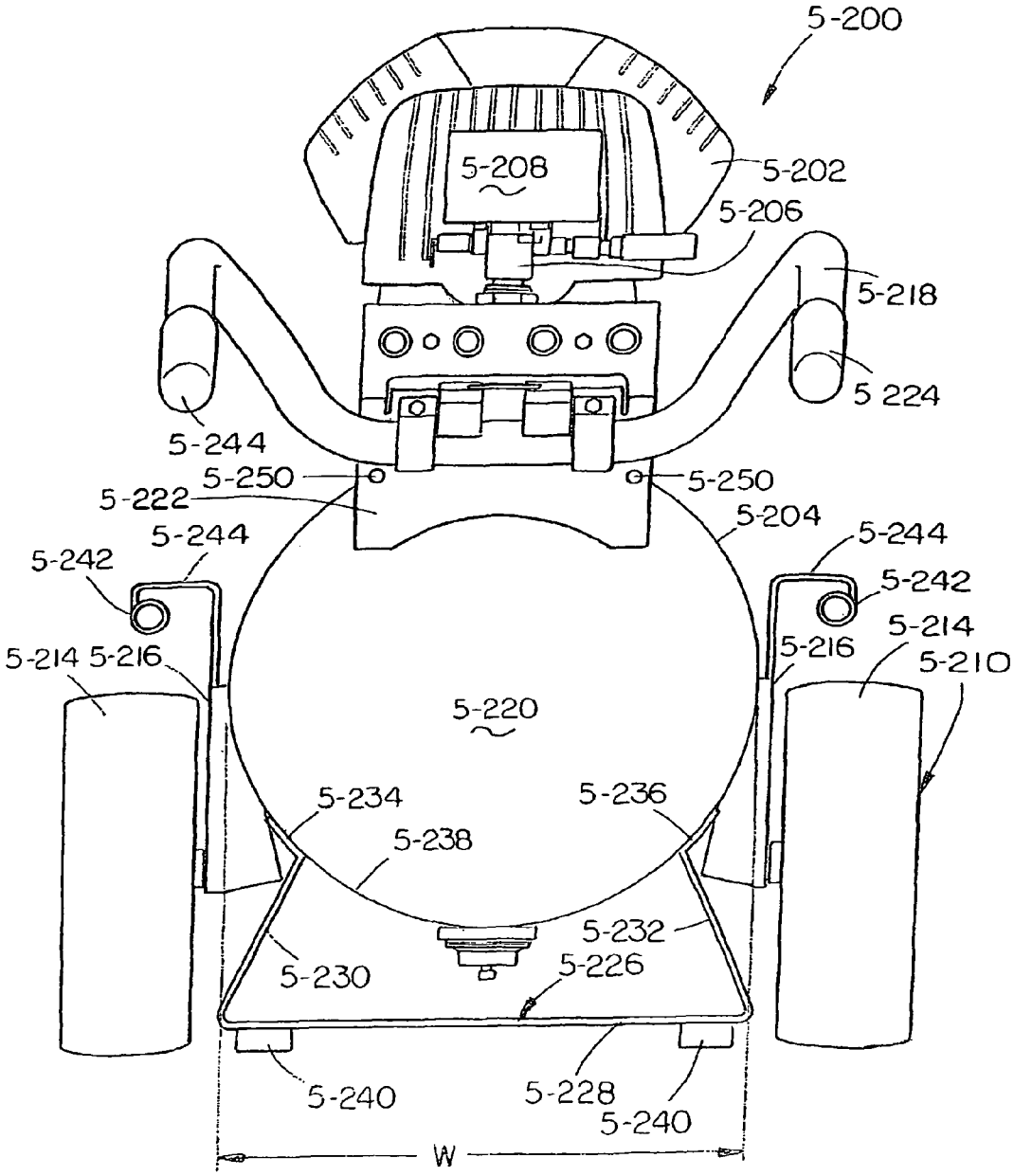
FIG. 50 is an end elevational view of the portable air compressor assembly shown in FIG. 49.

As shown in FIG. 50, side members 5-230 & 5-232 may angle inwardly from the bottom member 5-228 so that attachment members 5-234 & 5-236 join the bottom surface of the compressed air storage tank 5-204. In this manner, the attachment between the base 5-226 and compressed air storage tank 5-204 is made more robust than would be possible if the side members 5-230 & 5-232 were attached to the sides of the tank 5-204 since the welds between the attachment members 5-234 & 5-236 and tank are subjected to lower shear stress. In the exemplary embodiment illustrated and described herein, the base 5-226 is shown as having a straight, single piece bottom member 5-228 and angled side members 5-230 and 5-232. However, it will be appreciated that the shape of base 5-226 is not limited to a specific geometry. For example, the base 5-226 may be provided with additional members extending between the bottom member 5-228 and the bottom surface 5-238 of the compressed air storage tank 5-204, or may be formed from a solid plate.

Figure 51:
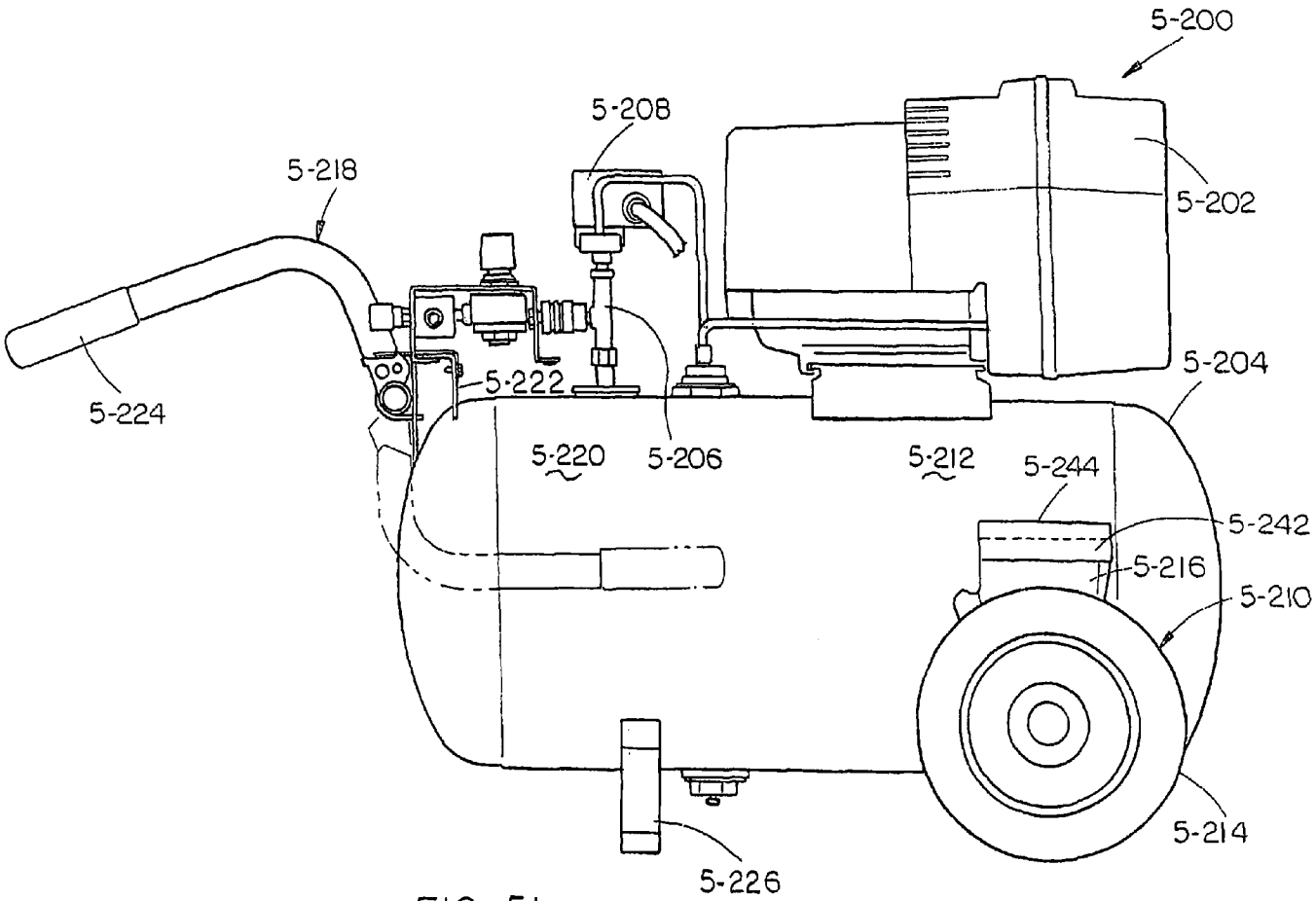
FIG. 51 is a side elevational view of the portable air compressor assembly shown in FIG. 49.
Figure 52:
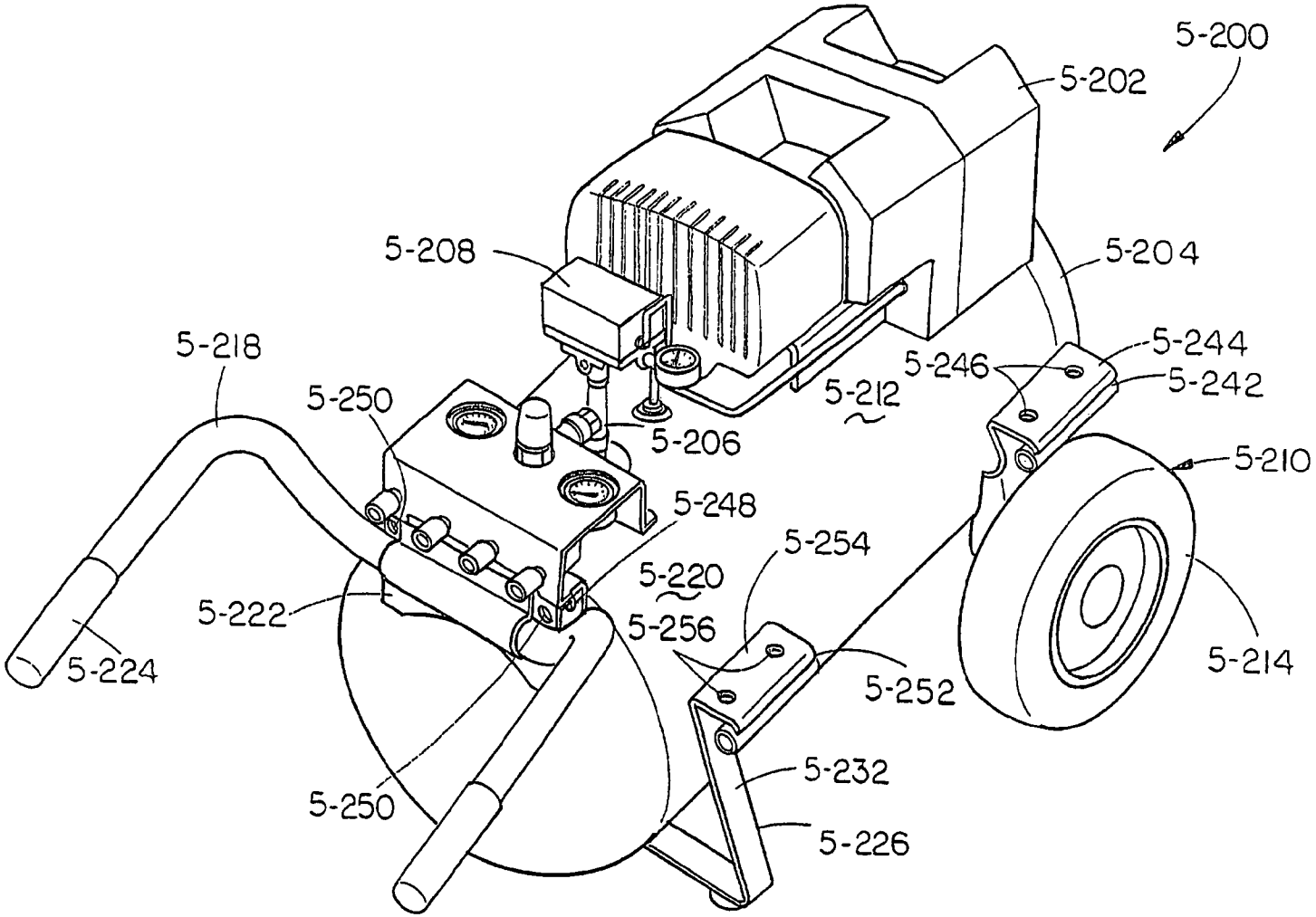
FIG. 52 is an isometric view illustrating a portable air compressor air tank assembly having a combination lift handle and stable support bracket in accordance with an exemplary embodiment of the present invention.

In another embodiment of the present invention shown in FIG. 51, tie-down points may be provided for securing the air compressor assembly 5-200 to a platform such as a floor surface, the bed and/or sidewalls of a truck, a trailer, a lift, or the like. In an exemplary embodiment, each wheel bracket 5-216 may include a handle assembly 5-242 providing a point by which a user may lift the air compressor assembly 5-200. The handle assembly 5-242 includes an upper surface 5-244 having one or more apertures 5-246 (FIG. 52) formed therein. Similarly, the handle assembly mounting bracket 5-222 may include one or more additional apertures 5-248 & 5-250 (FIG. 52). Preferably, these apertures 5-246, 5-248 & 5-250 are sized to allow attachment of a rope, cable, cord, or the like thereby providing tide down points for securing the portable air compressor assembly 5-200 to the platform.

In a further embodiment shown in FIG. 52, the side members 5-230 & 5-232 of base 5-226 may be extended upward along the sides of the air storage tank 5-204 to support a second set of handle assemblies 5-252 which may be used in cooperation with handle assemblies 5-242 to lift the air compressor assembly 5-200. Like the handle assemblies 5-242 provided by wheel brackets 5-216, handle assemblies 5-252 include an upper surface 5-254 having one or more apertures 5-256 formed therein providing additional tie-down points for the portable air compressor 5-200.

In view of the discussion of FIG. 1 and FIGS. 49 through 52, it will now be apparent to those of skill in the art that tie-down points may be provided elsewhere on the air compressor. For example, additional tie-down points may be furnished in brackets provided for mounting such components as the compressor 5-202, pressure manifold assembly 5-206, and pressure switch assembly 5-208. Accordingly, provision of such tie-down points by one of ordinary skill in the art would not depart from the scope and spirit of the present invention as defined in the appended claims.

Referring generally to FIGS. 53 through 59, an air compressor assembly 6-100 having a removable manifold assembly 6-104 and an extensible handle bar assembly 6-114 in accordance with an exemplary embodiment of the present invention is shown. The air compressor assembly 6-100 may have an air storage tank 6-106 suitable for storing compressed air, an air compressor 6-108 suitable for supplying compressed air to the air storage tank 6-106, and the manifold assembly 6-104 suitable for controlling and distributing compressed air from the air compressor assembly 6-100 to one or more air powered tools. The air compressor assembly 6-100 may be equipped with a roll cage 6-102, which may substantially enclose the air storage tank 6-106 and the air compressor 6-108 to protect these components from damage due to contact with foreign objects. A cover member 6-130 may also be placed on the top of the roll cage 6-102 to protect the air compressor 6-108 from contact with foreign objects. The air compressor assembly 6-100 may have a wheel assembly 6-110 mounted to the roll cage 6-102 so that the air compressor assembly 6-100 may be transported on wheels. A lifting handle assembly 6-160 may be mounted to the roll cage 6-102 for lifting the air compressor assembly 6-100. A cord drop assembly 6-112 may be mounted to the roll cage 6-102. Cushion members 6-116 may be mounted to the roll cage 6-102 to support, along with the wheel assembly 6-110, the weight of the air compressor assembly 6-100 when the air compressor assembly 6-100 rests, for example, on the ground (see FIG. 54). A support member 6-120 may be mounted to the roll cage 6-102 and placed beneath the air storage tank 6-106 to help support the weight of the air storage tank 6-106.

Figure 53:
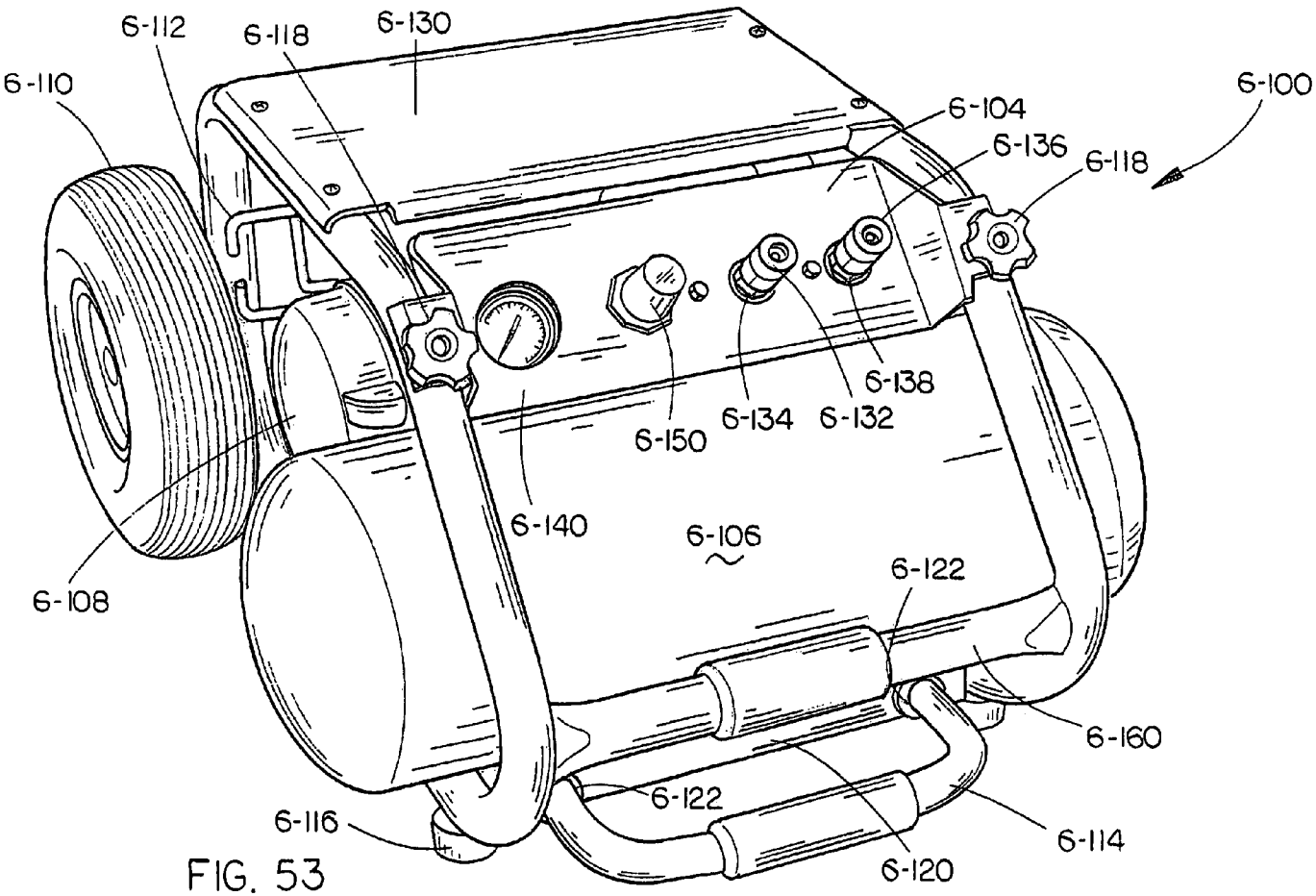
FIG. 53 is an isometric view illustrating an air compressor assembly having a removable manifold assembly and an extensible handle bar assembly in accordance with an exemplary embodiment of the present invention.
Figure 54:
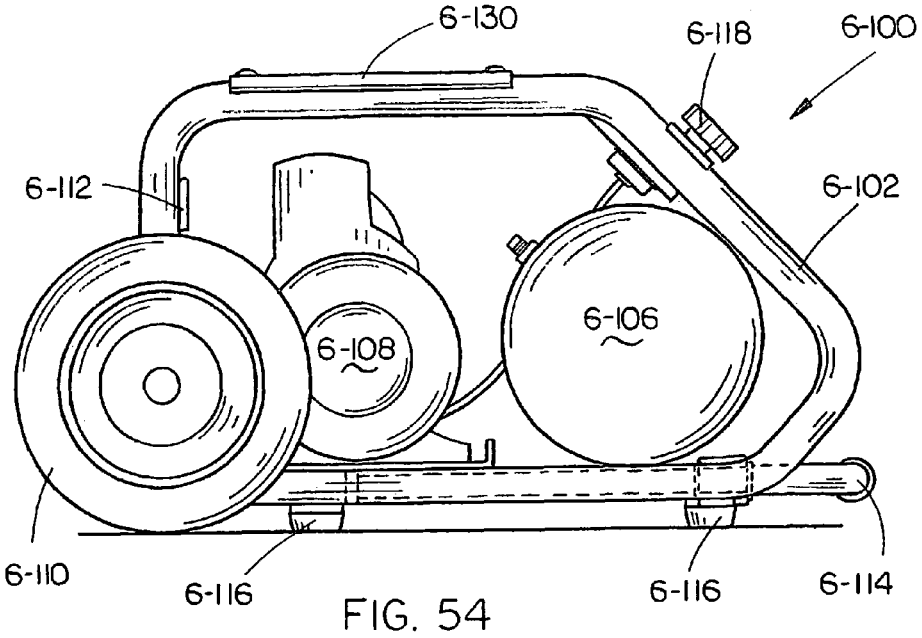
FIG. 54 is a side view of the air compressor assembly as shown in FIG. 53.
Figure 55:
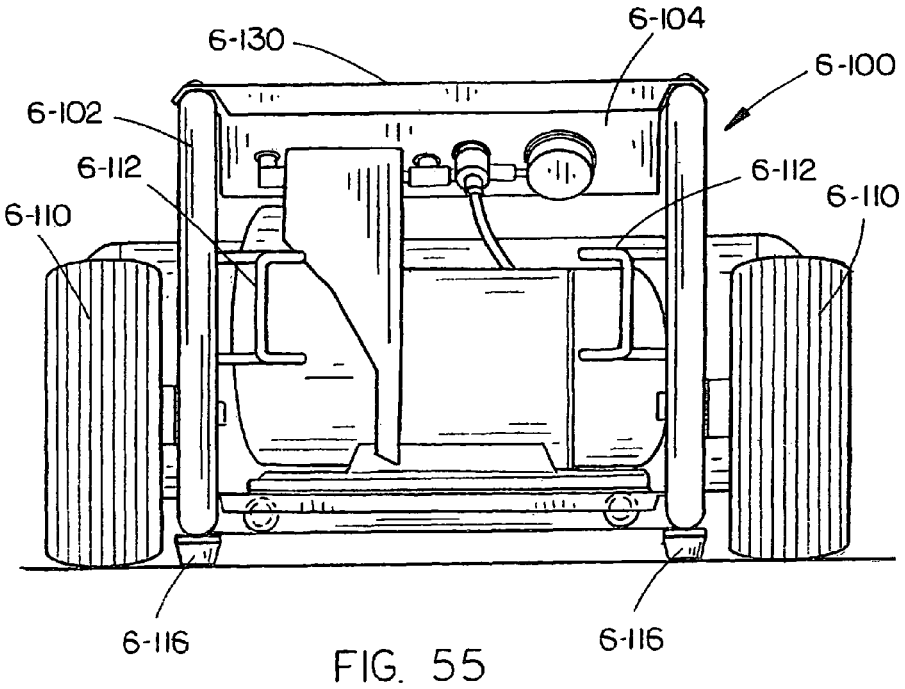
FIG. 55 is an end view of the air compressor assembly as shown in FIG. 53.
Figure 56:
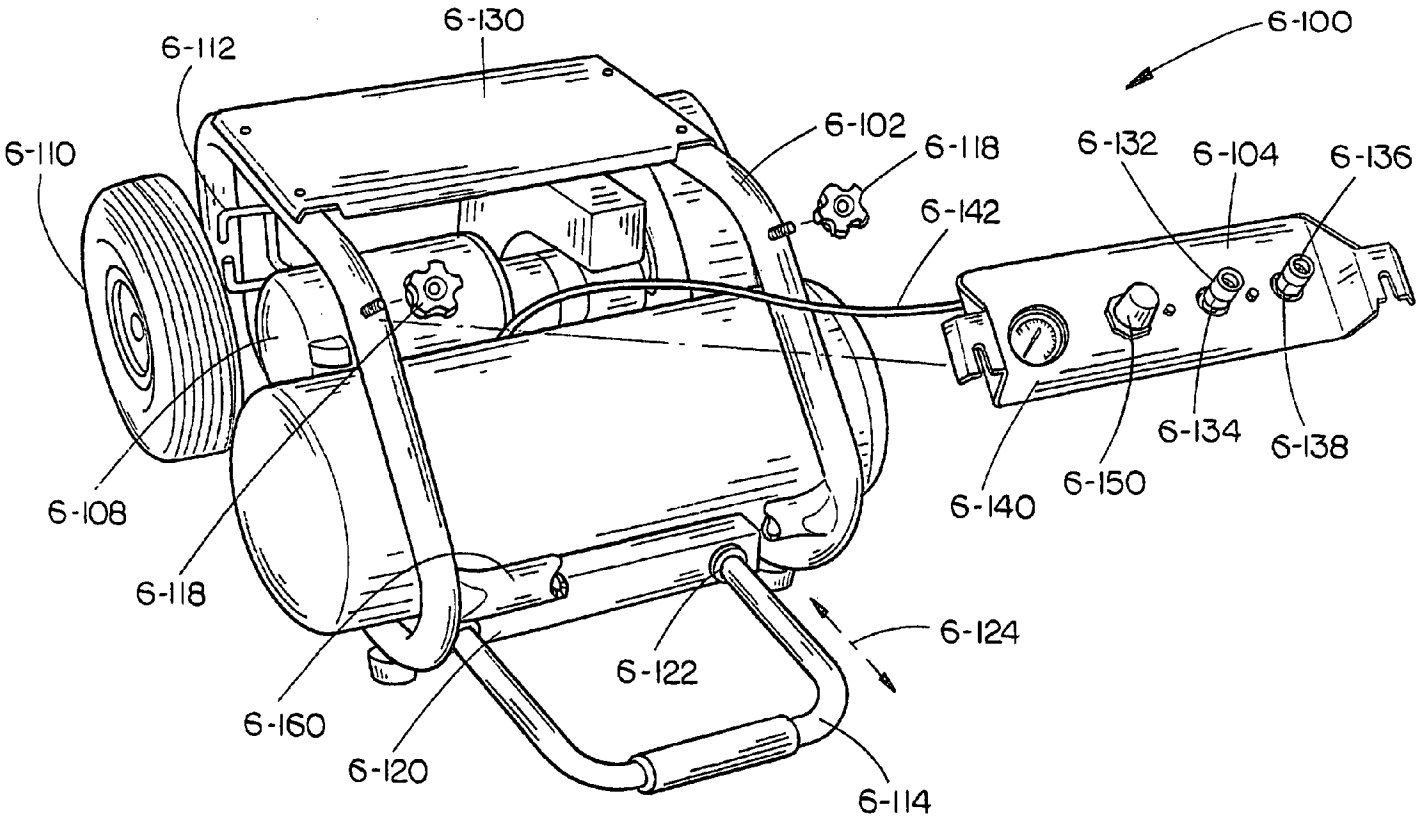
FIG. 56 is an isometric view of the air compressor assembly as shown in FIG. 53, wherein the manifold assembly is removed from a roll cage of the air compressor assembly and the extensible handle bar assembly is partially pulled out.

As shown in FIGS. 53 and 56, the manifold assembly 6-104 may include a pneumatic manifold (not shown) and at least one pressure regulator assembly 6-150, coupled to a supporting frame 6-140. Outlet ports 6-134, 6-138 within the pneumatic manifold are fitted with suitable couplers or connectors 6-132, 6-136 which extend through apertures in the frame 6-140 for allowing attachment and removal of air hoses to provide compressed air to one or more air powered tools. In exemplary embodiments of the invention, couplers 6-132, 6-136 may be comprised of quick-connect coupler bodies for allowing attachment and removal of air hoses without the use of tools. Alternatively, one or more of the outlet ports 6-134, 6-138 may be fitted with a quick-connect coupler plug or stud allowing attachment of air hoses equipped with a quick-connect coupler bodies, a threaded connector (male or female), or the like as contemplated by one of ordinary skill in the art. The manifold assembly 6-104 may be mounted to the roll cage 6-102 through a fastening means 6-118 (see FIG. 53). Alternatively, the manifold assembly 6-104 may be removed from the air compressor assembly 6-100 and coupled thereto via a single air hose 6-142 so the manifold assembly 6-104 may be utilized at locations remote from the air compressor assembly 6-100, as shown in FIG. 56.

Figure 57:
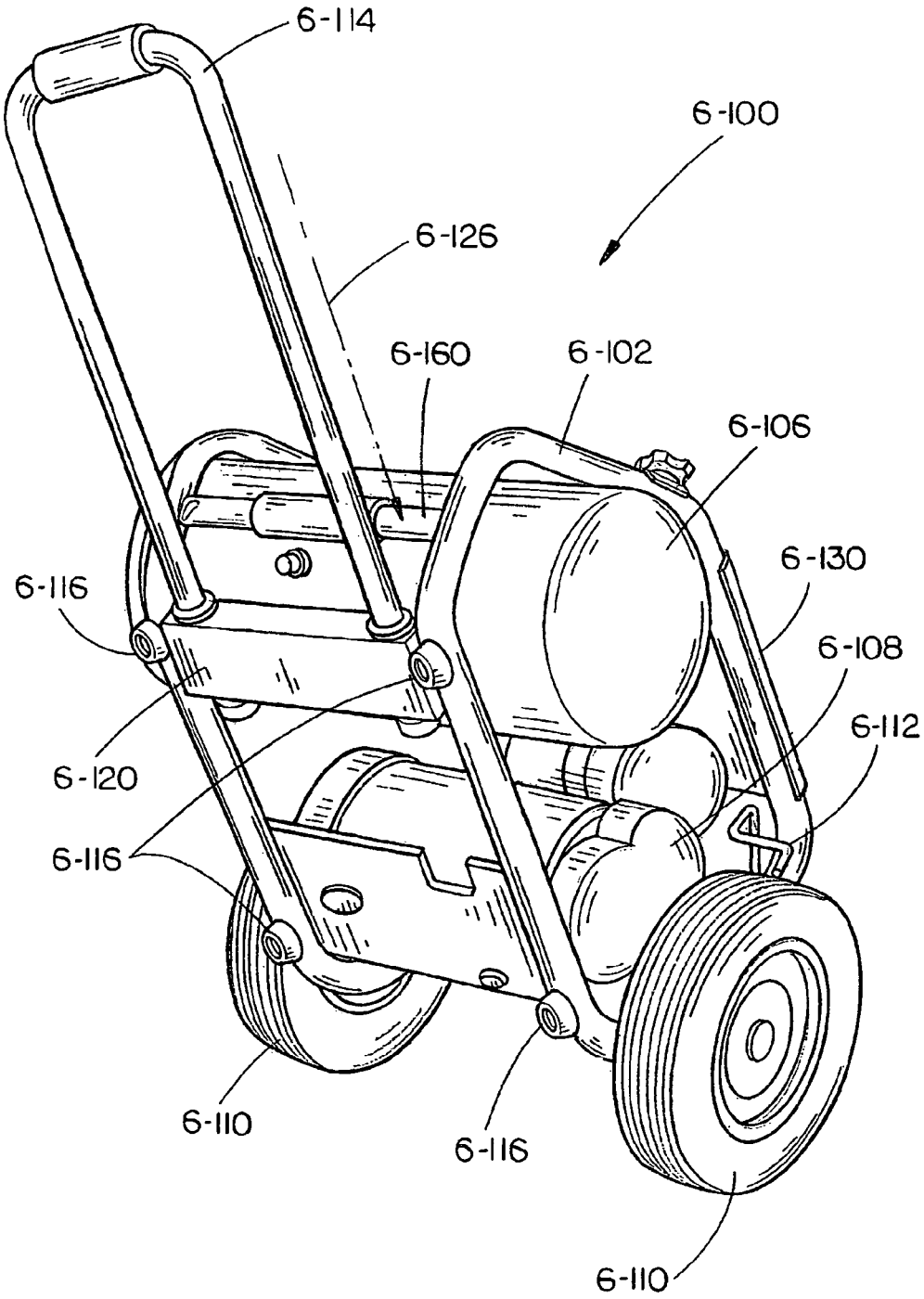
FIG. 57 is an isometric view of the air compressor assembly as shown in FIG. 53, wherein the extensible handle bar assembly is fully pulled out.
Figure 58:
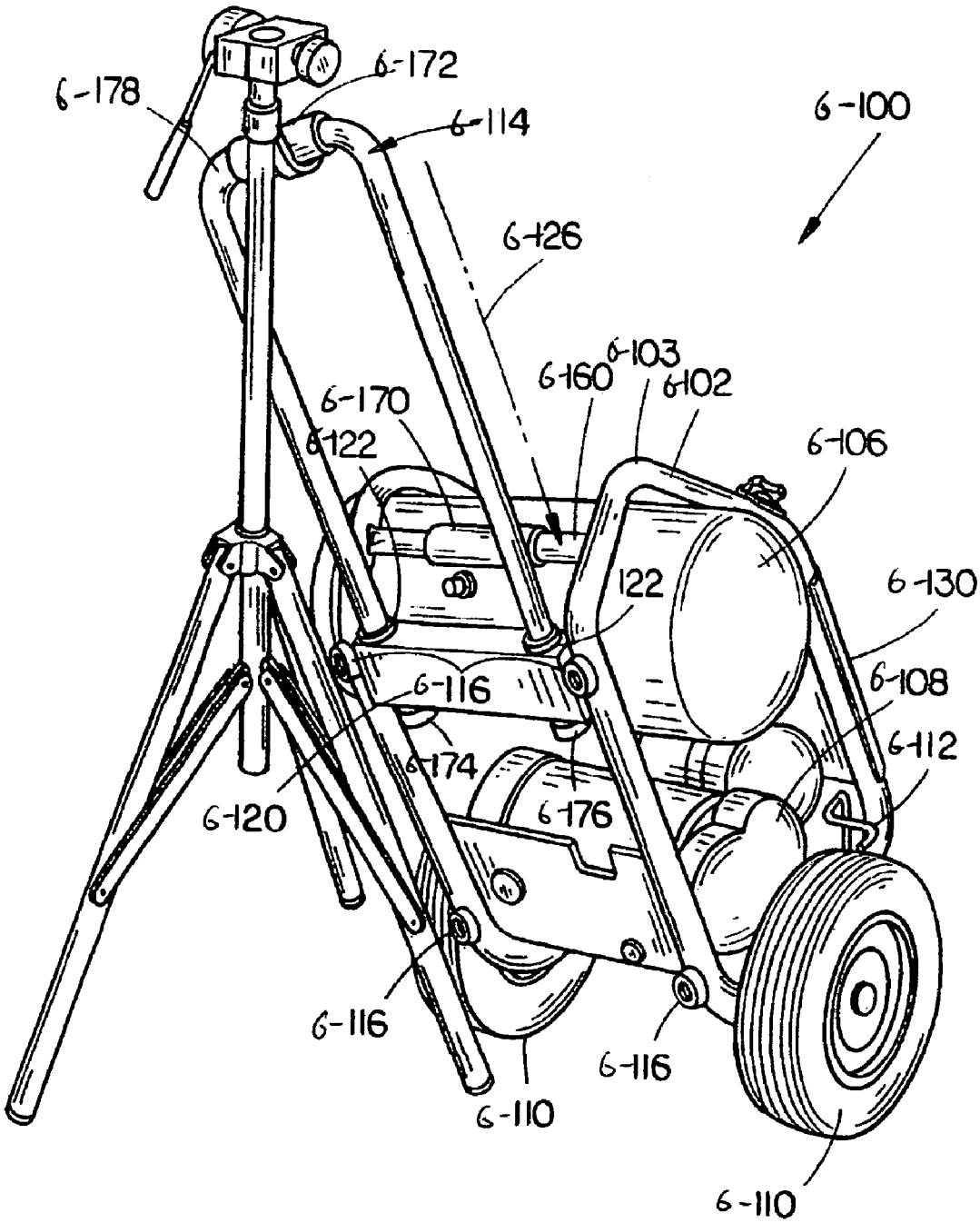
FIG. 58 is an isometric view of the air compressor assembly as shown in FIG. 53, wherein the extensible handle bar assembly is fully extended and coupled to a tripod.
Figure 59:
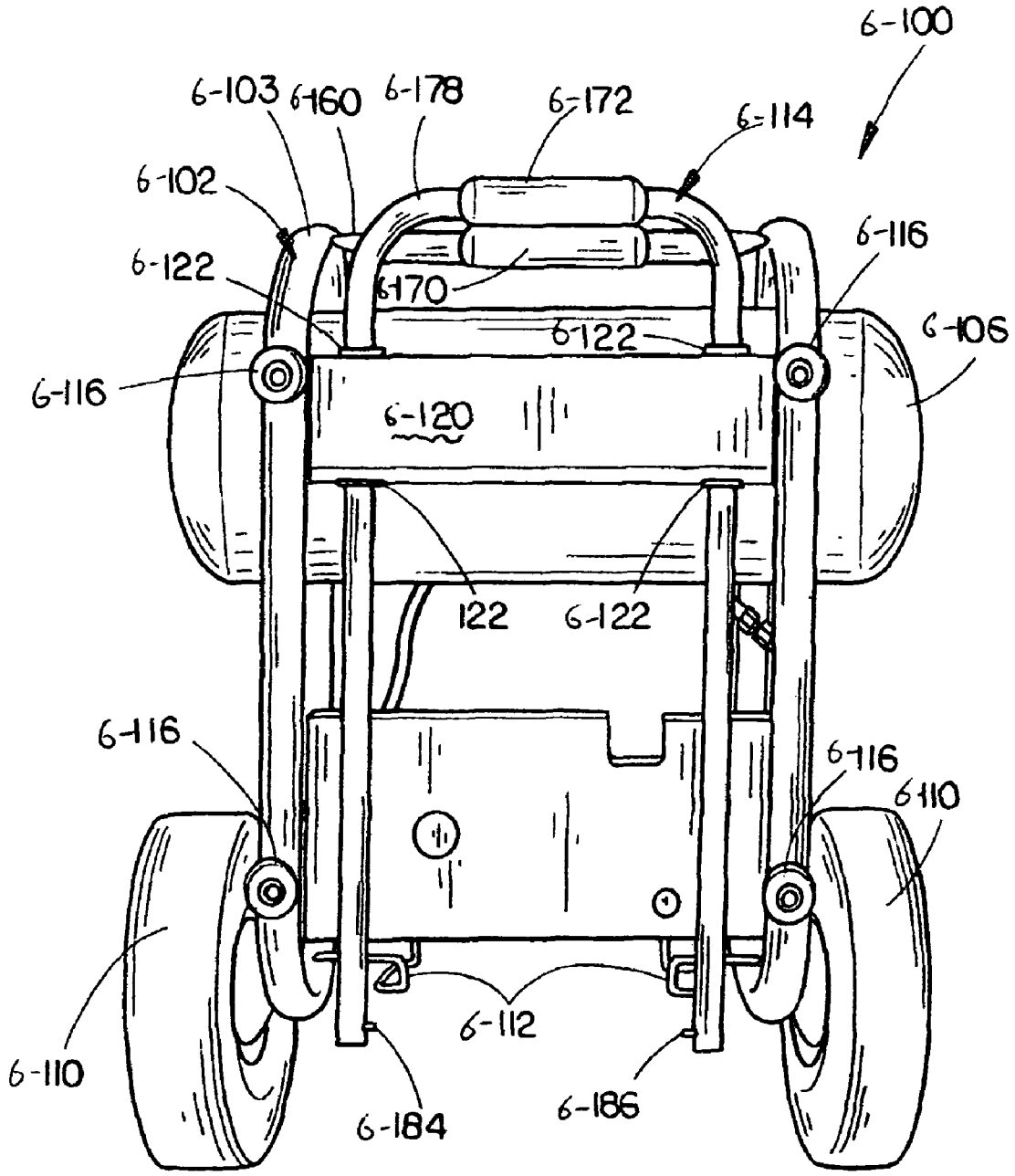
FIG. 59 is a bottom view of the air compressor assembly as shown in FIG. 53.

Referring to FIGS. 53, 56 and 57, the extensible handle bar assembly 6-114 may be mounted to the roll cage 6-102 through apertures 6-122 of the support member 6-120 and may be capable of telescopic movement. The extensible handle bar assembly 6-114 may be pushed in or pulled out along the line 6-124, as shown in FIG. 56. When the extensible handle bar assembly 6-114 is fully pushed in, as shown in FIG. 53, the air compressor assembly 6-100 occupies a small space, and the air compressor assembly 6-100 may be lifted using the lifting handle assembly 6-160. When the extensible handle bar assembly 6-114 is fully pulled out, as shown in FIG. 57, the extensible handle bar assembly 6-114, along with the wheel assembly 6-110, may allow the air compressor assembly 6-100 to be easily transported. When the air compressor assembly 6-100 reaches the destination, the extensible handle bar assembly 6-114 may be pushed in along the direction 6-126 to save space. When the air compressor assembly 100 reaches the destination, the extensible handle bar assembly 6-114 may be rested against a tripod (see, e.g., FIG. 58), or retracted along the direction 6-126 to save space.

Figure 60:
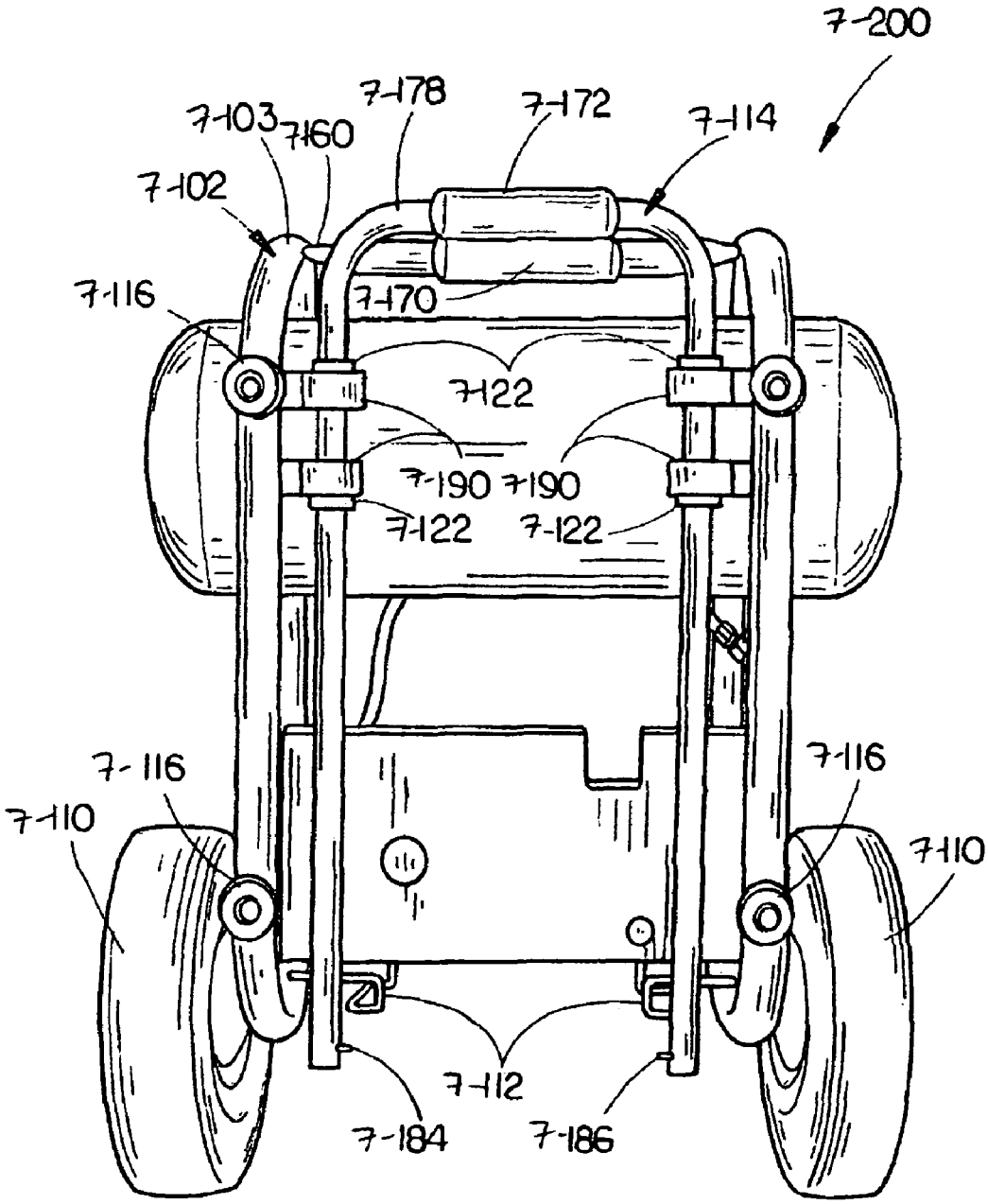
FIG. 60 is a bottom view of an air compressor assembly having an extensible handle bar assembly in accordance with an additional exemplary embodiment of the present invention.

FIG. 60 is a bottom view of an air compressor assembly 7-200 having an extensible handle bar assembly 7-114 in accordance with an additional exemplary embodiment of the present invention. The air compressor assembly 7-200 may have a structure similar to the air compressor assembly 6-100. However, the roll cage assembly 7-102 shown in FIG. 60 does not include the support member 6-120. Instead, the roll cage assembly 7-102 includes brackets 7-190 mounted to the roll cage 7-103. The brackets 7-190 may be made of metal, plastic, or the like. The legs of the handle bar 7-178 may be inserted into the brackets 7-190 for telescopic movement (i.e., the handle bar 7-178 is movable along longitudinal directions of the legs of the handle bar 7-178).

Figure 61:
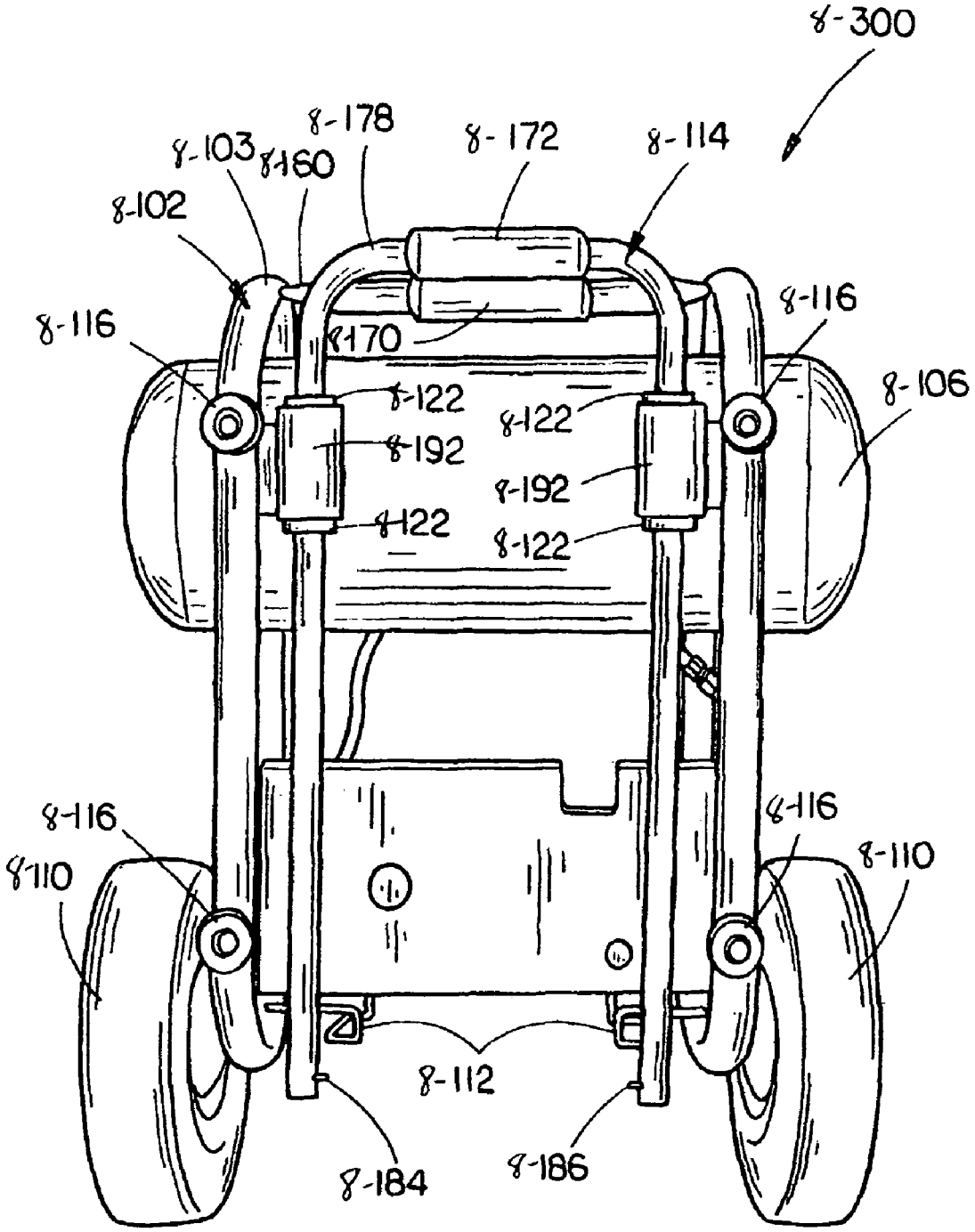
FIG. 61 is a bottom view of an air compressor assembly having an extensible handle bar assembly in accordance with another exemplary embodiment of the present invention.

FIG. 61 is a bottom view of an air compressor assembly having an extensible handle bar assembly in accordance with another exemplary embodiment of the present invention. The air compressor assembly 8-300 may have a structure similar to the air compressor assembly 6-100. However, the roll cage assembly 8-102 shown in FIG. 61 does not include the support member 6-120. Instead, the roll cage assembly 8-102 includes centrally hollow tubes or cylindrical channels 8-192 mounted to the roll cage 8-102. The tubes 8-192 may be made of metal, plastic, or the like. The legs of the handle bar 8-178 may be inserted into the pipes 8-192 for telescopic movement (i.e., the handle bar 8-178 is movable along longitudinal directions of the tubes 8-192). It is understood that channels that are not cylindrical may be used instead of the tubes 8-192 without departing from the scope and spirit of the present invention, It is understood that the extensible handle bar assembly shown in FIGS. 60 and 61 include stops as may be contemplated by a person of ordinary skill in the art at the handle bar 7-178, 8-178 for preventing the handle bar 7-178, 8-178 from being fully pulled out of the roll cage assembly 7-102, 8-102.

It is appreciated although a substantially U shaped handle bar is shown, a handle bar in any other shape may be used instead without departing from the scope and spirit of the present invention. For example, in an alternative embodiment, a L shaped single-legged handle bar may be used instead of the substantially U shaped double-legged handle bar.

The embodiments of the air compressor assembly and many of their attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An air compressor assembly comprising:

a first generally cylindrical tank configured to store compressed air;

an air compressor that includes a pump configured to deliver compressed air to the first tank and a motor configured to drive the pump;

a frame coupled to at least one of the first tank and the air compressor;

a manifold assembly directly and removably attachable to the frame of the air compressor assembly, the manifold assembly including an inlet for receiving compressed air from the first tank, a pressure regulator configured to regulate pressure output from the manifold assembly, a gauge configured to display the pressure of the air output from the manifold assembly, and an outlet configured to deliver the output air to a pneumatic tool; and an air conduit connected between the first tank and the manifold assembly, the manifold assembly being directly and removably coupled to the air conduit, wherein the inlet of the manifold assembly is configured to be coupled to the first tank via the air conduit when the manifold assembly is detached from the first tank and the frame so that the manifold assembly is operable at a location remote from the air compressor assembly, and wherein the manifold assembly is operable while decoupled from the air conduit and reattached to the first tank and the frame.

2. The air compressor assembly of claim 1, wherein the frame comprises a roll cage that at least partially encloses the air compressor.

3. The air compressor assembly of claim 2, wherein the roll cage at least partially encloses the first tank.

4. The air compressor assembly of claim 1, further comprising a wheel assembly coupled to the frame.

5. The air compressor assembly of claim 4, wherein the wheel assembly comprises an axle coupled to the frame, a first wheel coupled to a first end portion of the axle, and a second wheel coupled to a second, opposite end portion of the axle.

6. The air compressor assembly of claim 1, further comprising a second generally cylindrical tank for storing additional compressed air.

7. The air compressor assembly of claim 1, further comprising a telescoping handle coupled to the frame to assist in transporting the air compressor assembly.

8. The air compressor assembly of claim 1, further comprising a coupling member configured to attach the manifold assembly to the air compressor assembly.

9. The air compressor assembly of claim 1, wherein the air conduit comprises a hose.

10. An air compressor assembly comprising:

a means for providing a source of compressed air;

a means for distributing the compressed air to one or more pneumatic tools, a means for attaching and detaching the distributing means from the providing means;

wherein the distributing means is removably coupled to the providing means, so that when the means for attaching and detaching the distributing means from the providing means is decoupled from the providing means the distributing means is operable at a location remote from the providing means.

11. The air compressor of claim 10, wherein the providing means comprises a pump, a motor, and a storage tank.

12. The air compressor of claim 10, wherein the distributing means comprises a manifold assembly.

13. The air compressor of claim 10, further comprising a means for transporting the air compressor.

14. The air compressor of claim 13, wherein the transporting means comprises a wheel assembly.

15. The air compressor of claim 14, wherein the transporting means further comprises a handle.

16. The air compressor of claim 15, wherein the handle is retractable.

17. The air compressor of claim 10, further comprising means for at least partially enclosing a portion of the distributing means.

18. The air compressor of claim 17, wherein the enclosing means comprises a roll-cage assembly.

19. An air compressor comprising:

a roll cage frame defined by at least one substantially tubular member, the frame having a bottom portion, a top portion, a rear portion, and a front portion, the top portion being spaced from and substantially parallel to the bottom portion, the rear portion extending between the top and bottom portions, and the front portion extending toward the top portion from the bottom portion at an angle to the bottom portion;

a generally cylindrical compressed air storage tank supported by the bottom portion adjacent a junction between the bottom portion and the front portion;

a pump configured to deliver compressed air to the tank and a motor configured to drive the pump, the pump and motor supported on the bottom portion between the tank and the rear portion and substantially enclosed by the bottom portion, the rear portion, and the top portion;

a pair of wheels coupled to the frame adjacent a junction between the bottom portion and the rear portion;

a telescoping handle coupled to the frame, the handle positioned parallel to the bottom portion and with a grip portion of the handle extending beyond the front portion to facilitate transporting the air compressor on the wheels;

a manifold assembly directly and removably couplable to the roll cage frame, the manifold assembly including an inlet for receiving compressed air from the tank, a pressure regulator configured to regulate pressure output from the manifold assembly, a gauge configured to display the pressure of the air output from the manifold assembly, and an outlet configured to deliver the output air to a pneumatic tool; and an air conduit connected between the first tank and the manifold assembly, the manifold assembly being directly and removably coupled to the air conduit, wherein the inlet of the manifold assembly is configured to be coupled to the tank via the air conduit when the manifold assembly is detached from the roll cage frame so that the manifold assembly is operable at a location remote from the air compressor, and wherein the manifold assembly can be decoupled from the air conduit and reattached to the roll cage frame.

20. The air compressor of claim 19, further comprising a stationary handle to facilitate lifting the compressor.

21. The air compressor of claim 20, wherein the stationary handle is coupled to the air compressor adjacent the tank.

22. The air compressor assembly of claim 19, wherein the air conduit comprises a hose.

* * * * *